US009170530B2

(12) United States Patent
Oshikawa et al.

(10) Patent No.: US 9,170,530 B2
(45) Date of Patent: Oct. 27, 2015

(54) POWDER CONTAINER AND IMAGE FORMING APPARATUS INCORPORATING SAME

(75) Inventors: Yuki Oshikawa, Kanagawa (JP); Yuuki Satoh, Kanagawa (JP); Takuya Seshita, Kanagawa (JP); Toshiki Hayashi, Kanagawa (JP); Masashi Nagayama, Shizuoka (JP); Hiroyuki Uenishi, Kanagawa (JP); Tomoji Ishikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 346 days.

(21) Appl. No.: 13/157,796

(22) Filed: Jun. 10, 2011

(65) Prior Publication Data

US 2011/0305485 A1 Dec. 15, 2011

(30) Foreign Application Priority Data

Jun. 14, 2010 (JP) ..... 2010-135462

(51) Int. Cl.
*G03G 15/06* (2006.01)
*G03G 15/08* (2006.01)

(52) U.S. Cl.
CPC ..... *G03G 15/0879* (2013.01); *G03G 15/087* (2013.01); *G03G 15/0872* (2013.01)

(58) Field of Classification Search
CPC ..... G03G 15/087; G03G 15/0879; G03G 15/0877; G03G 15/0872; G03G 15/0887; G03G 15/0889; G03G 15/0891
USPC ..... 399/119, 120, 252, 258, 260, 261
See application file for complete search history.

(56) References Cited

U.S. PATENT DOCUMENTS

| | | | | |
|---|---|---|---|---|
| 4,212,264 | A | 7/1980 | Knechtel et al. | |
| 5,918,090 | A * | 6/1999 | Ichikawa et al. | 399/120 |
| 7,773,920 | B2 | 8/2010 | Oshikawa | |
| 7,783,209 | B2 | 8/2010 | Uno et al. | |
| 2007/0081833 | A1 | 4/2007 | Koyama et al. | |

(Continued)

FOREIGN PATENT DOCUMENTS

| | | |
|---|---|---|
| JP | 53-146639 | 12/1978 |
| JP | 9-311535 | 12/1997 |

(Continued)

OTHER PUBLICATIONS

Office Action issued Oct. 8, 2012, in Chinese Patent Application No. 201110154571.7.

(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A powder container includes a cylindrical container body to contain a powder, having an opening in one end thereof, to convey the powder contained in the container body to the opening with rotation of the container body, and having a container-body projection provided on an outer circumferential surface of the container body; and a cylindrical holder, into which the end of the container body having the opening is inserted, to hold the container body rotatably, having a powder outlet through which the powder is discharged from the holder and a holder projection provided on an inner circumferential surface thereof. The container-body projection repetitively contacts and separates from the holder projection with rotation of the container body to vibrate the container body and the holder.

19 Claims, 38 Drawing Sheets

(56) References Cited

U.S. PATENT DOCUMENTS

| | | | | |
|---|---|---|---|---|
| 2008/0175628 | A1 | 7/2008 | Kita et al. | |
| 2008/0181670 | A1 | 7/2008 | Tsuda et al. | |
| 2008/0193169 | A1* | 8/2008 | Teramura | 399/262 |
| 2008/0240792 | A1 | 10/2008 | Kita et al. | |
| 2008/0253810 | A1 | 10/2008 | Tateyama et al. | |
| 2009/0041508 | A1 | 2/2009 | Oshikawa et al. | |
| 2009/0087214 | A1 | 4/2009 | Utsunomiya et al. | |
| 2009/0103935 | A1 | 4/2009 | Uno et al. | |
| 2009/0110425 | A1 | 4/2009 | Uno et al. | |
| 2009/0263164 | A1 | 10/2009 | Koeda et al. | |
| 2010/0046985 | A1* | 2/2010 | Fuchigami | 399/159 |

FOREIGN PATENT DOCUMENTS

| | | |
|---|---|---|
| JP | S11-143194 | 5/1999 |
| JP | 2000-89638 | 3/2000 |
| JP | 3280504 | 2/2002 |
| JP | 2002-365895 | 12/2002 |
| JP | 2003-287946 | 10/2003 |
| JP | 3535721 | 3/2004 |
| JP | 3545916 | 4/2004 |
| JP | 2006-235306 A | 9/2006 |
| JP | 2007-102134 | 4/2007 |
| JP | 2008-070815 | 3/2008 |

OTHER PUBLICATIONS

U.S. Appl. No. 13/075,641, filed Mar. 30, 2011, Oshikawa, et al.

Japanese Office Action issued Jan. 17, 2014, in Patent Application No. 2010-135462.

* cited by examiner

YELLOW

MAGENTA

CYAN

BLACK

POWDER CONTAINER AND IMAGE FORMING APPARATUS INCORPORATING SAME

CROSS-REFERENCE TO RELATED APPLICATIONS

This patent specification is based on and claims priority from Japanese Patent Application No. 2010-135462, filed on Jun. 14, 2010 in the Japan Patent Office, which is hereby incorporated by reference herein in its entirety.

BACKGROUND

1. Technical Field

The present invention generally relates to a powder container for containing powder such as toner and an image forming apparatus such as a copier, a printer, a facsimile machine, a plotter, or a multifunction machine capable of at least two of these functions that includes the powder container.

2. Description of the Background Art

In general, electrophotographic image forming apparatuses such as copiers, printers, facsimile machines, or multifunction machines including at least two of these functions include a development device to develop latent images formed on an image carrier. In addition, cylindrical toner containers for containing toner, removably installable in main bodies of image forming apparatuses, are widely used.

For example, FIGS. 55 through 57 show a related art toner container proposed in JP-H11-109737-A. In an image forming apparatus shown in FIG. 55, a toner container 320Y is installed in a toner supply device (toner container mount) 310. The toner container 320Y includes a cylindrical bottle 320Y2 to contain a powder such as toner and a cap 320Y1 to engage an end of the bottle 320Y2. The toner supply device 310 includes a toner hopper 700, serving as a holder, to engage the other end of the cap 320Y1 of the toner container 320Y and hold the bottle 320Y2 rotatably, a bottle receiving portion 600, a coupling member 910, a spring 930, and a driving source 900. The bottle 320Y2 has spiral protrusions 320Y2*a* formed in an inner circumferential surface of the bottle 320Y2 and an opening positioned in one end in which the cap 320Y1 is engaged. A toner outlet is formed in the cap 320Y1.

As the bottle 320Y2 rotates, the toner contained in the bottle 320Y2 is transported along the spiral protrusions 320Y2*a* to the opening of the bottle 320Y2. The toner discharged from the bottle 320Y2 is discharged outside the toner container 320Y through the toner outlet in the cap 320Y1 and supplied to a development device provided inside a main body 1000 of the image forming apparatus through the toner hopper 700 in the toner supply device 310.

A coupling engaged portion 320Y2*h* is provided on a posterior end of the bottle 320Y2 that is an end opposite the end at which of the cap 320Y1 is located. The coupling engaged portion 320Y2*h* includes an outer cylindrical wall 320Y2*g*, a central support ring 320Y2*d*, and multiple spokes 320Y2*b* (projections) connected between the outer cylindrical wall 320Y2*g* and the central support ring 320Y2*d*. In addition, a central cylindrical recess 320Y2*f* and multiple divided annular recesses 320Y2*e* are formed in the coupling engaged portion 320Y2*h*.

The coupling engaged portion 320Y2*h* of the bottle 320Y2 is engaged with the coupling member 910 that presses the bottle 320Y2 of the toner container 320Y by the spring 930 provided in the toner supply device 310 in the main body 1000. The driving source 900 to generate a rotary driving force is connected to the spring 930 and is provided in the main body 1000. The coupling member 910 transmits torque from the driving source 900 via the spring 930. A columnar center rotary shaft 912 and multiple tabs 911 are provided on a lateral face of the coupling member 910, facing the posterior end of the bottle 320Y2, and the multiple tabs 911 are arranged at a predetermined pitch in a rotary direction around the columnar center rotary shaft 912 on the lateral face.

With this example, the coupling member 910 is engaged with the coupling engaged portion 320Y2*h* by contacting the respective tabs 911 of the coupling member 910 with the spokes 320Y2*b* (projections) of the coupling-engaged portion 320Y2*h* of the bottle 320Y2. When the coupling member 910 in the main body 1000 rotates in this state, the bottle 320Y2 and the cap 320Y1 are rotated in a state in which the bottle 320Y2 and the cap 320Y1 are held by the toner hopper 700.

With this example configuration of the image forming apparatus, the toner in the bottle 320Y2 of the toner container 320Y can be discharged outside, without providing a rotary conveyance member that conveys the toner in the bottle 320Y2, thus reducing the cost of the toner container 320Y. However, in this configuration, since the toner in the bottle 320Y2 is not softened by the rotary conveyance member, the toner is more likely to form agglomeration.

In an effect to counteract the above-described problem that the toner is more likely to form agglomeration, the bottle 320Y2 is rotated in reverse in this example. More specifically, with reference to FIGS. 56 and 57, each of the multiple tabs 911 of the coupling member 910 has a setting face 911*d* positioned on an upstream lateral end of the rotary direction, a sloped face 911*c* positioned on a downstream lateral end of the rotary direction, a top face 911*b*, an exterior face 911*a*, and an inner face 911*e*. When the driving source 900 drives the bottle 320Y2 to rotate normally in a direction indicated by arrow E shown in FIGS. 55 through 57, the rotary driving force is exerted to the bottle 320Y2 in a state in which the setting faces 911*d* of multiple tabs 911 in the coupling member 910 in the main body 1000 hang with (closely contact) upstream faces of the spokes 320Y2*b* (projections) in the normally rotation direction of the coupling engaged portion 320Y2*h* of the bottle 320Y2 of the toner container 320Y. Conversely, when the driving source 900 drives the bottle 320Y2 to rotate in reverse in a direction indicated by arrow F shown in FIGS. 55 through 57, the sloped faces 911*c* of the multiple tabs 911 of the coupling member 910 respectively contact the spokes 320Y2*b* of the coupling engaged portion 320Y2*h* of the bottle 320Y2. Then, since the sloped faces 911*c* of the multiple tabs 911 cannot hang with the spokes 320Y2*b* of the coupling engaged portion 320Y2*h* of the bottle 320Y2, the sloped face 911*c* of the tabs 911 slide on respective edges of top faces of the spokes 320Y2*b* of the coupling engaged portion 320Y2*h* of the bottle 320Y2. At this time, the coupling member 910 that is pressed to the bottle 320Y2 of the toner container 320Y by the spring 930 is pressed back to a direction opposite the direction in which the spring force from the spring 930 is exerted, and the coupling member 910 is moved to the main body side (driving source 900 side) with to respect to the posterior end of the bottle 320Y2 in the bottle axis direction (longitudinal direction of the bottle 320Y2). Thus, the tabs 911 of the coupling member 910 cross over the spokes 320Y2*b* of the bottle 320Y2 of the toner container 320Y while the coupling member 910 moves to the main body side with respect to the posterior end of the bottle 320Y2. Then, the tabs 911 of the coupling member 910 are taken off from the top faces of the spokes 320Y2, and the tabs 911 enter the divided annular recesses 320Y2*e* positioned next to the spokes 320Y2*b* (projections) of the coupling engaged portion 320Y2*h* of the bottle 320Y2. At this time, the coupling member 910 moves to a position at which a vicinity of a base of the tabs 911 of the coupling member 910 (the lateral face of the coupling member 910) strongly contacts the top faces of the spokes 320Y2*b* at a burst. Thus, due to the impact of the contacting coupling member 910 and the coupling engaged portion 320Y2*h*, a great vibration can be generated in the bottle 320Y2, which can break the agglomeration of the toner in the bottle 320Y2.

However, since the agglomeration of the toner is broken up while the bottle 320Y2 of the toner container 320Y is rotated in reverse, the toner in the bottle 320Y2 cannot be conveyed to the toner hopper 700 at this time. Therefore, in order to alleviate the growth of the toner agglomeration, it is necessary to stop the continuous printing operation periodically and rotate the bottle 320Y2 in reverse, which increases the printing time.

Although problems arising in the bottle 320Y2 of the toner container 320Y (powder container) are described above, similar problems may occur in a powder supplying device including the powder container in an image forming apparatuses.

SUMMARY

In an aspect of this disclosure, there is a provided a powder container that includes a cylindrical container body and a cylindrical holder. The cylindrical container body to contain a powder, having an opening in one end thereof, to convey the powder contained in the container body to the opening with rotation of the container body, and having a container-body projection provided on an outer circumferential surface thereof. The cylindrical holder, into which the end of the container body having the opening is inserted, to hold the container body rotatably, having a powder outlet through which the powder is discharged from the holder and a holder projection provided on an inner circumferential surface thereof. The container-body projection repetitively contacts and separates from the holder projection with rotation of the container body to vibrate the container body and the holder.

In another aspect, there is provided an image forming apparatus that includes an image forming unit to form a toner image, a toner supply device to supply toner to the image forming unit; and the toner container as described above to supply the toner to the toner supply device.

BRIEF DESCRIPTION OF THE DRAWINGS

A more complete appreciation of the aforementioned and other features, aspects and advantages will bet better understood by reference to the following detailed description when considered in connection with the accompanying drawings, wherein.

DETAILED DESCRIPTION OF PREFERRED EMBODIMENTS

Figure 1:
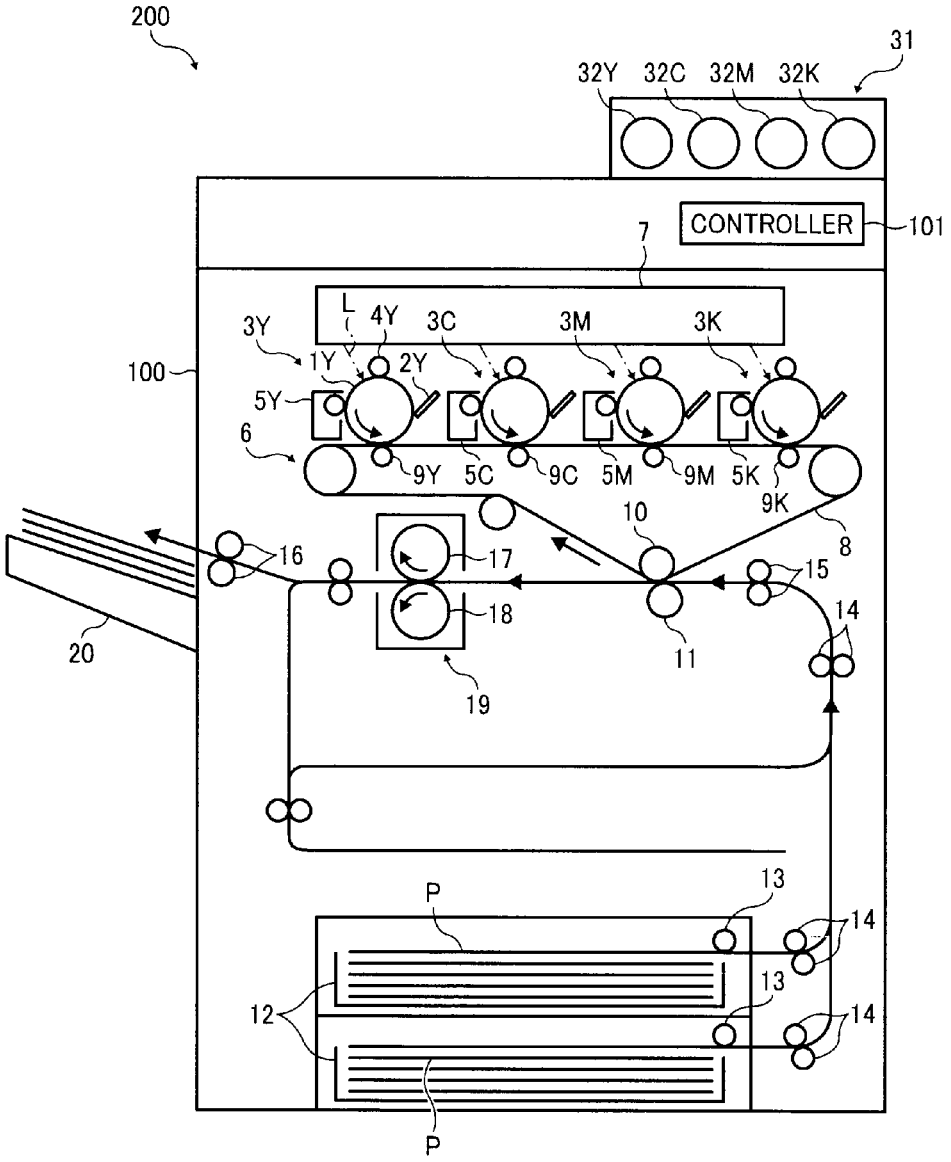
FIG. 1 is a schematic diagram illustrating a configuration of an image forming apparatus according to illustrative embodiments of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
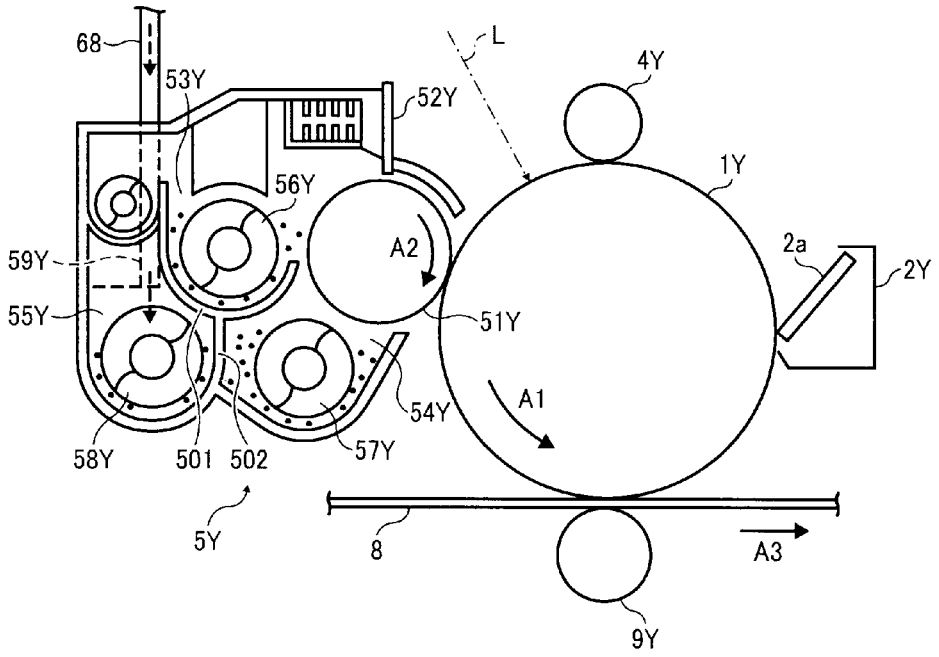
FIG. 2 is a schematic cross-sectional view illustrating a configuration of an image forming unit included in the image forming apparatus shown in FIG. 1.

Referring now to the drawings, wherein like reference numerals designate identical or corresponding parts throughout the several views thereof, and particularly to FIGS. 1 and 2, an electrophotographic image forming apparatus according to illustrative embodiments of the present disclosure is described. It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary.

A configuration and operation of an image forming apparatus according to the present embodiments is described below with reference to FIGS. 1 and 2.

As shown in FIG. 1, an image forming apparatus 200 includes a toner container mount 31, serving as a powder container mount (frame), provided above a main body 100 of the image forming apparatus 200. Four toner containers 32Y, 32M, 32C, and 32K (shown in FIG. 3) for containing yellow, magenta, cyan, and black toners, respectively, are removably installed in the toner container mount 31. That is, the toner containers 32Y, 32M, 32C, and 32K are replaceable.

The image forming apparatus 200 according to the present embodiments includes four image forming units 3Y, 3M, 3C, and 3K for forming yellow, magenta, cyan, and black toner images, respectively. Each of the image forming units 3Y, 3M, 3C, and 3K are removably installable in the main body 100.

Figure 3:
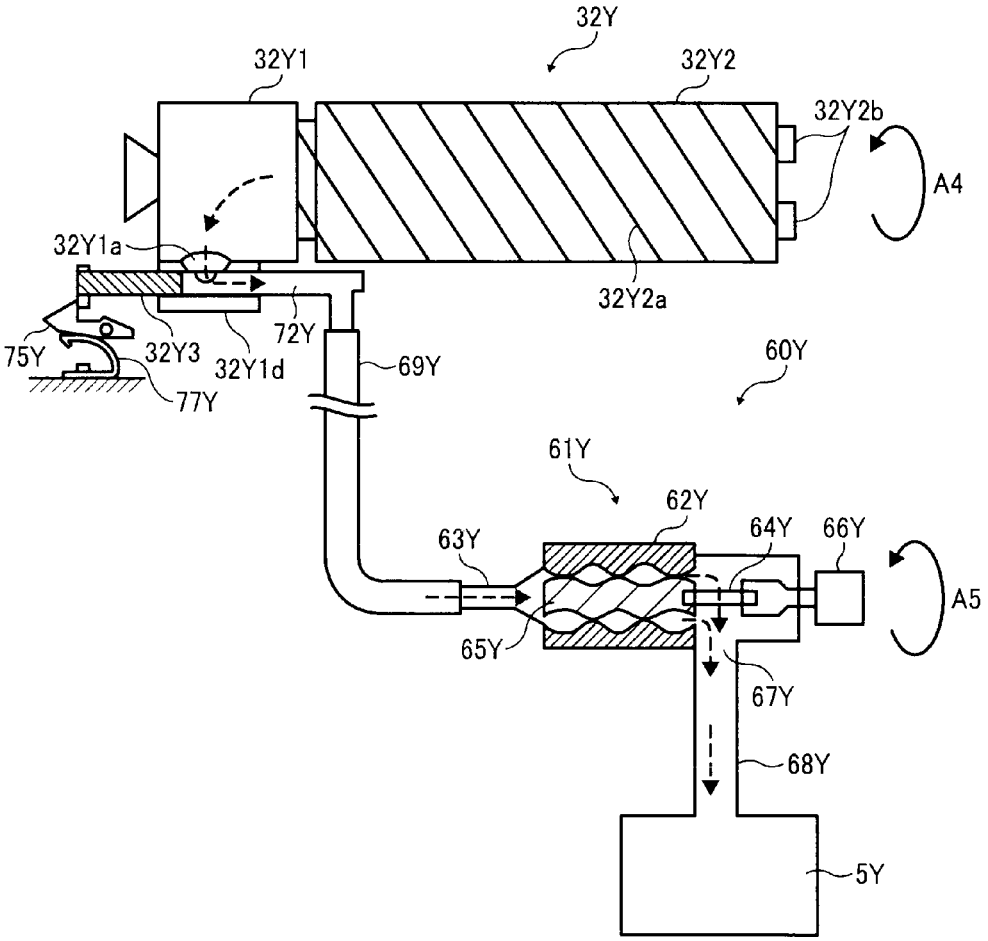
FIG. 3 is a schematic diagram that illustrates a toner supply device and a toner container.

Although not shown in FIG. 1, toner supply devices 60Y, 60M, 60C, and 60K shown in FIG. 3 are provided above the image forming units 3Y, 3M, 3C, and 3K. Each toner supply device 60 supplies the toner contained in the corresponding toner container 32 to a development device 5 of the corresponding image forming unit 3.

Referring to FIG. 2, the image forming unit 3Y for yellow includes a photoreceptor drum 1Y and further includes a charging member 4Y, the development device 5Y, a cleaning unit 2Y, a discharger, and the like provided around the photoconductor drum 1Y. Image forming processes, namely, charging, exposure, development, transfer, and cleaning processes are performed on the photoreceptor drum 1Y, and thus a yellow toner image is formed on the photoreceptor drum 1Y.

It is to be noted that other image forming units 3 have a similar configuration to that of the yellow image forming unit 3Y except the color of the toner used therein and form toner images of the respective colors. Thus, only the image forming unit 3Y is described below and descriptions of other image forming units are omitted.

Referring to FIG. 2, the photoreceptor drum 1Y is rotated counterclockwise direction indicated by arrow A1 shown in FIG. 2 by a driving motor (not shown). A surface of the photoreceptor drum 1Y is charged uniformly at a position facing the charging member 4Y by the charging member 4Y (charging process).

When the photoreceptor drum 1Y reaches a portion to receive a laser beam L emitted from an exposure unit 7 (shown in FIG. 1), the photoreceptor drum 1Y is scanned with the laser beam L, and thus an electrostatic latent image for yellow is formed thereon (exposure process).

Then, the photoreceptor drum 1Y reaches a portion facing the development device 5Y, where the latent image is developed with toner into a yellow toner (Y toner) image (development process).

Then, the surface of the photoreceptor drum 1Y carrying the toner image enters a primary-transfer nip. The primary-transfer nip is a portion in which the primary-transfer bias roller 9Y presses the intermediate transfer roller 8 to the photoreceptor drum 1. A primary transfer bias is applied to the primary transfer roller 9 by a power supply (not shown). Thus, a primary electric field that causes the Y toner carried on the photoreceptor drum 1Y to be electrostatically moved to the intermediate belt 8 is formed in the primary transfer nip. In this configuration, when the Y toner image on the surface of the photoreceptor drum 1Y is transferred onto the surface of the intermediate transfer belt 8 by the primary electric field and the pressure in the primary-transfer nip (primary-transfer process). After the primary-transfer process, a certain amount of toner tends to remain on the photoreceptor drum 1Y.

When the surface of the photoreceptor drum 1Y after the Y toner image is transferred onto the intermediated transfer belt 8 reaches a position facing the cleaning unit 2Y, a cleaning blade 2*a* of the cleaning unit 2Y mechanically collects any toner remaining on the photoreceptor drum 1Y (cleaning process).

Subsequently, the discharger removes potentials remaining on the surface of the photoreceptor drum 1Y.

Thus, a sequence of image forming processes performed on the photoreceptor drum 1Y is completed.

The above-described image forming processes are performed in the image forming units 3M, 3C, and 3K similarly to the yellow image forming unit 3Y. That is, the exposure unit 7 disposed above the image forming units 3 in FIG. 1 directs laser beams L according to image data onto the photoreceptor drums 1 in the respective image forming units 3. Specifically, the exposure unit 7 includes light sources to emit the laser beams L, multiple optical elements, and a polygon mirror that is rotated by a motor. The exposure unit 7 directs the laser beams L to the respective photoreceptor drums 1 via the multiple optical elements while deflecting the laser beams L with the polygon mirror.

Then, the toner images formed on the respective photoreceptor drums 1 through the development process are transferred therefrom and superimposed one on another on the intermediate transfer belt 8. Thus, a multicolor toner image is formed on the intermediate transfer belt 8.

Referring now to FIG. 1, the intermediate transfer unit 6 includes the intermediate transfer belt 8, the four primary-transfer bias rollers 9, a secondary-transfer backup roller 10, multiple tension rollers, and a belt cleaning unit. The intermediate transfer belt 8 is supported by the multiple rollers and is rotated in the direction indicated by an arrow shown in FIG. 1 as one of the multiple rollers that serves as a driving roller rotates.

The four primary-transfer bias rollers 9 are pressed against the corresponding photoreceptor drums 1 via the intermediate transfer belt 8, and four contact portions between the primary-transfer bias rollers 9 and the corresponding photoreceptor drums 1 are the primary-transfer nips. Each primary-transfer bias roller 9 receives a transfer bias whose polarity is opposite the polarity of the toner.

While rotating in the direction indicated by the arrow shown in FIG. 1, the intermediate transfer belt 8 sequentially passes through the respective primary-transfer nips. Then, the single-color toner images are transferred from the respective photoreceptor drums 1 primarily and superimposed one on another on the intermediate transfer belt 8. Thus, the multicolor toner image is formed on the intermediate transfer belt 8. Then, the intermediate transfer belt 8 carrying the multicolor toner image reaches a portion facing the secondary-transfer roller 11 disposed facing the secondary-transfer backup roller 10. The secondary-transfer backup roller 10 and the secondary-transfer roller 11 press against each other via the intermediate transfer belt 8, and the contact portion therebetween is hereinafter referred o as a secondary-transfer nip. The multicolor toner image formed on the intermediate transfer belt 8 is transferred onto a sheet P (recording medium) transported to the secondary-transfer nip (secondary-transfer process). After the secondary-transfer process, a certain amount of toner tends to remain on the intermediate transfer belt 8.

When the intermediate transfer belt 8 reaches a position facing the belt cleaning unit, any toner remaining on the intermediate transfer belt 8 is collected by the belt cleaning unit. Thus, a sequence of image forming processes performed on the intermediate transfer belt 8 is completed.

The sheet P is transported by a sheet feeder 12 provided in the lower portion of the main body 100 to the secondary-transfer nip via a feed roller 13, pairs of conveyance rollers 14, and a pair of registration rollers 15. More specifically, the sheet feeder 12 contains multiple sheets P piled one on another. When the feed roller 13 is rotated counterclockwise in FIG. 1, the sheet P on the top is picked up and transported from the sheet feeder 12 to the pair of conveyance rollers 14.

Then, the conveyance rollers 14 transport the sheet P to the pair of registration rollers 15. The registration rollers 15 stop the sheet P by clamping the sheet P therebetween once and then forward the sheet P to the secondary-transfer nip, timed to coincide with the arrival of the multicolor toner image formed on the intermediate transfer belt 8. Thus, the multicolor toner image is recorded on the sheet P.

Subsequently, the sheet P onto which the multicolor image is transferred is transported to the fixing device 19. In the fixing device 19, the multicolor toner image is fixed on the sheet P with heat from a fixing roller 17 and pressure exerted by a pressure roller 18.

Then, the sheet P is discharged by a pair of discharge rollers 16 outside the apparatus and stacked on a stack tray 20 as an output image.

Thus, a sequence of image forming processes performed in the image forming apparatus 200 is completed. It is to be noted that the main body 100 of the image forming apparatus 200 further includes a controller 101 that is may be a computer including a central processing unit (CPU) and associated memory units (e.g., ROM, RAM, etc.), for example. The controller 101 performs various types of control processing by executing programs stored in the memory. Field programmable gate arrays (FPGA) may be used instead of the CPU.

Next, a configuration and operation of the development device 5Y in each image forming unit is described in further detail below with reference to FIG. 2.

The development device 5Y includes a development roller 51Y disposed facing the photoreceptor drum 1Y, a doctor blade 52Y disposed facing the development roller 51Y, a supply screw 56Y, a collecting screw 57, an agitation screw 58Y, and a toner concentration detector to detect the concentration of toner in the developer. A casing of the development device 5Y serves as a developer container and is divided, at least partially, into a supply compartment 53Y, a collecting compartment 54Y, and an agitation compartment 55Y (also collectively "the developer conveyance compartments 53Y, 54Y, and 55Y") in which the supply screw 56Y, the collecting screw 57Y, and the agitation screw 58Y are respectively provided. The development roller 51Y includes a magnet roller or multiple magnets fixed in position relative to the casing of the development device 5Y, a development sleeve that rotates around the magnet, and the like. Two-component developer consisting essentially of carrier (carrier particles) and toner (toner particles) is contained in the developer conveyance compartments 53Y, 54Y, and 55Y. The toner contained in the toner container 32Y is supplied through an inlet 59Y formed above the agitation compartment 55Y.

Arrangement of the components of the development device 5 is described in further detail below.

The supply compartment 53Y faces the development roller 51Y, and the developer contained in the supply compartment 53Y is supplied to the development roller 51Y. While supplying the developer to the developing roller 51Y, the supply screw 56Y provided in the supply compartment 53Y transports the developer in an axial direction of the development roller 51Y toward a back side of paper on which FIG. 2 is drawn. The doctor blade 52Y, serving as a developer regulator, that adjusts the amount of developer supplied to the development roller 51Y to a desired or given layer thickness is positioned downstream from a portion where the development roller 51Y faces the supply screw 56Y in a direction in which the development sleeve rotates, indicated by arrow A2.

The collection compartment 54Y is facing the development roller 51Y at a position downstream in the rotational direction of the development sleeve from a development area where the development roller 51Y faces the photoreceptor drum 1Y. The developer that has passed the development area and been separated from the development roller 51Y (hereinafter "developer after development") is collected in the collection compartment 54Y. The collecting screw 57Y is positioned in parallel to the axial direction of the development roller 51Y in the collection compartment 54Y. The collecting screw 57Y is spiral-shaped and transports the developer in the direction identical or similar to the direction in which the supply screw 56Y transports the developer (hereinafter "developer conveyance direction"). The developing roller 51Y and the supply compartment 53Y in which the supply screw 56Y is provided are arranged laterally, and the collection compartment 54Y in which the collecting screw 57Y is provided is positioned beneath the development roller 51Y.

The magnet roller provided inside the development sleeve of the development roller 51Y has a portion (release portion) where no magnetic force is present in a circumferential direction. When the developer carried on the sleeve surface of the development roller 51Y faces the release portion as the development sleeve rotates, the developer is separated from the sleeve surface of the development roller 51Y.

Alternatively, the magnet roller includes a repulsive magnetic field a repulsive magnetic field in the portion where the developer is to be separated from the sleeve surface of the development roller 51Y, instead of the portion where no magnetic force is present.

The agitation compartment 55Y is positioned beneath the supply compartment 53Y in parallel to the collection compartment 54Y. The agitation screw 58Y provided in the agitation compartment 55Y is shaped like a spiral and parallels the axial direction of the development roller 51Y. While agitating the developer, the agitation screw 58Y transports the developer in the axial direction of the development roller 51Y toward a front side of paper on which FIG. 2 is drawn, which is opposite the developer conveyance direction by the supply screw 56Y.

The developing unit 5Y further includes a first partition 501 including a portion separating the supply compartment 53Y from the agitation compartment 55Y. Although separated by the first partition 501, the supply compartment 53Y and the agitation compartment 55Y communicates with each other in both end portions in the direction perpendicular to the surface of paper on which FIG. 2 is drawn, through openings, namely, a first communication portion and a third communication portion respectively formed on the front side and the back side of paper on which FIG. 2 is drawn.

It is to be noted that the supply compartment 53Y and the collection compartment 54Y are separated by the first partition 501 as well, and no opening is formed in that portion of the first partition 501. Thus, the supply compartment 53Y does not communicate with the collection compartment 54Y.

The development device 5Y further includes a second partition 502 that includes a portion separating the agitation compartment 55Y from the collection compartment 54Y. Although separated by the second partition 502, an opening (second communication portion) through which the agitation compartment 55Y communicates with the collection compartment 54Y is formed in the second partition 502, in an end portion, that is, on the back side of paper on which FIG. 2 is drawn.

The development device 5Y configured as described above operates as follows.

The development sleeve of the development roller 51Y rotates in the direction indicated by the arrow A2 shown in FIG. 2. The developer held on the development roller 51Y by the magnetic field generated by the magnet roller is transported as the development sleeve rotates.

The ratio of the toner to the carrier (the concentration of toner) in the developer contained in the development device 5Y is adjusted within a predetermined range. More specifically, the toner supply device 60Y supplies toner from the toner container 32Y to the agitation compartment 55Y according to the consumption of toner in the development device 5Y. The configuration and operation of the toner supply device 60 are described in further detail later.

The toner supplied to the agitation compartment 55Y is transported to the front side of paper on which FIG. 2 is drawn through the agitation compartment 55Y by the agitation screw 58Y while mixed with the developer. The developer that has reached a downstream end portion of the supply compartment 53Y is supplied therefrom to the supply compartment 53Y through the opening (first communication portion) of the first partition 501, which is positioned in the downstream end portion in the developer conveyance direction by the agitation screw 58Y and in an upstream end portion (proximal end portion) in the developer conveyance direction by the supply screw 54Y.

Then, the supply screw 56Y transports the developer supplied from the agitation compartment 55Y to the supply compartment 53Y downstream in the supply compartment 53Y while supplying it to the development roller 51Y. Then, the developer that is not supplied to the development roller 51Y (excessive developer) but is transported to the downstream end portion of the supply compartment 53Y is transported through the opening (third communication portion) formed in the first partition 501 to the agitation compartment 55Y.

The developer carried on the development roller 51Y is transported in the direction indicated by the arrow A2 in FIG. 2 to the doctor blade 52Y. The amount of the developer on the development roller 51Y is adjusted to a suitable amount by the doctor blade 52Y, after which the developer is carried to the development area facing the photoreceptor drum 1Y. Then, the toner in the developer adheres to the latent image formed on the photoreceptor drum 1Y due to the effect of the magnetic field generated in the development area. Subsequently, the developer remaining on the development roller 51Y is separated from the development roller 51Y and drops to the collection compartment 54Y. The developer collected from the development roller 51Y in the collection compartment 54Y is transported by the collection screw 57Y to a downstream end portion of the collection compartment 54Y in the conveyance direction therein, after which the collected developer is transported to the agitation compartment 58Y through the opening or a second communication portion of the second partition 502.

While being mixed with the toner supplied to the agitation compartment 55Y, the excessive developer and the collected developer supplied to the agitation compartment 55Y are transported by the agitation screw 58Y through the agitation compartment 55Y to the front side of paper on which FIG. 2 is drawn. Then, the mixed developer is supplied through the opening of the first communication portion in the first partition 501 to the supply compartment 53Y.

The toner concentration detector is provided beneath the agitation compartment 55Y, and toner is supplied by the toner supply device 60 from the toner container 32Y according to outputs from the toner concentration detector. The toner concentration detector may be a magnetic permeability sensor, for example.

Each of the toner containers 32Y, 32M, 32C, and 32K in toner container mount 31 has the same basic configuration, differing only in the color of toner used therein as an image forming material. Using the toner container 32Y purely as an example, the configuration of the toner container 32Y, 32M, 32C, and 32K is described in further detail below.

Next, a toner supply assembly according to the present embodiments is described below. The toner supply device 60, the toner container 32, the toner container mount 31 provided in the main body 100, and the controller 101 together form the toner supply assembly.

Figure 4:
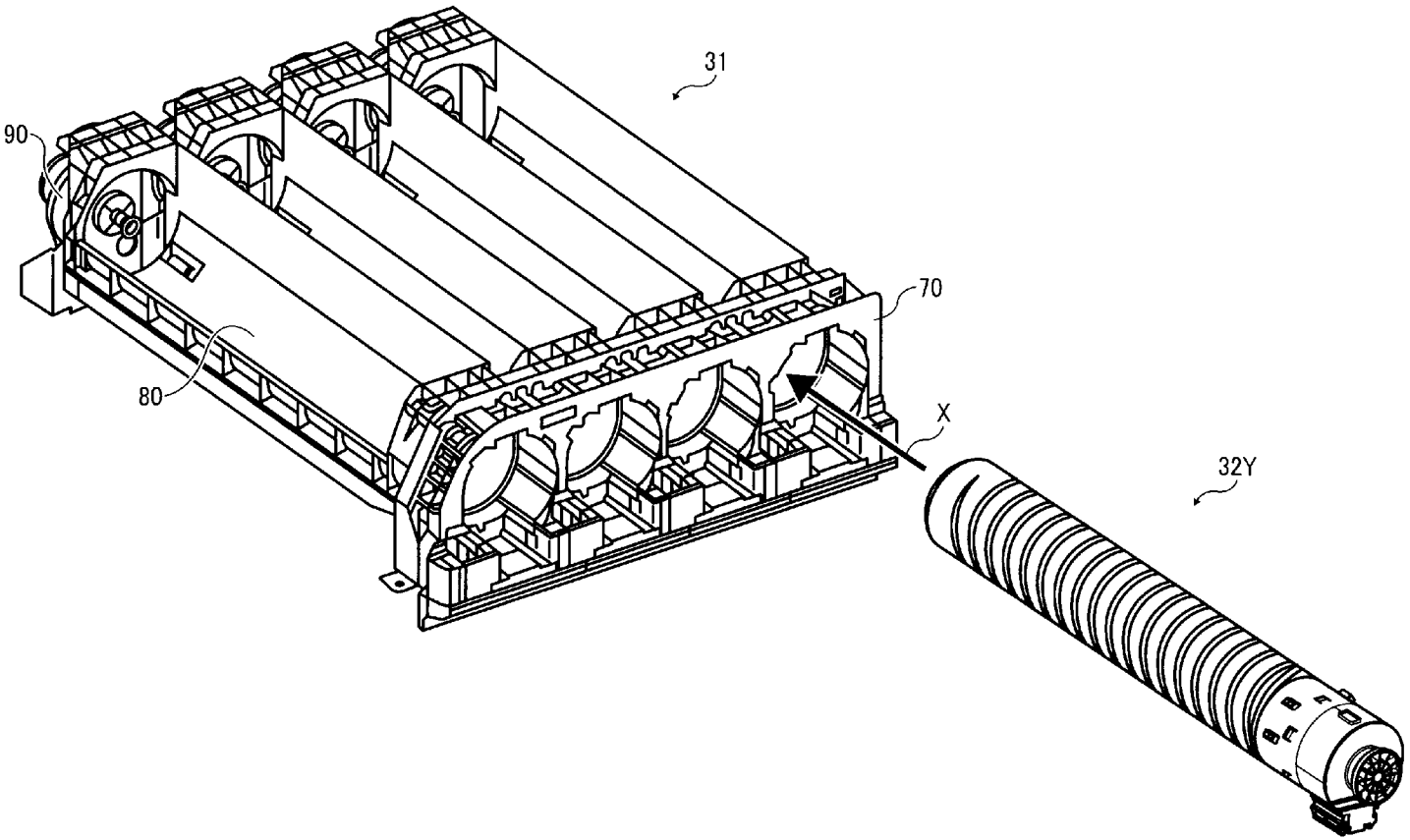
FIG. 4 is a perspective view of a toner container mount.

FIG. 3 is a schematic diagram that illustrates supply of toner by the toner supply device 60 from the toner container 32 to the development device 5, and FIG. 4 is a perspective view of the toner container mount 31.

Referring to FIG. 4, the toner container mount 31 serving as a powder container frame includes a bottle fixing portion 70 (powder container engagement portion), bottle guides 80 (powder container guides), a bottle driving unit 90 (powder container driving unit). The toner container 32Y is installed in and removed from the toner container mount 31 through the bottle fixing portion 70. The toner container 32Y is installed in the toner container mount 31 horizontally, which is a direction indicated by arrow X shown in FIG. 4. It is to be noted that the term "horizontally" used in this specification is not limited to an exact horizontal direction but includes substantially horizontal directions.

Referring to FIG. 3, the toner container 32 is described below.

The toner container 32Y according to the present embodiments is a substantially cylindrical toner bottle and includes a cap 32Y1 and a bottle 32Y2. The bottle 32Y2, serving as a bottle-body, contains the toner. The cap 32Y1, serving as a holder, is engaged with a front portion of the bottle 32Y2 and holds the bottle 32Y2 rotatably. A spiral protrusion 32Y2*a* protrudes inward from an inner circumferential face of the bottle 32Y2. In other words, a spiral groove is formed in an outer circumferential surface of the bottle 32Y2 of the toner container 32Y. In a lower portion of the cap 32Y1, a toner outlet 32Y1*a* and toner discharge portion 32Y1*d* are provided. The cap 32Y1 further includes a plug 32Y3 to close the toner outlet 32Y1*a*.

Figure 5:
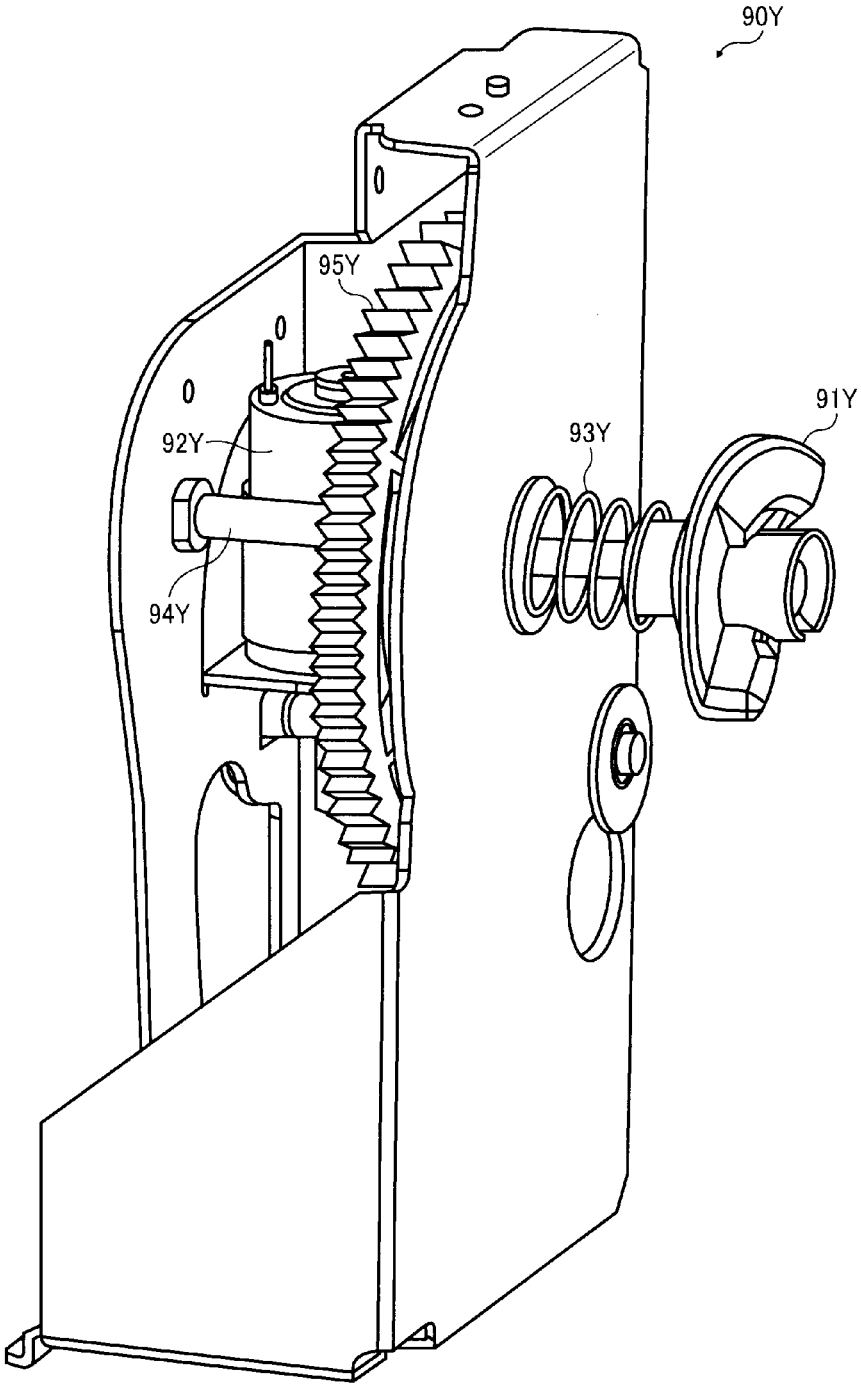
FIG. 5 is a perspective view of a bottle driving unit.

The spiral protrusion 32Y2*a* is formed on the inner circumferential surface of the bottle 32Y2 of the toner container 32Y for discharging the toner in the bottle 32Y2 to a space (toner reservoir 32Y1*k* shown in FIG. 26) inside the cap 32Y1 when the bottle 32Y2 is rotated in a direction indicated by arrow Y4 shown in FIG. 3 by the bottle driving unit 90 (shown in FIG. 5) provided in the main body 100 of the image forming apparatus 200. As shown in FIG. 5, the driving unit 90 includes a motor 92, driving coupling 91, a spring 93, a shaft 94, and a gear 95. It is to be noted that, reference character 32Y2*b* shown in FIG. 3 represents a pair of driving input parts (coupling engaged portion). That is, the bottle 32Y2 of the toner container 32Y is rotated by the bottle driving unit 90 as required, thus supplying the toner from the toner container 32Y through the toner outlet 32Y1*a* formed in the bottom of the space 32Y1*k* in the cap 32Y1 to the development device 5.

It is to be noted that, when the respective service life of the toner containers 32Y, 32M, 32C, and 32K have expired, that is, when almost all toner in the toner container 32 have been consumed, the old one is replaced with a new one. The structure of the toner container 32 is described in further detail later.

Next, referring to FIG. 3, the toner supply device 60Y to supply the toner contained in the toner container 32Y to the development device 5Y is described in further detail below.

The respective color toners contained in the toner containers 32Y, 32M, 32C, and 32K in the toner container mount 31 are supplied to the corresponding developing devices 5Y, 5M, 5C, and 5K by the toner supply devices 60Y, 60M, 60C, and 60K according to the amount of the corresponding toner consumed. The four toner supply devices 60 have a similar-configuration except the color of the toner used therein. The toner supply device 60 includes a screw pump 61, a conveyance pipe 68, and a tube 69 connected to the screw pump 61. The screw pump 61 includes a stator 62, a suction inlet 63, a universal joint 64, a rotor 65, and a motor 66.

The plug 32Y3 is contained in a nozzle connection compartment or insertion hole 32Y1*b* (shown in FIG. 6) of the toner container 32Y, and thus the nozzle connection compartment 32Y1*b* serves as a tube connection compartment. A nozzle 72, serving as a tube, of the toner container mount 31 is inserted into the nozzle connection compartment 32Y1*b* in conjunction with the installation of the toner container 32Y. At that time, the plug 32Y3 to close the toner container 32Y is clamped between the nozzle 72 and a pawl 75 and opens the toner outlet 32Y1*a* (powder outlet). Then, the toner outlet 32Y1*a* communicates with a toner inlet 72*a* (shown in FIGS. 6 and 7), serving as a powder inlet, formed in one end (first end) portion of the nozzle 72, and accordingly the toner contained in the bottle 32Y2 is conveyed through the toner outlet 32Y1*a* into the nozzle 72.

The other end portion (second end portion) of the nozzle 72 is connected to a first end of the tube 69 forming a toner supply route. The tube 69 is formed of a flexible material resistant to toner, and a second end of the tube 69 is connected to the screw pump 61. For example, the screw pump 61 is a uniaxial eccentric screw pump.

The tube 69 has an inner diameter of within a range of from 4 mm to 10 mm. Examples of the material of the tube 69 include rubbers of polyurethane, nitrile, ethylene-propylene-diene monomer (EPDM), silicone, and the like; and resins of polyethylene, nylon, and the like. Using the flexible tube 69 can enhance flexibility in layout of the toner supply route. Thus, the image forming apparatus 200 can be more compact.

In the present embodiments, the screw pump 61 is a suction-type uniaxial eccentric screw pump. The rotor 65, the stator 62, the universal joint 64, and the like are housed in a casing. The stator 62 is shaped like a female screw or internal thread formed of an elastic material such a rubber, and a double-pitch spiral groove is formed inside the stator 62. The rotor 65 is formed of a rigid material such as metal and shaped like a male screw, that is, twisted into a spiral. The rotor 65 is inserted in the stator 62 rotatably. One end of the rotor 65 is connected to the motor 66 via the universal joint 64.

The screw pump 61 as described above generates a suction force at the suction inlet 63 by rotating the rotor 65 inside the stator 62 in a predetermined direction with the motor 66. In other words, the screw pump 61 generates a negative pressure inside the tube 69 by evacuating air from the tube 69. Thus, the toner inside the toner container 32Y is sucked into the suction inlet 63 via the tube 69 together with the air inside the toner container 32Y. Then, the toner is attracted into the gap between the stator 62 and the rotor 65 from the suction inlet 63 and conveyed to the side opposite the suction inlet 63. The toner is further conveyed through a toner supply outlet 67Y, the conveyance pipe 68, and the toner inlet 59Y (see FIG. 2) to the development device 5Y as indicated by broken arrow A5 shown in FIG. 3.

It is to be noted that, a hopper may be installed between the screw pump 61 and the development device 5Y for temporarily storing the toner supplied to the development device 5Y.

Next, the toner container mount 31 of the image forming apparatus 200 in which the toner containers 32 are installed is described in further detail below with reference to FIGS. 5 through 18.

FIG. 5 is a perspective view of the bottle driving unit 90 provided on the downstream side (distal side) in the direction in which the toner container 32 is installed (hereinafter "installation direction of the toner container 32"). The toner container mount contains four bottle driving unit 90Y, 90M, 90C, and 90K. The bottle driving unit 90 includes the driving coupling 91, the motor 92, the spring 93, and the shaft 94 as shown in FIG. 5. The driving coupling 91 is positioned to engage the driving input parts (coupling engaged portions) 32Y2*b* formed on the bottom of the bottle 32Y2 (in FIG. 3, on the right) opposite the cap 32Y1 (see also FIG. 20). The driving coupling 91 and the motor 92 are connected with each other via the shaft 94 and the gear 95 provided at the shaft 94. The driving force of the motor 92 is transmitted to the driving coupling 91 via the shaft 94 and the gear 95 and rotates the bottle 32Y2 of the toner container 32Y that engages the driving coupling 91 in the predetermined direction. The spring 93 is wound around the shaft 94 and biases the driving coupling 91 to the upstream side (proximal side) in the installation direction of the toner container 32Y.

Figure 6:
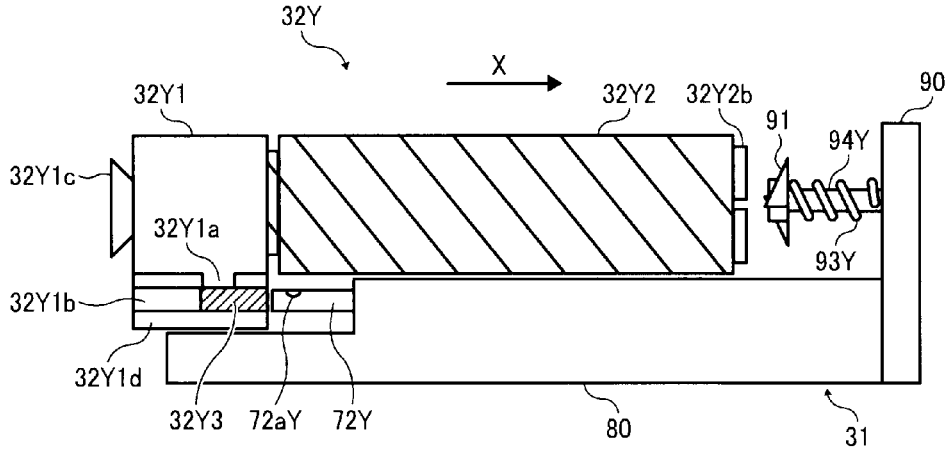
FIG. 6 is a schematic diagram that illustrates an engagement process of the toner container between the bottle driving unit.
Figure 7:
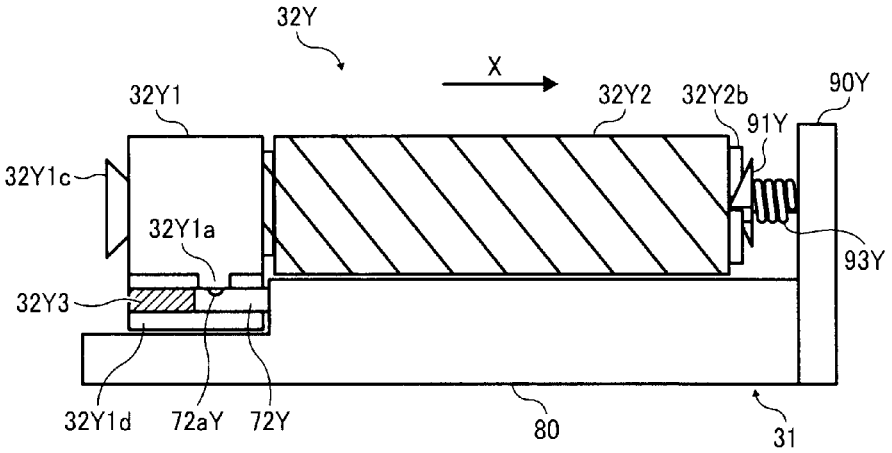
FIG. 7 is a schematic diagram that illustrates the toner container engaged with the bottle driving unit.

FIG. 6 is schematic diagram illustrating an engagement process in a state in which the toner container 32Y is being installed in the toner container mount 31. FIG. 7 is schematic diagram illustrating an engagement process in a state in which the toner container 32Y is fully set in the toner container mount 31. Referring to FIGS. 6 and 7, the driving coupling 91 is movable reciprocally in parallel to the installation direction of the toner container 32Y is biased to the upstream side in the installation direction of the toner container 32Y (to the left in FIG. 6) by the spring 93. When the toner container 32Y moves in the direction indicated by arrow X shown in FIG. 6 and is set in the toner container mount 31, the driving coupling 91 engaging the driving input part 32Y2 moves to the downstream side in the installation direction of the toner container 32Y (to the right in FIG. 6), pushed by the toner container 32Y (see also FIG. 7). At that time, the driving coupling 91 presses the toner container 32Y to the upstream side in the installation direction of the toner container 32Y (to the left in FIG. 7), urged by the spring 93. Additionally, as shown in FIGS. 6 and 7, the toner container 32Y further includes a handle 32Y1*c* provided on a head side (proximal side) of the cap 32Y1, which is on the left in FIGS. 6 and 7, opposite the distal side of the bottle 32Y2 on which the driving input parts 32Y2*b* are provided.

In removing the toner container 32Y from the toner container mount 31, when the toner container 32Y is released from the toner container mount 31, the spring 93 pushes the toner container 32Y in the direction in which the toner container 32 32Y is removed (hereinafter "removal direction"), which is to the left in FIG. 7. In other words, the toner container 32Y pops out from an insertion opening (insertion portion) 71, shown in FIG. 8, formed in the bottle fixing portion 70 of the toner container mount 31 (pop-up action). Then, users can grip the handle 32Y1*c* and remove the toner container 32Y from the main body 100 of the image forming apparatus 200 easily. It is to be noted that the insertion opening 71Y is defined by an interior of a cap holder 71Y-1 (shown in FIG. 9) in which the cap of the toner container 32Y is contained.

Next, the bottle fixing portion 70 is described in further detail below with reference to FIG. 8.

The bottle fixing portion 70 holds the caps 32Y1, 32M1, 32C1, and 32K1 of the toner containers 32Y, 32M, 32C, and 32K not to rotate. That is, the bottle fixing portion 70 includes four cap holders in which the respective caps of the toner containers 32 are housed. The bottle fixing portion 70 is constituted by an upper front case 701 and a lower front case 702 of the bottle fixing portion 70. That is, the insertion opening 71Y is defined by an interior of the cap holder 71Y-1 (shown in FIG. 9) in which the cap of the toner container 32Y is contained.

In addition, the bottle fixing portion 70 includes the four nozzles 72, four antenna boards 74 serving as communication circuits, the four pawls 75 to bias the plugs 32Y3 in the direction to close the toner outlets 32Y1*a* of the toner containers 32, four fixing and release levers 76 (hereinafter also simply "lever 76") to fix and release the toner container 32Y from the toner container mount 31, and four pairs of positioning protrusions 78. In addition, the four insertion openings 70 are formed in the bottle fixing portion 70 and rims of the insertion portions function as the respective cap holders 71-1. That is, the insertion opening 71Y is defined by an interior of the cap holder 71Y-1 (shown in FIG. 9) in which the cap of the toner container 32Y is contained.

Figure 9:
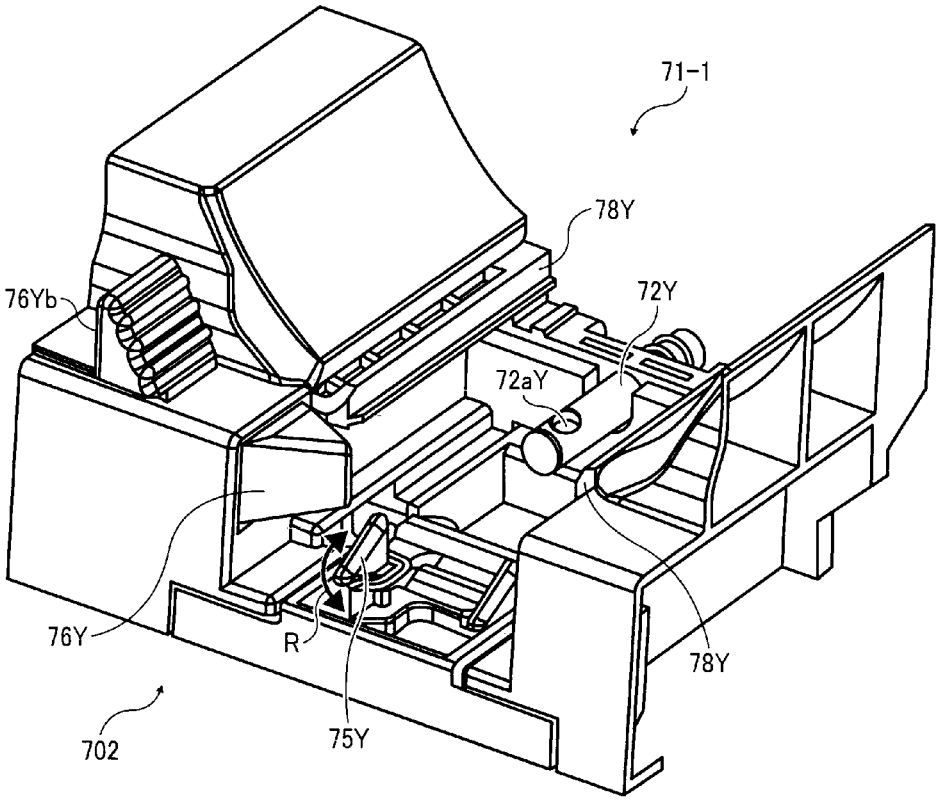
FIG. 9 is a perspective view that illustrates a vicinity of a lower front case of the bottle fixing portion.
Figure 10:
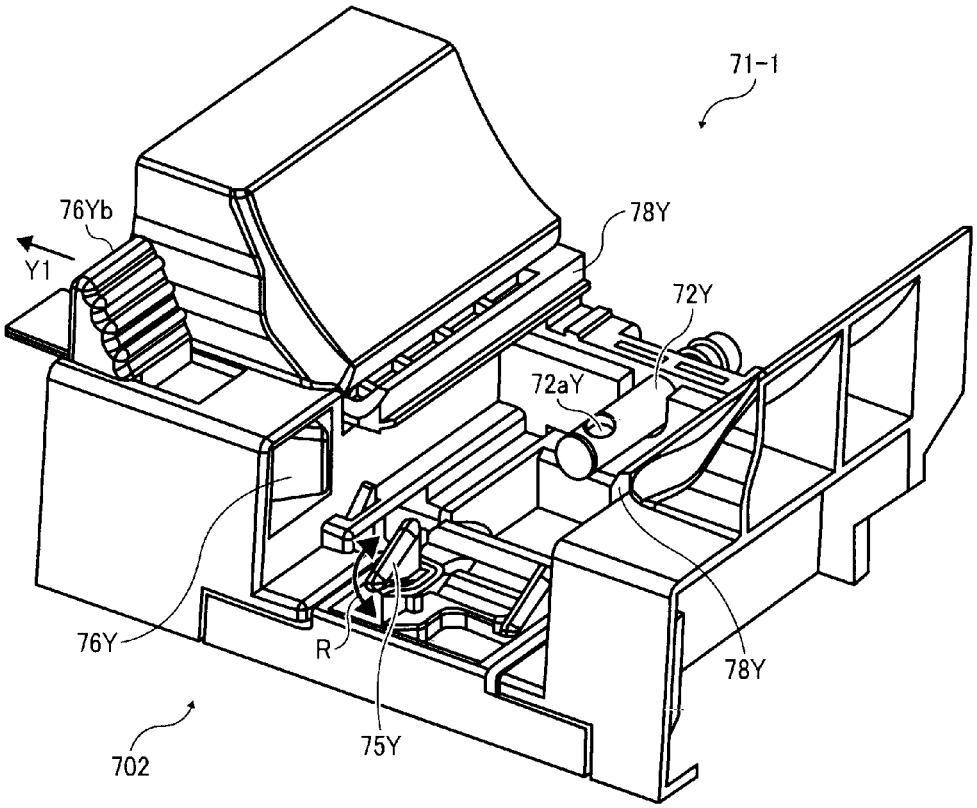
FIG. 10 is another perspective view that illustrates the vicinity of the lower front case.

FIG. 9 is an enlarged perspective view of the lower front case 702 in a state in which the fixing and release lever 76 (hereinafter just "lever") is locked at a retention position. FIG. 10 is an enlarged perspective view of the lower front case 702 in a state in which the lever 76 is locked at a release position.

Referring to FIG. 9, the lower front case 702 includes the positioning protrusions 78 to set the cap 32Y1 in position in conjunction with installation of the cap 32Y1. In the present embodiments, the positioning protrusions 78 protrude from the inner face of the bottle fixing portion 70 defining the cap holder 71Y1 in which the cap 32Y1 is held. The positioning protrusions 78 extend in the installation direction of the toner container 32Y and are provided on either side symmetrically about a long axis, that is, a line passing through a center axis of the nozzle 72.

In each cap holder 71Y-1 of the bottle fixing portion 70, the nozzle 72 extends horizontally, that is, in the installation direction of the toner container 32Y. The toner inlet 72*a* serving as the powder inlet is formed in a top portion of the first end portion of the nozzle 7. That is, the toner inlet 72*a* faces up so as to receive toner from above.

Figure 33:
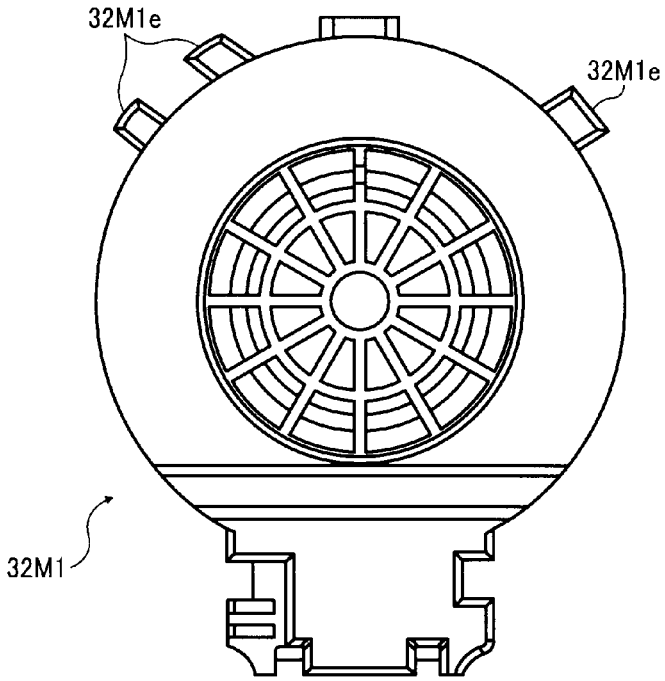
FIG. 33 is a front view of the cap of the magenta toner container.
Figure 34:
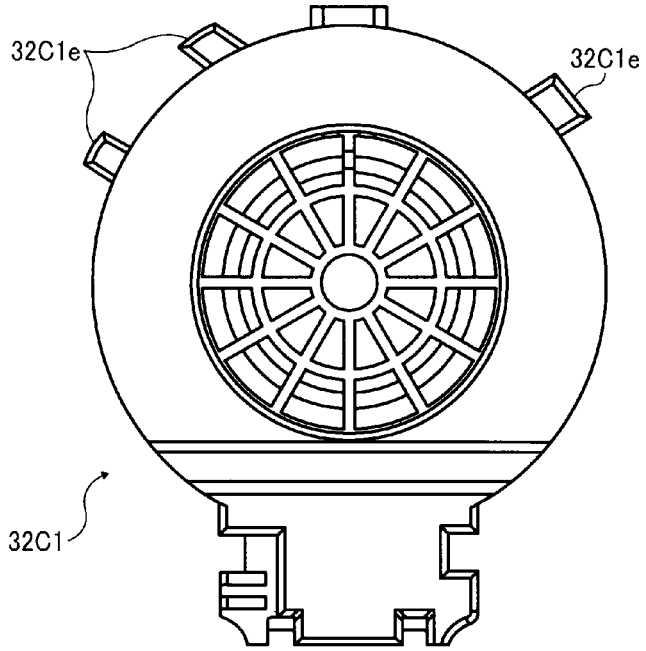
FIG. 34 is a front view of the cap of the cyan toner container.

The pawl 75 is positioned in a bottom portion of the bottle fixing portion 70, beneath the cap 32Y1 when the cap 32Y1 is fixed in the cap holder 71-1 of the bottle fixing portion 70. The pawl 75 serves as a biasing member that biases the plug 32Y3 in the direction in which the toner outlet 32Y1*a* is closed in conjunction with removal of the cap 32Y1. The pawl 75 is supported on the lower case 702 rotatably around a shaft 75*a* (shown in FIGS. 34 and 37) in both directions as indicated by arrow R shown in FIG. 9. A leaf spring 77 (shown in FIG. 33) provided beneath the pawl 75, biases the pawl 75 from a position where the pawl 75 does not hinder installation and removal of the cap 32Y1 to a position to contact the plug 32Y3. That is, the pawl 75 is biased upward.

With this configuration, referring to FIG. 9, the cap 32Y1 of the toner container 32Y is fixed in the lower front case 702 of the yellow cap holder 71Y-1 by locking the lever 76 at the retention position on the upper side of the pawl 75Y. Referring to FIG. 10, the cap 32Y1 of the toner container 32Y is released from retention state in the lower front case 702 of the Y cap holder 71Y-1 by locking the lever 76 at the release position located escaped from the upper side of the pawl 75Y. Additionally, the lever 76 to fix and release the toner container 32Y from the bottle fixing portion 70 is provided on the front of the insertion opening 71 and a lateral side of the insertion opening 71.

Figure 11:
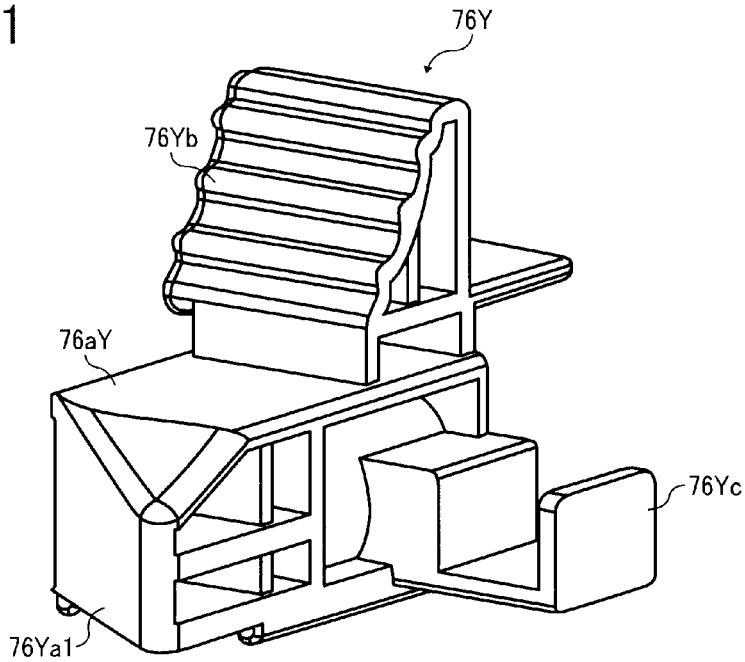
FIG. 11 is a perspective view of a lever for fixing and releasing the toner container.

FIG. 11 is a perspective view of the lever 76. Referring to FIG. 11, the lever 76 includes a pawl 76*a* to set the toner container 32Y in position and retain it, a lever portion 76*b* and a rib 76*c*. Referring to in FIGS. 9 and 10, the lever 76 can move reciprocally in a horizontal direction (lateral direction in FIGS. 9 and 10) substantially perpendicular to the installation direction of the toner container 32Y, which is the direction indicated by arrow Y1 and the opposite direction (direction indicated by arrow Y2 shown in FIG. 13). The lever 76 is biased by a spring 76*d* (shown in FIG. 12) to the insertion opening 71, that is, to the right in FIGS. 9 and 10. As shown in FIG. 10, the user can slide the lever 76 to the position (release position) not to protrude into the insertion opening 71 in the direction indicated by arrow Y, opposite the direction in which the spring 76*d* biases the lever 76, by pushing the lever portion 76*b* with his/her finger. It is to be noted that, in FIG. 11, reference character 76*a*1 represents a sloped surface 76*a* of the pawl 76*a*.

Figure 12:
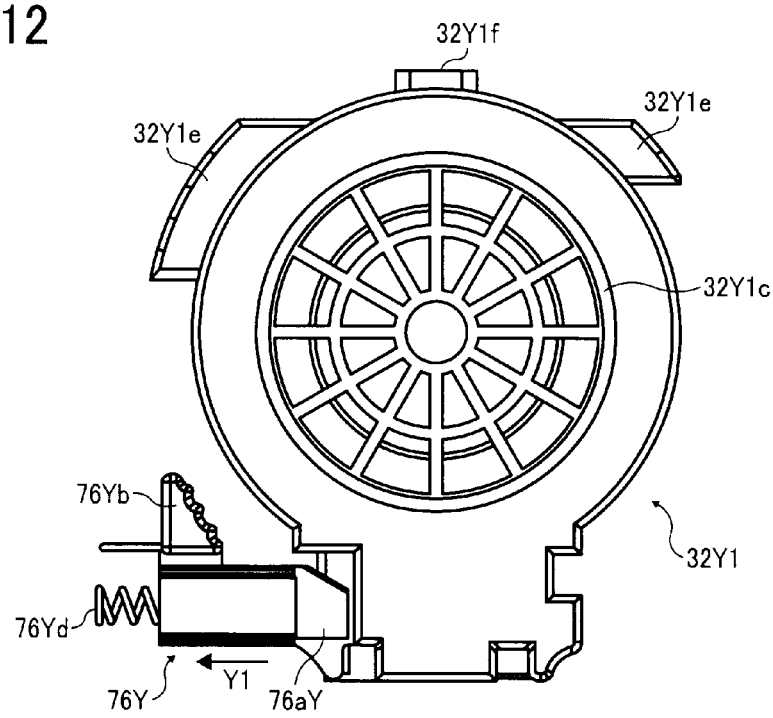
FIG. 12 is a front view that illustrates the lever when the toner container is installed in the toner container mount.
Figure 13:
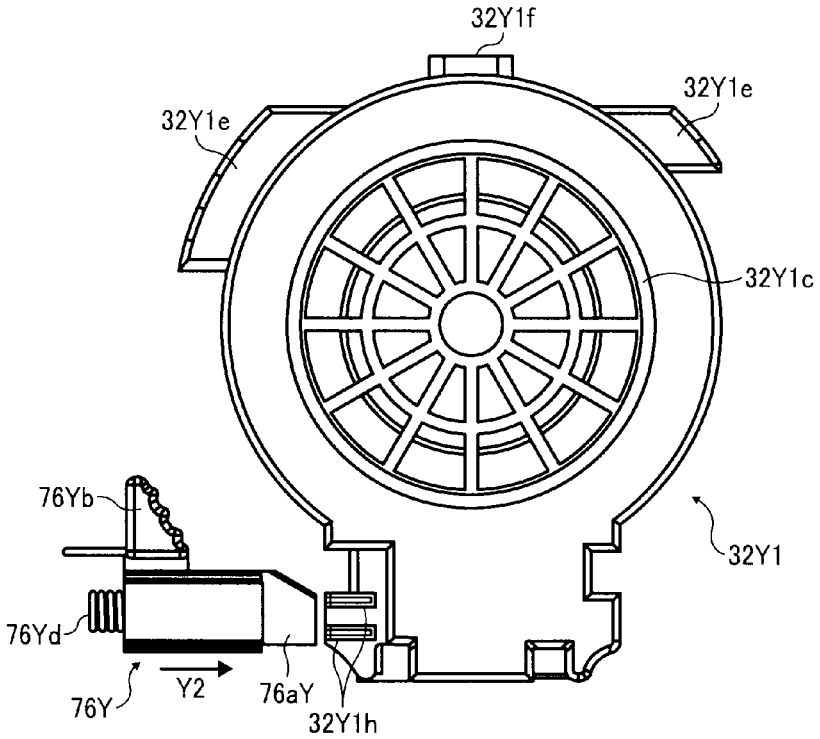
FIG. 13 is a front view that illustrates the lever when the toner container is being inserted into the toner container mount.

FIGS. 12 and 13 are end-on axial views that illustrate relative positions of the cap 32Y1 of the toner container 32Y contained in the toner container mount 31 and the lever 76 from the proximal (upstream) side in the installation direction of the toner container 32Y. Reference characters 32Y1*e*, 32Y1*f*, and 32Y1*h* respectively represent color discrimination protrusions, an identification chip (ID chip) that is an electronic board (electronic data storage unit), and a pressed portion against which the pawl 76*a* is pressed. In FIG. 12, the cap 32Y1 is fixed in position and retained in the bottle fixing portion 70 by the lever 76, and, in FIG. 13, the lever 76 is moved in the direction indicated by arrow Y (to the left in FIG. 13), and thus the toner container 32 is unlocked.

As described above with reference to FIGS. 6 and 7, the toner container 32Y installed in the toner container mount 31 is biased by the driving coupling 91 to the upstream side in the installation direction of the toner container 32Y (to the front side of paper on which FIG. 12 is drawn). The lever 76 urged by the spring 76*d*, however, hinders removal of the toner container 32Y when the lever 76 is at the retention position shown in FIG. 12, that is, when the lever 76 protrudes into the insertion opening 71Y (see also FIG. 18), biased by the spring 76*d*. Thus, the lever 76 can retain the toner container 32Y in the toner container mount 31.

Next, operation of the fixing and release lever 76 is described in further detail below.

Figure 14:
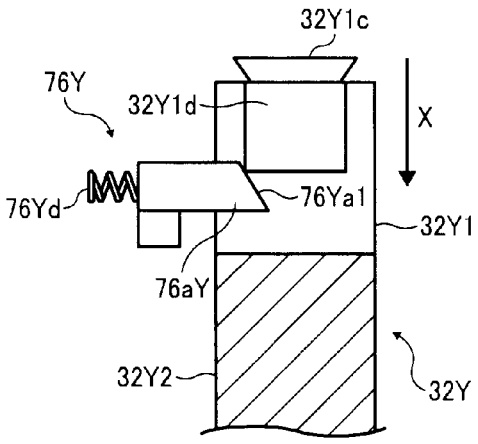
FIG. 14 is a schematic view that illustrates installation of the toner container into the toner container mount as viewed from the bottom of the toner container.

FIGS. 14 through 17 are schematic views that illustrate installation of the toner container 32Y into the toner container mount 31 as viewed from the bottom side of the toner container 32Y on which the toner discharge portion 32Y1*d* is provided. Arrow X indicates the installation direction of the toner container 32Y in the toner container mount 31 (hereinafter "the installation direction X"). Referring to FIG. 14, when the toner container 32Y is inserted into the toner container mount 31 in the installation direction X, a backside edge of the toner discharge portion 32Y1*d* of the toner container 32Y contacts the sloped surface 76*a*1 of the pawl 76*a* protruding into the insertion opening 71Y.

Figure 15:
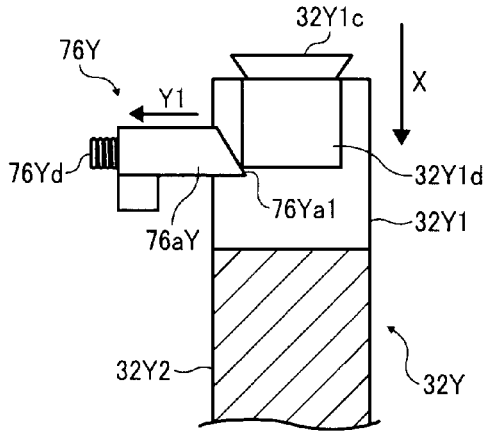
FIG. 15 is schematic view that illustrates a state subsequent to that shown in FIG. 14 in installation of the toner container as viewed from the bottom of the toner container.
Figure 16:
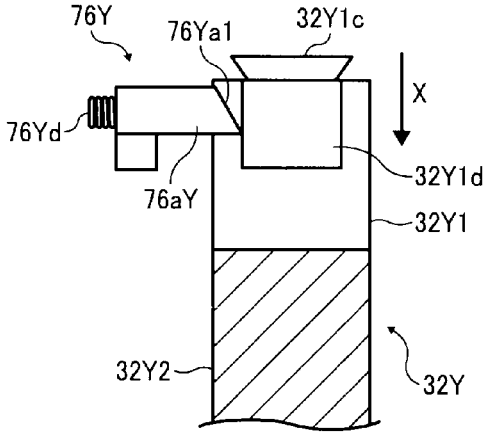
FIG. 16 is schematic view that illustrates a state subsequent to that shown in FIG. 15 in installation of the toner container as viewed from the bottom of the toner container.
Figure 17:
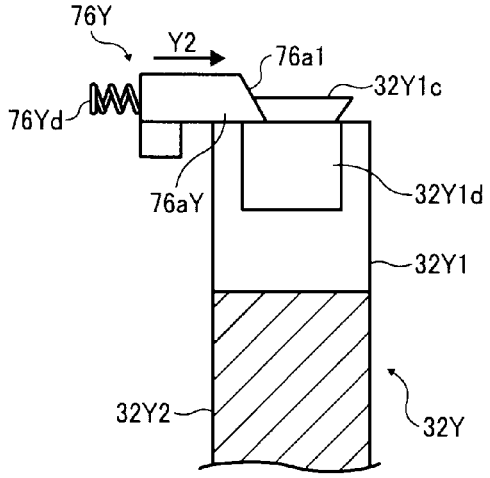
FIG. 17 is a schematic view that illustrates the toner container secured in the toner container mount as viewed from the bottom of the toner container.

Referring to FIG. 15, when the toner container 32Y is inserted further, the backside edge of the toner discharge portion 32Y1*d* in contact with the sloped surface 76*a*1 slides along the sloped surface 76*a*1 and pushes the lever 76 in the direction indicated by arrow Y (hereinafter "direction Y"), opposite the direction in which the spring 76*d* biases the lever 76. When the pawl 76*a* of the lever 76 is pushed to the release position not to protrude into the insertion opening 71Y, the lever 76 does not hinder installation of the toner container 32Y. Then, as shown in FIG. 16, the toner container 32Y moves further in the installation direction X with a side surface of the toner discharge portion 32Y1*d* in sliding contact with a tip portion of the pawl 76*a*.

When the toner container 32Y is fully inserted into the toner container mount 31, the toner discharge portion 32Y1*d* of the toner container 32Y is positioned downstream (on distal side) from the lever 76 in the installation direction X. That is, the lever 76 is positioned beneath the lever 76 in FIG. 17. In this state, the lever 76 that has been in contact with the toner discharge portion 32Y1*d* and thus been pressed by it is no longer moved by the toner discharge portion 32Y1*d*. Accordingly, the lever 76 moves back in the direction indicated by arrow Y2 shown in FIG. 17 to the retention position where the lever 76 protrudes into the insertion opening 71 as shown in FIG. 12. The toner container 32Y is clamped between the driving coupling 91 of the bottle driving unit 90 and the lever 76, thereby fixed in position and retained at that position in the installation direction.

Next, removal of the toner container 32 from the toner container mount 31 of the image forming apparatus 200 is described below.

When the toner container 32Y in the retention position shown in FIG. 12 is released, initially, the user moves the lever portion 76*b* with his/her finger in the direction indicated by arrow X shown in FIG. 12, in which the spring 76*d* biases the lever 76, thereby sliding the lever 76 with the toner container 32Y installed in the toner container mount 31. Then, the pawl 76*a* moves to the release position not to protrude into the insertion opening 71, thus, the toner container 32Y is released. Because the toner container 32Y is pressed by the driving coupling 91 of the bottle driving unit 90 (see FIG. 6), the toner container 32Y pops out from the insertion opening 71 in the direction opposite the installation direction X shown in FIG. 8.

Therefore, the top edge of the pawl 76*a* of the lever 76 comes into contact with a lateral surface of the toner discharge portion 32Y1*d* of the toner container 32Y, which prevents the lever 76 from moving to the retention position. That is, the lever 76 is kept at the release position. Subsequently, when the user grips the handle 32Y1*c* and pulls the toner container 32Y in the direction (hereinafter "removal direction") opposite the installation direction X out from the toner container mount 31, the contact between the pawl 76*a* and the toner discharge portion 32Y1*d* is released. Accordingly, the lever 76 returns to the retention position shown in FIG. 14, biased by the spring 76*d*. It is to be noted that, at this time, because the toner container 32Y for yellow is not installed in the container mount 31, although the lever 76 is located at the retention position, the toner container is not retained in the toner installation portion 31.

In the present embodiments, the bottle fixing portion 70 further includes a lever position detector 79 shown in FIGS. 18 through 21 for detecting the position of the lever 76. For example, the lever position detector 79 is a photosensor. More specifically, referring to FIGS. 18 through 21, the lever position detector 79 that in the present embodiments is a transmissive photosensor is positioned adjacent to the lever 76.

Figure 18:
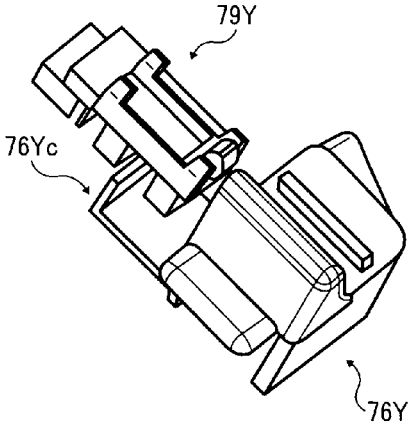
FIG. 18 is a perspective view illustrating the lever shown in FIG. 11 at a retention position.
Figure 19:
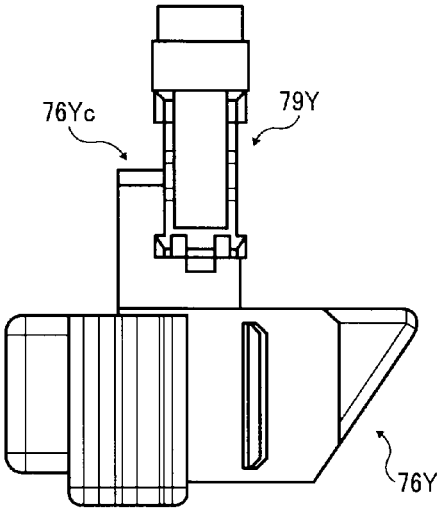
FIG. 19 is a top view illustrating the lever at the retention position.

FIG. 18 is a perspective view that illustrates relative positions of the lever 76 and the lever position detector 79 when the lever 76 is at the retention position. FIG. 19 is a schematic top view that illustrates the relative positions of the lever 76 and the lever position detector 79 when the lever 76 is at the retention position.

The lever position detector 79Y is held by the bottle fixing portion 70. The lever position sensor 79Y can receive a light emitted from a light-emitting element provided inside the lever position detector 79Y by a light-receiving element provided in side the lever position detector 79Y positioned facing the light-emitting element within a predetermined gap. When the lever 76Y is located at the retention position, a rib 76Yc of the lever 76Y is positioned between the light-emitting element and the light-receiving element in the lever position detector 79Y. Thus, the light emitted from the light-emitting element is blocked by the rib 76Yc and does not reach the light-receiving element. Accordingly, the lever position sensor 79Y detects that the lever 76Y is retained at the retention position and outputs a detection signal (outputs on state)

Figure 20:
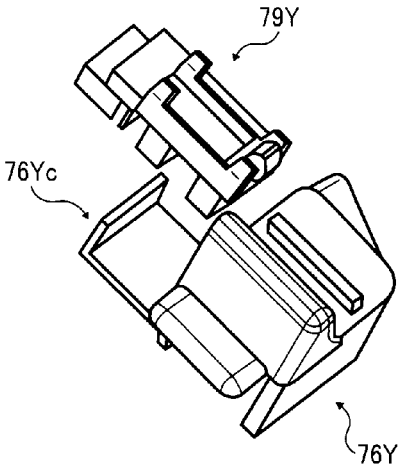
FIG. 20 is a perspective view illustrating the lever at a release position.
Figure 21:
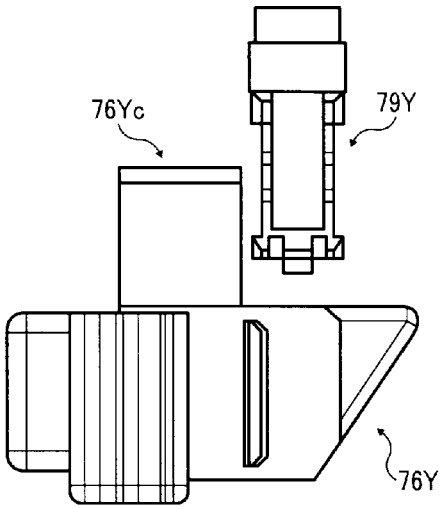
FIG. 21 is a top view illustrating the lever at a release position.

FIG. 20 is a perspective view that illustrates relative positions of the lever 76 and the position detector 79 when the lever 76 is at the release position. FIG. 21 is a schematic top view that illustrates the relative positions of the lever 76 and the position detector 79 when the lever 76 is at the release position.

When the lever 76 is moved to the release position, the rib 76*c* moves away from the position between the light-emitting element and the light-receiving element in the lever position detector 79. Thus, the light-receiving element can receive the light from the light-emitting element, and stop outputting the detection signal (the output of the photosensor is off in this state.)

Although the transmission-type photosensor is used as the lever position detector 79 in the present embodiments, alternatively, a reflection-type photosensor may be used to detect the lever 76. Moreover, although in the description above, the shielding of the rib 76*c* provided on the lever 76 is used in detecting the lever 76 and switching the output of the lever position detector 79, the output of the lever 76 may be switched differently. For example, the output from the lever position detector 79 may be switched by detecting another component that moves in conjunction with the movement of the lever 76.

Next, the insertion opening 71 is described in further detail below.

Referring back to FIG. 1, when a cover (not shown) provided on the front side of the main body 100 is opened, the toner container mount 31 is exposed (see FIG. 1). More specifically, as shown in FIG. 22, the bottle fixing portion 70 in which the four insertion openings 71 are formed is exposed when the cover of the main body 100 is opened.

In a state in which no part of the toner container is installed in the main body 100, the four insertion openings 71Y, 71M, 71C, and 71K provided in the bottle fixing portion 70 are opened. The user installs and removes the tone containers 32Y, 32M, 32C, and 32K in and from the main body 100 via the insertion openings 71.

Figure 22:
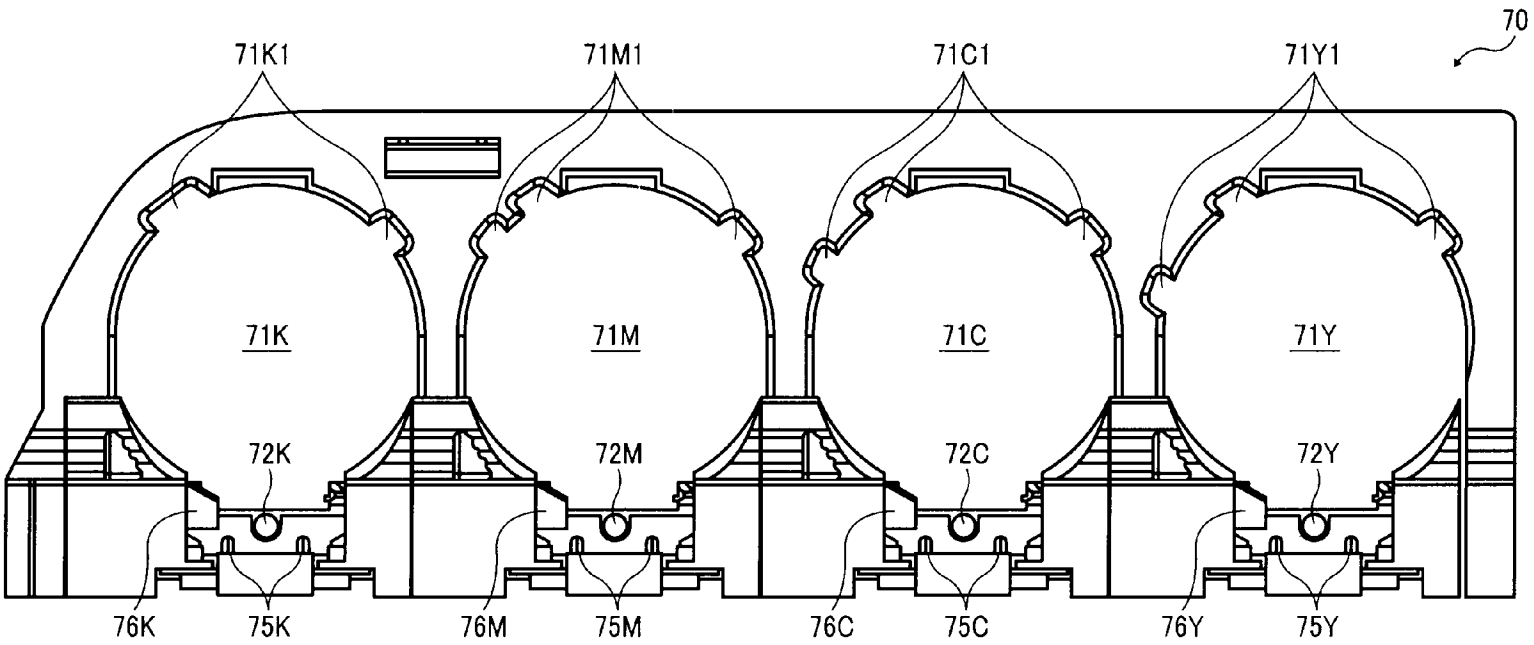
FIG. 22 is a front view of insertion openings in which the respective toner containers are inserted.

Referring to FIG. 22, the shapes of four insertion openings 71Y, 71M, 71C, and 71K are different for each of the four colors and the shapes of four caps 32Y1, 32M1, 32C1, 32K1 are different as well, so that the insertion opening 71 of a specific color can accommodate only the toner container 32 of a corresponding color, thus preventing a toner container of the wrong color from being set in the insertion opening 71 or the toner supply device 60.

Figure 23:
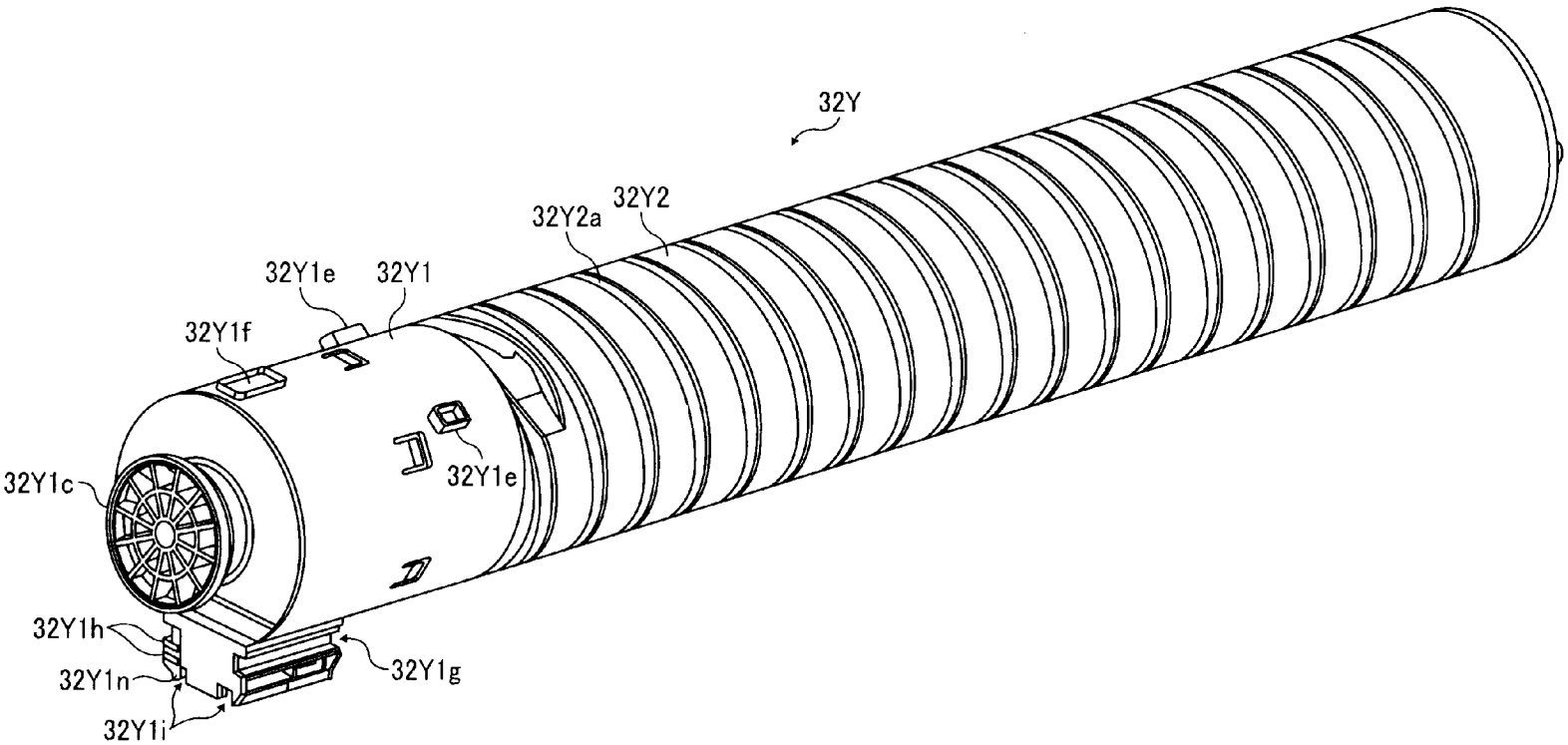
FIG. 23 is a perspective view of the toner container.
Figure 24:
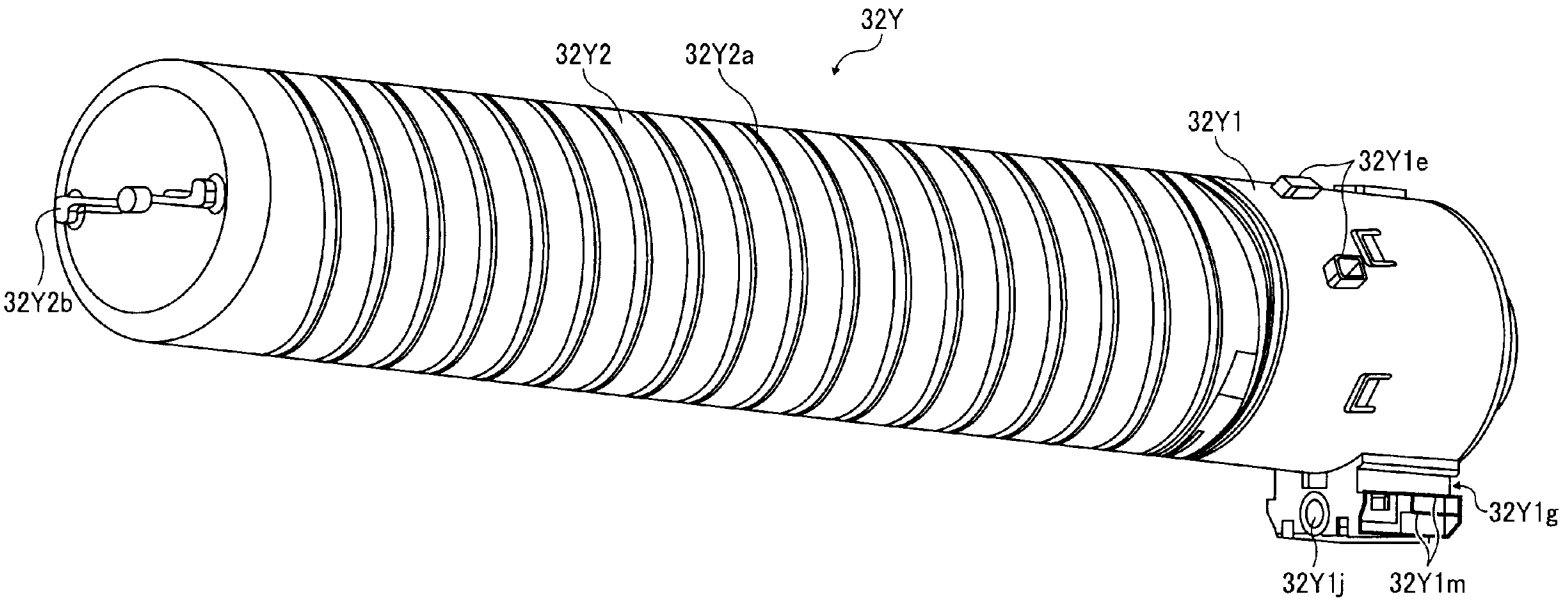
FIG. 24 is a perspective view of the toner container as viewed from another angle.

FIG. 23 is an expanded perspective view of the toner container 32Y as viewed from a front side. FIG. 24 is an expanded perspective view of the toner container 32Y as viewed from a posterior side. The toner container 32Y includes the cylindrical bottle 32Y2 that contains the toner, and the cap 32Y1 that rotatably holds the front portion of the bottle 32Y2. Color discrimination protrusions 32Y1*e*, 32M1*e*, 32Ce, and 32Ke that project outward in normal direction are provided on respective outer circumferential surfaces of the caps 32Y1, 32M1, 32C1, and 32K1.

By contrast, referring to FIG. 22, the interiors of the can holders 71Y-1, 71M-1, 71C-1, and 71K-1 defining the insertion openings 71Y, 71M, 71C, and 71K include first guide grooves 71Y1, 71M1, 71C1, and 71K1 that engage the color discrimination protrusions 32Y1*e*, 32M1*e*, 32Ce, and 32Ke provided on the caps of the toner containers 32Y, 32M, 32C, and 32K, respectively.

At least one of the shapes, the arrangement, and the quantities of the first guide grooves 71Y1, 71M1, 71C1, and 71K1 are different among the four colors so that the guide grooves 71Y1, 71M1, 71C1, and 71K1 of specific color can engage the corresponding color of the color discrimination protrusions 32Y1*e*, 32M1*e*, 32Ce, and 32Ke, thus prevent a toner container of the wrong color from being set in the insertion opening 71 of the toner container mount 31. In the configuration shown in FIG. 22, three first guide grooves 71Y1, 71M1, 71C1, and 71K1 are formed for each color.

Figure 8:
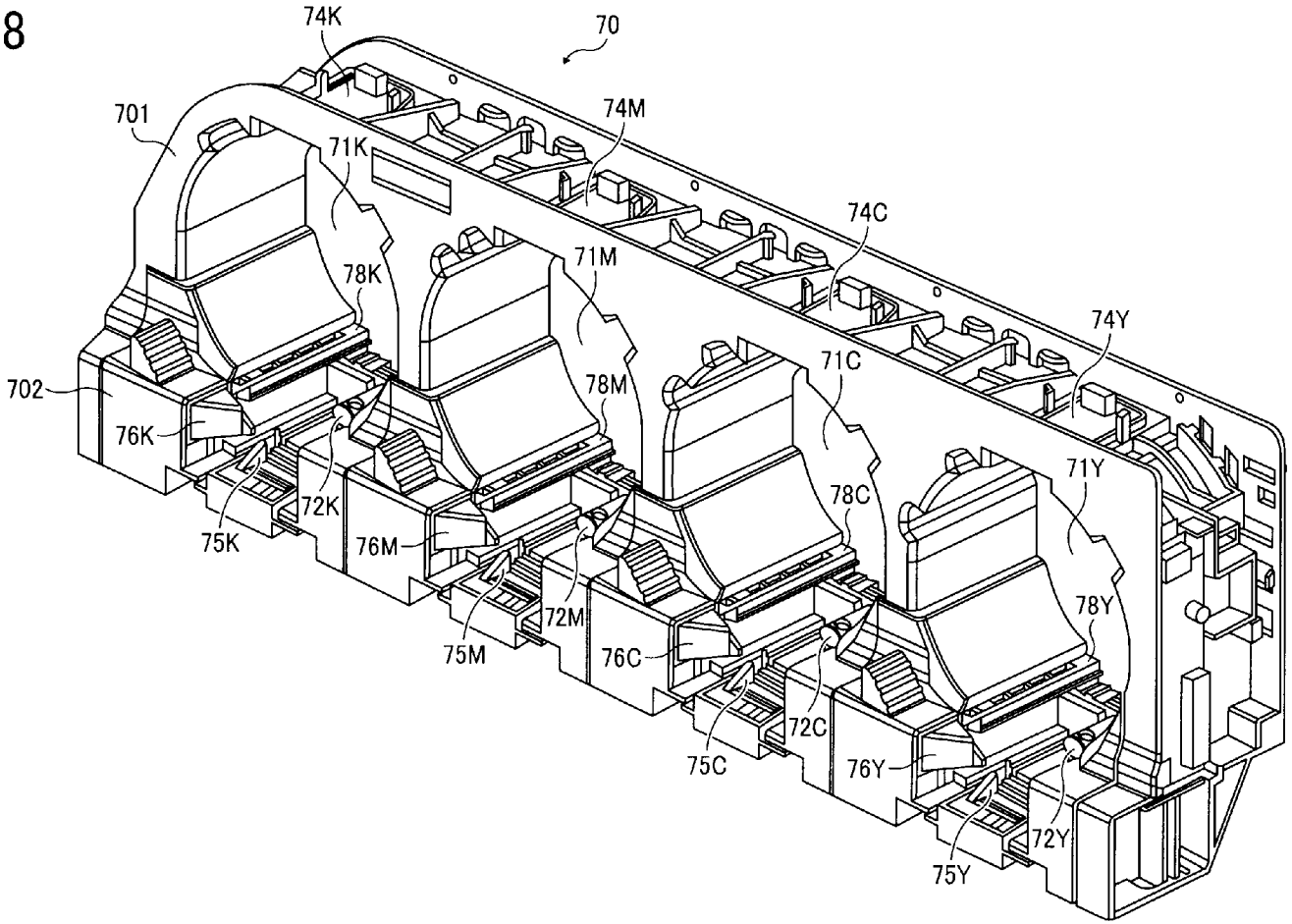
FIG. 8 is a perspective view of a bottle fixing portion.

Additionally, referring to FIG. 8, the antenna boards 74 are set in the upper front case 701 of the bottle fixing portion 70 in which the toner containers 32Y, 32M, 32C, and 32K are removably installed in parallel to each other. More specifically, the antenna boards 74 are arranged on an identical face in an upper portion of the upper front case 701 so as to face the electronic boards 32Y1*f*, 32M1*f*, 32C1*f*, and 32K1*f* provided on circumferential surfaces of the toner containers 32Y, 32M, 32C, and 32K inserted through the bottle fixing portion 70, a part of which is formed by the upper font case 701, and arranged in parallel to each other. The electronic boards 32Y1*f*, 32M1*f*, 32C1*f*, and 32K1*f* are shown in FIGS. 22 and 28 through 31.

The electronic boards 32Y1*f*, 32M1*f*, 32C1*f*, and 32K1*f* of the toner containers 32Y, 32M, 32C, and 32K, serving as an electronic storage, including IC chip to store and exchange data with the main body 100 in which the antenna boards 74 are provided. The data exchanged between the toner container 32Y, 32M, 32C, and 32K and the image forming apparatus 200 includes, for example, the production serial number of the toner container, the number of times the toner container is reused, the production lot number, the production date, the color of the toner, and usage history of the image forming apparatus 200. Other data may also be included. Further, data including the amount of toner remaining in the toner container 32 (hereinafter "the amount of remaining toner") is written in the electronic boards 32Y1*f*, 32M1*f*, 32C1*f*, and 32K1*f* as required in accordance with the amount of toner consumed.

The controller 101 stored in the main body 100 can communicate with the electronic boards 32Y1*f*, 32M1*f*, 32C1*f*, and 32K1*f* through the antenna board 74. The controller 101 accesses the IC chips in the electronic boards 32Y1*f*, 32M1*f*, 32C1*f*, and 32K1*f* to read and update the data. It is to be noted that, in the present embodiments, the antenna boards 74 are positioned above the respective toner containers 32 as shown in FIG. 8. In other words, a receiving face of each antenna board 74 faces down. This arrangement can eliminate the possibility of drop of toner on the receiving face of the antenna board 74, thus preventing decreases in the communication sensitivity caused by the toner present between the electronic boards 32Y1*f*, 32M1*f*, 32C1*f*, and 32K1*f* and the respective antenna boards 74 if toner drops on the antenna boards 74.

Next, the toner containers 32 are described in further detail below with reference to FIGS. 23 through 40.

FIGS. 23 and 24 are perspective views illustrating the toner container 32Y. In FIG. 23, reference character 32Y1*i* represents a pair of second grooves, 32Y1*g* represents a pair of first grooves, and 32Y1*n* represents a face of the cap 32Y1 perpendicular to the installation direction. In FIG. 24, reference character 32Y1*m* represents ribs (sliding contact portions) extending in the installation direction, and reference character 32Y1 represents a nozzle inlet.

Figure 25:
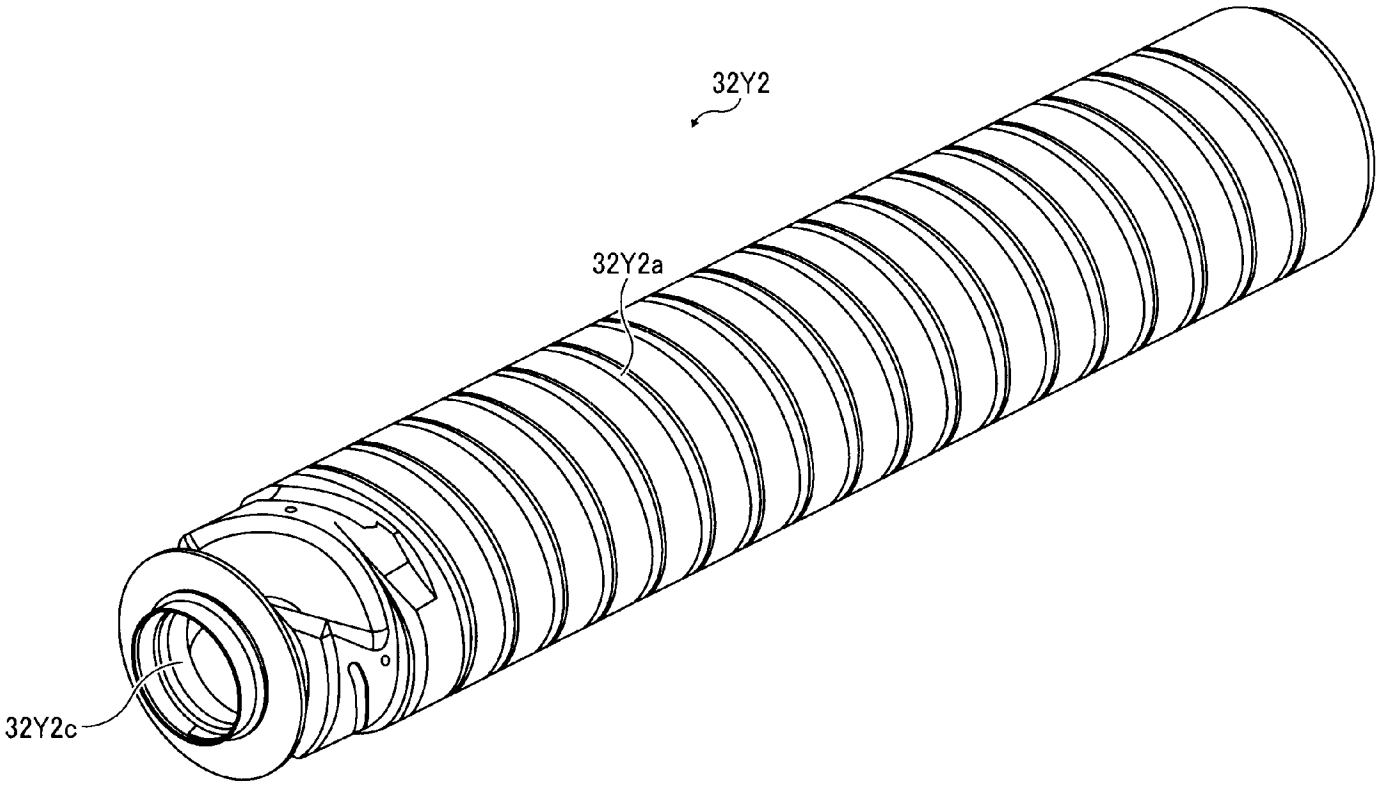
FIG. 25 is a perspective view that illustrates an exterior of a bottle of the toner container.

FIG. 25 is a perspective view of the bottle 32Y2. As shown in FIG. 25, the bottle 32Y2 includes an opening 32Y2*c* formed in a head portion, which is on the upstream side (proximal side) in the installation direction of the toner container 32Y into the image forming apparatus 200, and thus the interior of the bottle 32Y2 communicates with the interior of the cap 32Y1. The spiral-shaped protrusion 32Y2*a* is formed in the inner circumferential surface of the bottle 32Y2. Further, as shown in FIG. 24, the driving input parts 32Y2*b* are provided on the bottom of the bottle 32Y2, which is on the downstream side (distal side) in the installation direction of the toner container 32Y. The driving input parts 32Y2*b* engage the driving coupling 91 of the main body 100. With this configuration, the bottle 32Y2 rotates in the predetermined direction, receiving the driving force from the driving coupling 91 of the main body 100, thereby transporting the toner contained therein to the opening 32Y2*c*. The toner discharged from the opening 32Y2*c* of the bottle 32Y2 is then stored in the space (toner reservoir 32Y1*k* shown in FIG. 26) inside the cap 32Y1. The toner stored in that space is supplied to the development device 5Y through the toner outlet 32Y1*a* formed beneath that space in the cap 32Y1 as also shown in FIG. 27.

It is to be noted that, as shown in FIG. 24, the two driving input parts 32Y2*b* that engage the two pawls of the driving coupling 91, respectively, are arranged at angle positions different 180 degrees from each other with reference to the center of rotation of the bottle 32Y2 in the present embodiments. Alternatively, the driving coupling 91 may have three pawls and the number of the driving input parts 32Y2*b* provided in the toner container 32Y may be three accordingly. The three driving input parts 32Y2*b* can be arranged at identical angle intervals with reference to the center of rotation of the bottle 32Y2. Although such an arrangement can alleviate fluctuations in the torque when the toner container 32Y rotates, the probability of interference between the driving input parts 32Y2*b* and the pawls of the driving coupling 91 can increase as the number of the driving input parts 32Y2*b* (pawls) increases. Therefore, it is preferred to determine the number of the driving input parts 32Y2*b* (pawls) considering the adverse effects of the fluctuation in the torque on discharge performance of the toner from the toner container 32Y as well as the interference between the driving input parts 32Y2*b* and the pawls of the driving coupling 91 that inhibits reliable attachment of the toner container 32.

Next, the cap 32Y1 according to the present embodiments is described in further detail below with reference to FIGS. 26 through 35.

Figure 26:
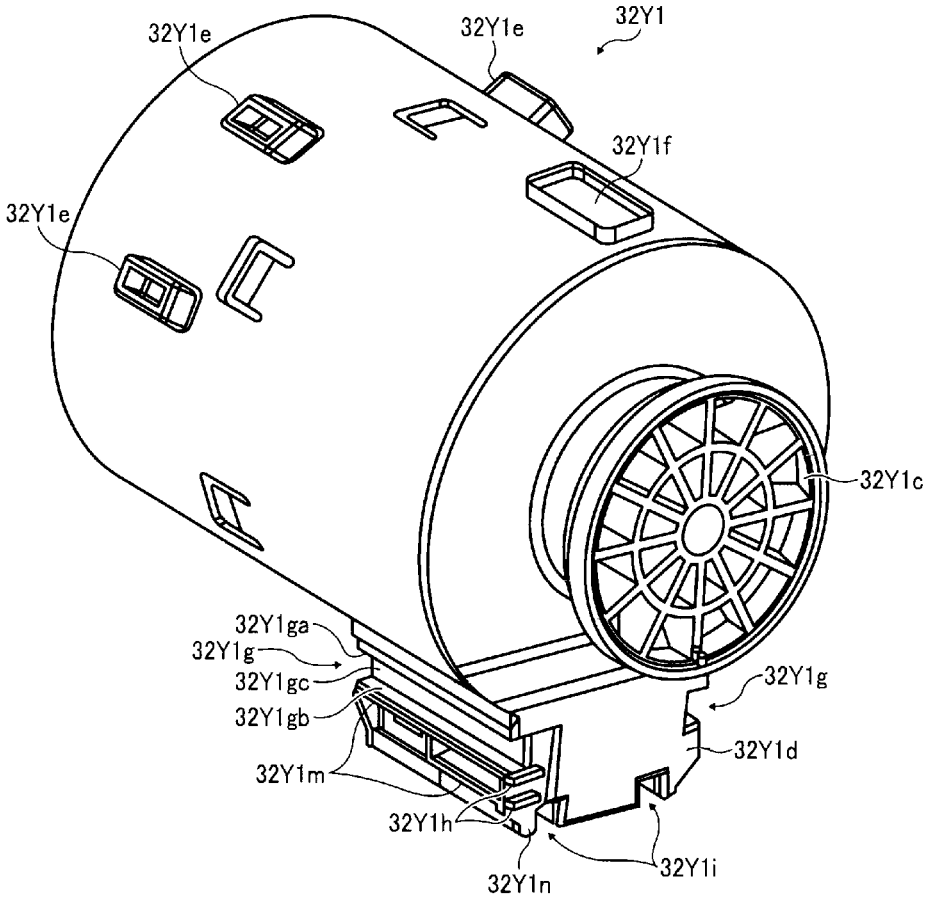
FIG. 26 is a perspective view that illustrates an exterior of a cap of the toner container.
Figure 27:
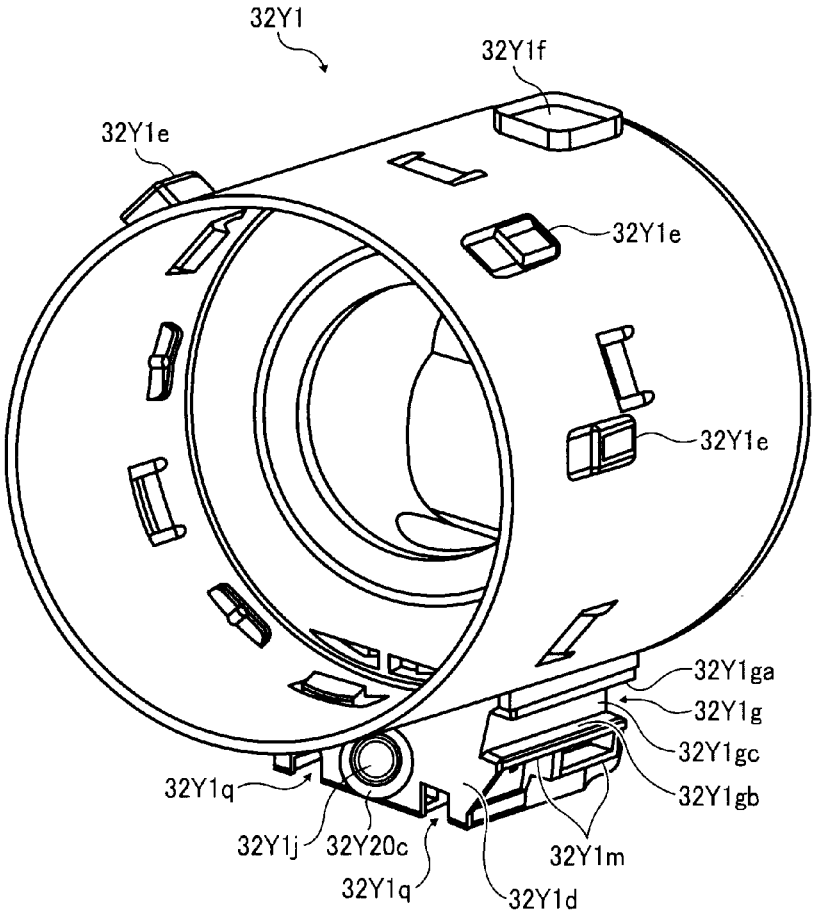
FIG. 27 is another perspective view that illustrates the exterior of the cap.
Figure 28:
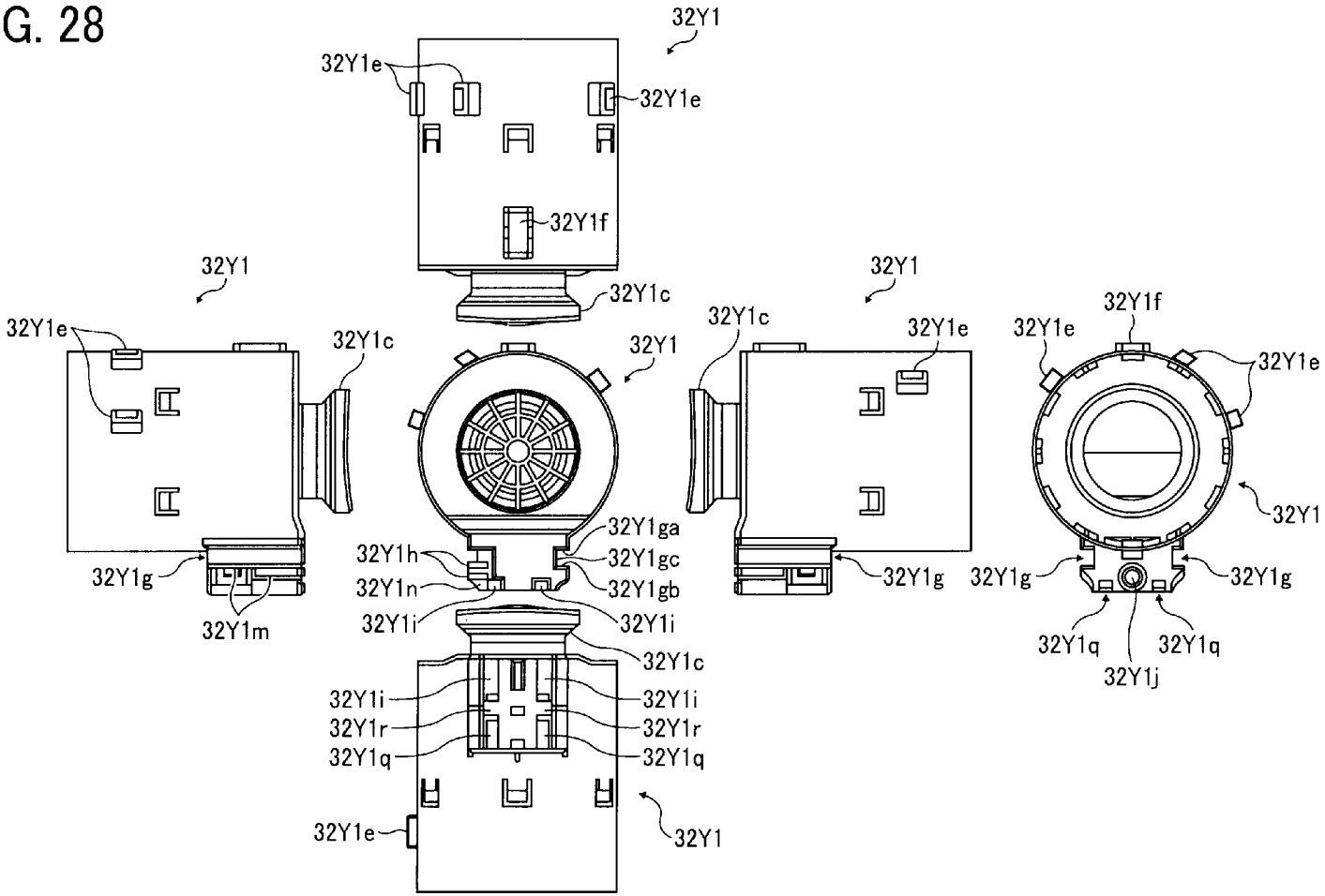
FIG. 28 is a set of six side views of the cap.

FIGS. 26 and 27 are perspective views of the cap 32Y1, and FIG. 28 is a set of six sides views. It is to be noted that reference character 32Y1*q* represents a pair of third grooves.

When inserted into the toner container mount 31, the cap 32Y1 is held and fixed in position relative to the toner container mount 31 (main body 100). In other words, after fully inserted into the toner container mount 31, the cap 32Y1 does not rotates, and only the bottle 32Y2 can rotates relative to the main body 100.

It is to be noted that, referring to FIGS. 26 and 27, the gap between the cap 32Y1 and the bottle 32Y2 is filled with a seal 32Y20*a* attached to a handle body 32Y20 of the cap 32Y1, securing the sealing therebetween. More specifically, a rim of the bottle 32Y2 defining the opening 32Y2*c* extends into the seal 32Y20*a* and slides on the seal 32Y20*a*, and thus toner does not leak out from the gap between the bottle 32Y2 and the cap 32Y1.

Referring to FIGS. 26 and 27, the cap 32Y1 includes the electronic board 32Y1*f*, the protrusions 32Y1*e* for color discrimination, the handle 32Y1*c*, and the toner discharge portion 32Y1*d* as described above. Additionally, the pair of first grooves 32Y1*g* is provided in either side surface (in parallel to the installation direction) of the toner discharge portion 32Y1*d* of the cap 32Y1 as engagement portions that engage the respective positioning protrusions 78 of the toner container mount 31. Referring to FIGS. 26 and 28, each first groove 32Y1*g* is defined by a pair of horizontal faces 32Y1*ga* and 32Y1*gb* facing each other, extending in the installation direction of the toner container 32Y in the main body 100, and a vertical face 32Y1*gc* positioned between the and horizontal faces 32Y1*ga* and 32Y1*gb*, extending in the installation direction as well. The cap 32Y1 does not rotate in conjunction with the rotation of the bottle 32Y2 but is retained stationary by the bottle fixing portion 70 of the toner container mount 31 with the first grooves 32Y1*g* engaged with the positioning protrusions 78.

Figure 29:
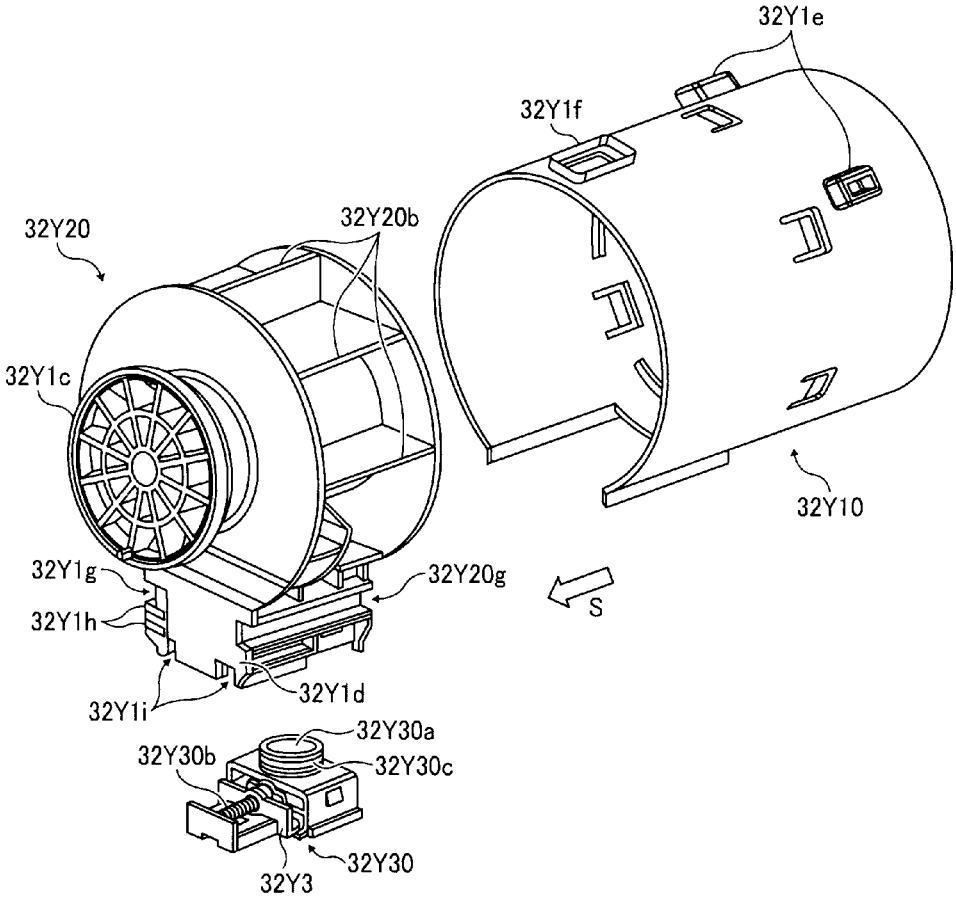
FIG. 29 is an exploded perspective view of the cap.
Figure 30:
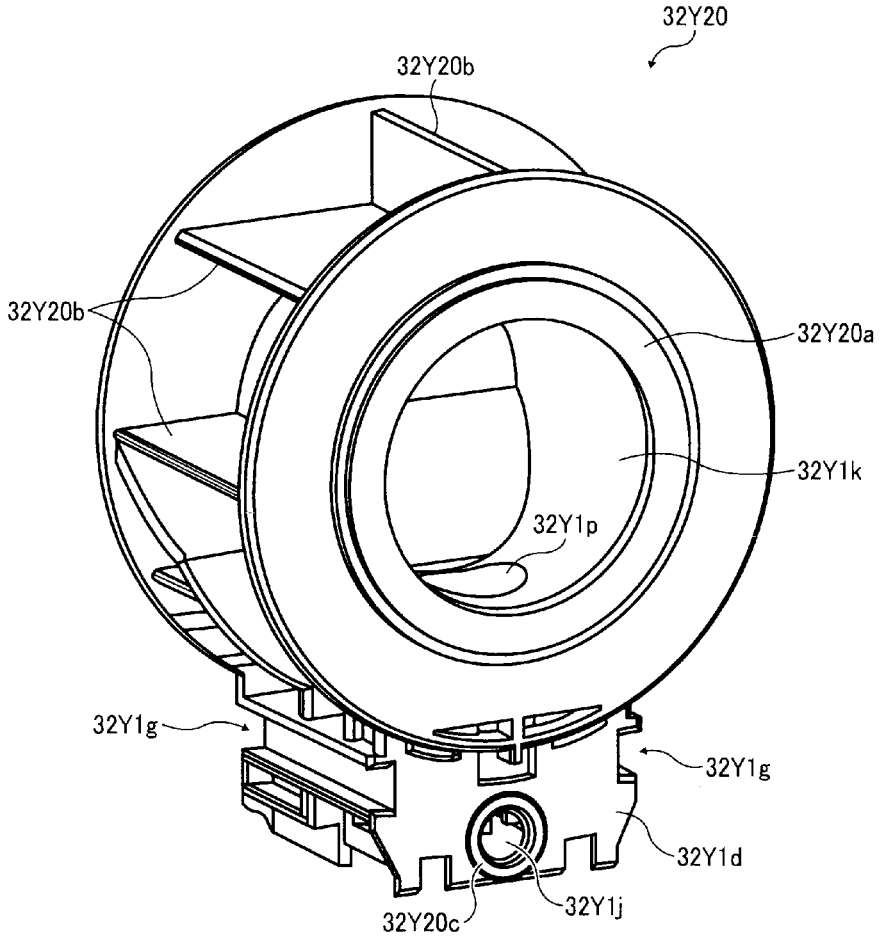
FIG. 30 is a perspective view of a handle body.
Figure 31:
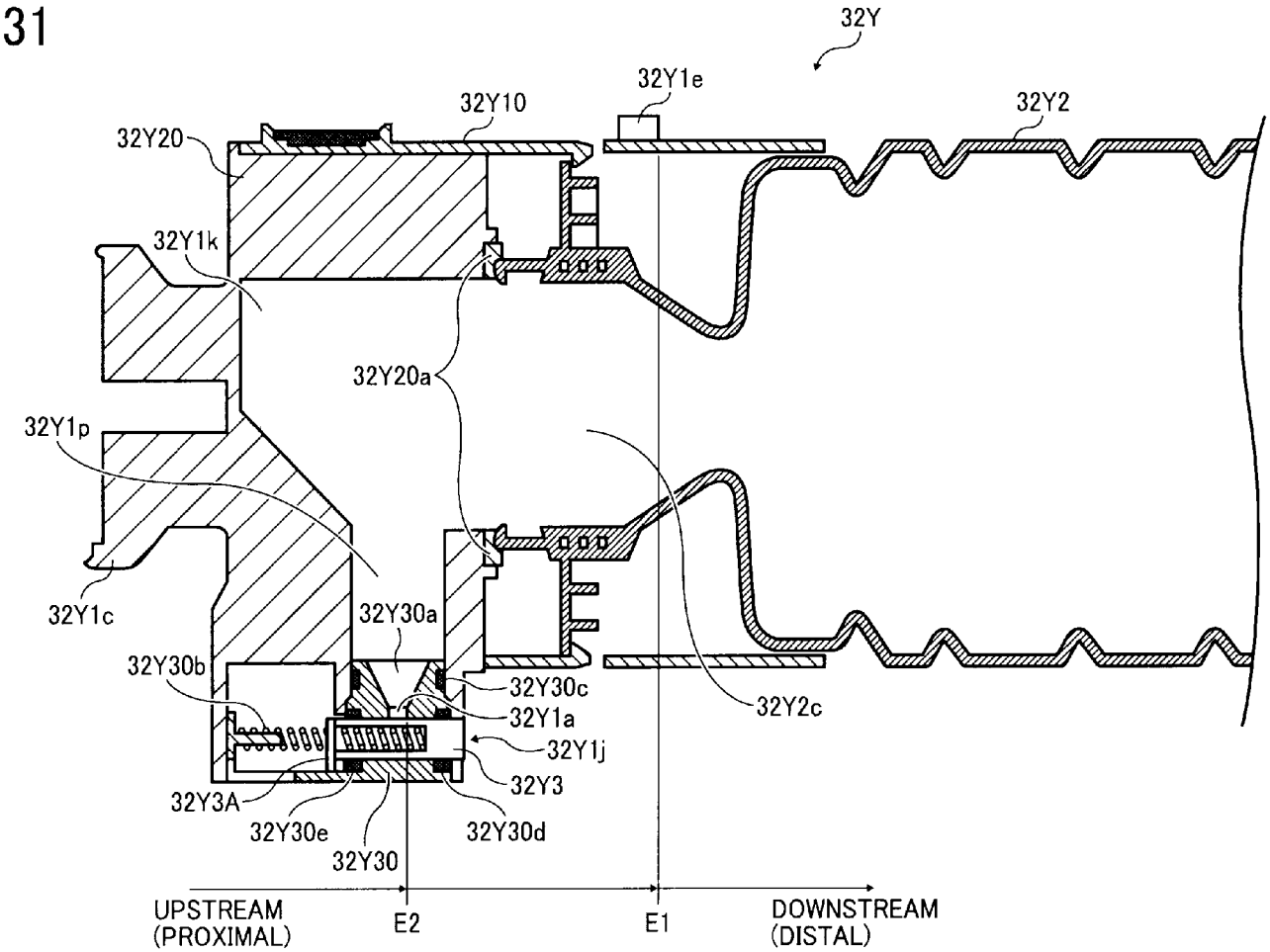
FIG. 31 is a cross-sectional view of a vicinity of the cap.
Figure 32:
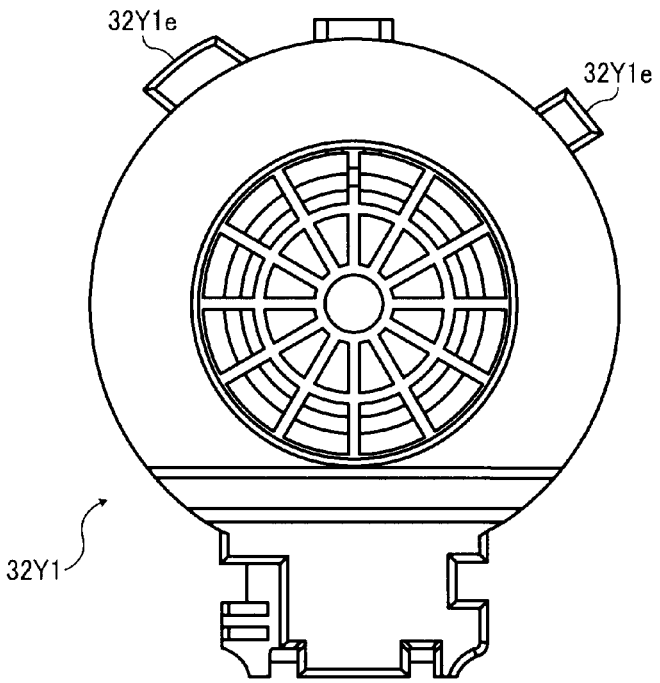
FIG. 32 is a front view of the cap of the yellow toner container.

FIG. 29 is an exploded perspective view of the cap 32Y1. The cap 32Y1 includes a cap body 32Y10, the handle body 32Y20, and a nozzle insertion portion 32Y30. FIG. 30 is a perspective view of the handle body 32Y20 as viewed in the direction indicated by arrow A shown in FIG. 31 The handle body 32Y20 is fitted into the cap body 32Y10, that is, the handle body 32Y20 is partly covered with the cap body 32Y10. In the configuration shown in FIGS. 29 and 30, the handle body 32Y20 includes multiple ribs 32Y20*b*, and edge faces of the ribs 32Y20*b* are bonded or welded to an inner circumferential face of the cap body 32Y10. A recess is formed in a lower portion of the handle body 32Y20 in FIG. 30, and the nozzle insertion portion 32Y30 is fitted in the recess as shown in FIG. 31.

Referring to FIG. 29, the electronic board 32Y1*f* and the protrusions 32Y1*e* for color discrimination are provided on the outer circumferential surface of the cap body 32Y10. The handle body 32Y20 further includes the handle 32Y1*c*, projecting in parallel to the installation direction of the toner container 32Y from a circular face of a cylindrical portion of the handle body 32Y20, and the toner discharge portion 32Y1*d* positioned beneath the cylindrical portion. Referring to FIG. 30, inside the cylindrical portion, the toner reservoir 32Y1*k* (hollow) for temporarily storing toner and a cylindrical communication portion 32Y1*p* through which the toner reservoir 32Y1*k* and the toner discharge portion 32Y1*d* communicate with each other are provided. The toner discharge portion 32Y1*d* includes the pair of first grooves 32Y1*g*, the pressed portion 32Y1*h*, and the nozzle inlet 32Y1*j*.

Additionally, a seal 32Y30*c* enclosing the nozzle inlet 32Y1*j* is provided. The seal 32Y30*c* can prevent leakage of toner from the gap between the nozzle 72 and the nozzle inlet 32Y1*j* when the toner container 32Y is set in the toner container mount 31. The seal 32Y30*c* also serves as a cushion for absorbing the impact when the toner container 32Y is slid in the toner container mount 31 and then is fully inserted therein.

In other words, the seal ability between the cap 32Y1 and the bottle 32Y2 are secured by the seal 32Y20*a* adhered to the handle body 32Y20 of the cap 32Y2. Since a lip of the opening 32Y2*c* of the bottle 32Y2 bites into the seal 32Y30*a* and slides on the seal 32Y30*a*, the leakage from the gap between the cap 32Y and the bottle 32Y can be prevented.

Further, referring to FIG. 29, the nozzle insertion portion 32Y30 includes the nozzle connection compartment 32Y1*b* (also shown in FIG. 6) to accommodate the plug 32Y3, the toner outlet 32Y1*a* positioned above the nozzle connection compartment 32Y1*b*, through which the toner reservoir 32Y1*k* communicates with the nozzle connection compartment 32Y1*b*, and a toner discharge path 32Y30*a* formed inside the cylindrical communication portion 32Y1*p* formed beneath the toner reservoir 32Y1*k*. The toner is discharged from the toner reservoir 32Y1*k* through the toner discharge path 32Y30*a* to the toner outlet 32Y1*a* and the nozzle connection compartment 32Y1*b* into which the nozzle 72 of the toner container mount 31 is inserted. When the nozzle insertion portion 32Y30 is fitted the recess formed in the toner discharge portion 32Y1*d* of the handle body 32Y20, the nozzle connection compartment 32Y1*b* communicates with the nozzle inlet 32Y1*j* of the toner discharge portion 32Y1*d*.

As shown in FIG. 29, the plug 32Y3 housed inside the nozzle connection compartment 32Y1*b* includes a cylindrical portion and a planar projection provided on an end of the cylindrical portion, projecting symmetrically. The plug 32Y3 moves inside the nozzle connection compartment 32Y1*b*, thereby opening and closing the toner outlet 32Y1*a*. A planar projection 32Y3A is provided on the upstream end (proximal end) of the plug 32Y3 in the installation direction of the toner container 32Y and extends horizontally, in the direction perpendicular to the center axis of the cylindrical portion. The pawl 75 of the toner container mount 31 engages the planar projection 32Y3A (see also FIG. 31) of the plug 32Y3, and accordingly the pawl 75 pushes the plug 32Y3 in the direction to close the toner outlet 32Y1*a* in conjunction with removal of the toner container 32Y from the toner container mount 31.

Additionally, a spring 32Y30*b* to bias the plug 32Y3 in the direction to close the toner outlet 32Y1*a* may be provided. The spring 32Y30*b* also can move the plug 32Y3 in the direction to close the toner outlet 32Y1*a* with its bias force when the toner container 32Y is removed. Providing the spring 32Y30*b* is preferable in that leakage of toner from the toner outlet 32Y1*a* can be reduced because the spring 32Y30*b* can accelerate the initial action of the plug 32Y3 moving in the direction to close the toner outlet 32Y1*a*. Although the plug 32Y3 can be moved in the direction to close the toner outlet 32Y1*a* by either the engagement between the plug 32Y3 and the pawl 75 or the bias by the spring 32Y30*b*, using both is preferable because the leakage of toner from the toner outlet 32Y1*a* can be better prevented. It is to be noted that, in the present embodiments, the image forming apparatus 200 includes both of the pawl 75 and the spring 32Y30*b*.

FIG. 31 is a vertical cross-sectional view around the cap 32Y1 and a front portion of the bottle 32Y1 of the toner container 32. In FIG. 31, the plug 32Y3 for opening and closing the toner outlet 32Y1*a* in conjunction with removal of the toner container 32Y is positioned in the nozzle connection compartment 32Y1*b*.

Pairs of O-rings 32Y30*d* and 32Y30*e* are provided on both ends of the plug 32Y3 to prevent leakage of toner from the gap between the plug 32Y3 and the nozzle connection compartment 32Y1*b*. Additionally, an O-ring 32Y30*c* is fitted around a circumferential surface of the portion of the nozzle insertion portion 32Y30 forming the toner discharge path 32Y30*a* to prevent leakage of toner from the gap between the handle body 32Y20 and the nozzle insertion portion 32Y30 (two O-ring 32Y30*c* is provided shown in FIG. 31). The downstream end or distal end (on the right in FIG. 31) of the nozzle connection compartment 32Y1*b* in the installation direction of the toner container 32Y into the main body 100 communicates with the nozzle inlet 32Y1*j*. The nozzle 72 is inserted into the nozzle inlet 32Y1*j* in conjunction with installation of the toner container 32Y in the toner container mount 31 as shown in FIGS. 6 and 7.

Further, referring back to FIGS. 28 and 29, the pair of second grooves 32Y1*i* is formed in the outer bottom surface of the cap 32Y1. The plug 32Y3 moves relatively to the cap 32Y1 as the cap 32Y1 moves with the second grooves 32Y1*i* engaged with the pawl 75 of the main body 100. Moreover, the pair of third grooves 32Y1*q* is formed in the outer bottom surface of the cap 32Y1 in line with the second grooves 32Y1*i*. That is, when viewed in the installation direction of the toner container 32Y, the second grooves 32Y1*i* overlap with the third grooves 32Y1*q*. A pair of slidable surfaces 32Y1*r* to slide down the pawl 75 is formed between the second grooves 32Y1*i* and the third grooves 32Y1*q* so that the pawl 75 does not hinder installation of the toner container 32Y. Edges of the slidable surfaces 32Y1*r* on the side of the pair of third grooves 32Y1*q* are sloped to push down the pawl 75 smoothly.

The electronic board 32Y1*f* provided on the upper face of the cap 32Y1 is a radio frequency identification (RFID) chip or IC chip, for example, and is used for exchanging the data relating to the toner container 32Y and the main body 100 with the main body 100 (antenna board 74) as described above with reference to FIG. 8. The electronic board 32Y1*f* is positioned opposite the nozzle connection compartment 32Y1*b* relative to the long axes of the toner container 32Y. This arrangement can prevent toner adhering to a vicinity of the nozzle connection compartment 32Y1*b* from dropping on the electronic board 32Y1*f* and a resultant deterioration in the communication sensitivity.

Further, referring back to FIG. 26, the handle 32Y1*c* is provided on the upstream side of the cap 32Y1 in the installation direction of the toner container 32Y, and the user can grip the handle 32Y1*c* to install or remove the toner container 32Y from the main body 100. The handle 32Y1*c* is provided on the face of the cap 32Y1 opposite the face in which the nozzle inlet 32Y1*j* is formed, projecting in the removal direction of the toner container 32Y from the main body 100. This arrangement can reduce the possibility that the user unintentionally touches the nozzle inlet 32Y1*j*, to which toner tends to adhere, when the user grips the handle 32Y1*c*.

Referring to FIGS. 26 and 32 through 35, descriptions are given below of preventing toner containers of wrong type from being inserted into the insertion opening 71 and preventing leakage of the toner therefrom when users mistakenly try to install the toner container 32 of the wrong type in the toner container mount 31.

Figure 35:
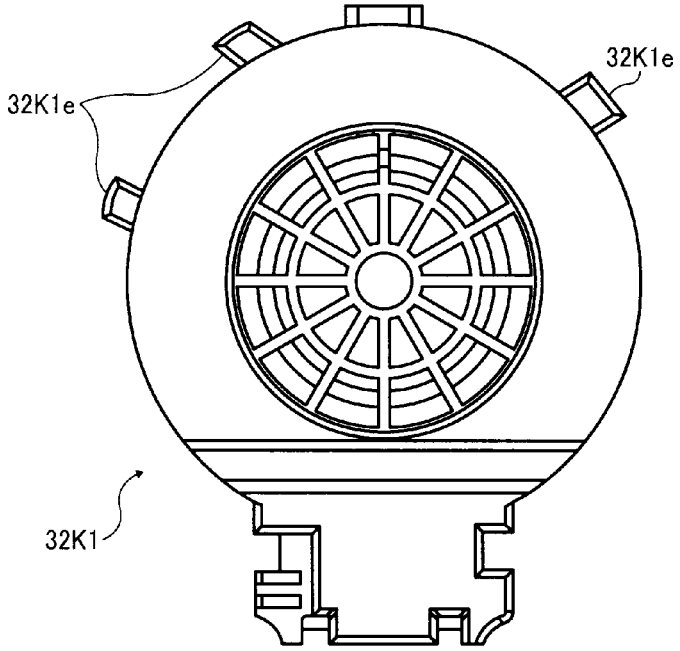
FIG. 35 is a front view of the cap of the black toner container.

The color discrimination protrusions 32Y1*e* are configured to prevent toner containers 32M, 32C, and 32K of other colors from being inserted into the insertion opening 71Y (toner container mount 31) for yellow as described above with reference to FIG. 22. More specifically, the color discrimination protrusions 32Y1*e* for yellow shown in FIG. 32, the color discrimination protrusions 32M1*e* for magenta shown in FIG. 33, the color discrimination protrusions 32C1*e* for cyan shown in FIG. 34, and the color discrimination protrusions 32K1*e* for black shown in FIG. 35 are different in at least one of arrangement, shape, and quantity so as to fit only the first guide grooves 71Y1, 71M1, 71C1, and 71K1 of the corresponding insertion openings 71Y, 71M, 71C, and 71K (shown in FIG. 22), respectively.

In the present embodiments, referring to FIG. 31, in the installation direction of the toner container 32Y into the main body 100, a downstream end (distal end) of the rim defining the toner outlet 32Y1*a* is positioned at a position E2 upstream (proximal side) from a position E1 of a downstream end 32Y1*e*-1 of the protrusions 32Y1*e* for color discrimination. With this arrangement, even when the toner container 32 of wrong color is inserted into the insertion opening 71Y for yellow, that toner container 32 cannot be inserted further from the downstream end of the color discrimination protrusions 32M1*e*, 32C1*e*, or 32K1*e* in the installation direction because the color discrimination protrusions 32M1*e*, 32C1*e*, or 32K1*e* interfere with insertion opening 71Y. Consequently, the nozzle 72 is not inserted into the nozzle inlet 32M1*j*, 32C1*j*, or 32K1*j*, and the toner outlet 32M1*a*, 32C1*a*, or 32K1*a* is not opened. Thus, toner does not leak out through the toner outlet 32M1*a*, 32C1*a*, or 32K1*a*, or drop inside the toner container mount 31. Also, toner does not scatter in the portion of the toner container mount 31 for different color.

When the toner container 32Y is installed in the toner container mount 31, the pressed portion 32Y1*h* is pressed against the pawl 76*a* of the lever 76 and thus held in the toner container mount 31. More specifically, the pressed portion 32Y1*h* is positioned to be pressed against the lever 76 when the position of the toner container 32Y, which is biased by the driving coupling 91 and held by the lever 76, is determined in the installation direction.

Referring to FIG. 26, the pressed portion 32Y1*h* is constructed of two projections, such as ribs, that projects from the face 32Y1*n* of the cap 32Y1 perpendicular to the installation direction and two projections and projects in the direction in the removal direction of the toner container 32Y. The pressed portion 32Y1*h* is pressed against the lever 76 with the bias force from the distal side to the proximal side, exerted by the driving coupling 91. The apexes of the two projections can enhance accuracy in the registration of the toner container 32Y in the installation direction.

Referring to FIG. 26, the ribs (sliding contact portion) 32Y1*m* extending in the installation direction are provided on the back side of the face 32Y1, opposite the side on which the pressed portion 32Y1*h* is formed. In other words, the ribs 32Y1*m* extend in parallel to the direction in which the pressed portion 32Y1*h* projects. As described above with reference to FIGS. 14 through 17, the sliding contact portion 32Y1*m* slides on the lever 76 and keeps the position of the lever 76 at the release position, at which the lever 76 does not prevent insertion or removal of the toner container 32Y, when the toner container 32Y is inserted or removed from the toner container mount 31. Additionally, the sliding contact portion 32Y1*m* can secure the strength of the face 32Y1 on which the pressed portion 32Y1*h* is formed. Further with reference to FIG. 22, the upper one of the two ribs serving as the sliding contact portion 32Y1*m* forms the horizontal face 32Y1*gb* that forms the first groove 32Y1*g* that engages with the positioning protrusion 78 in the toner container mount 31.

Descriptions are given below of opening and closing the toner outlet 32Y1*a* when the toner container 32Y is installed and removed from the toner container mount 31 with reference to FIGS. 36 through 41.

Figure 36:
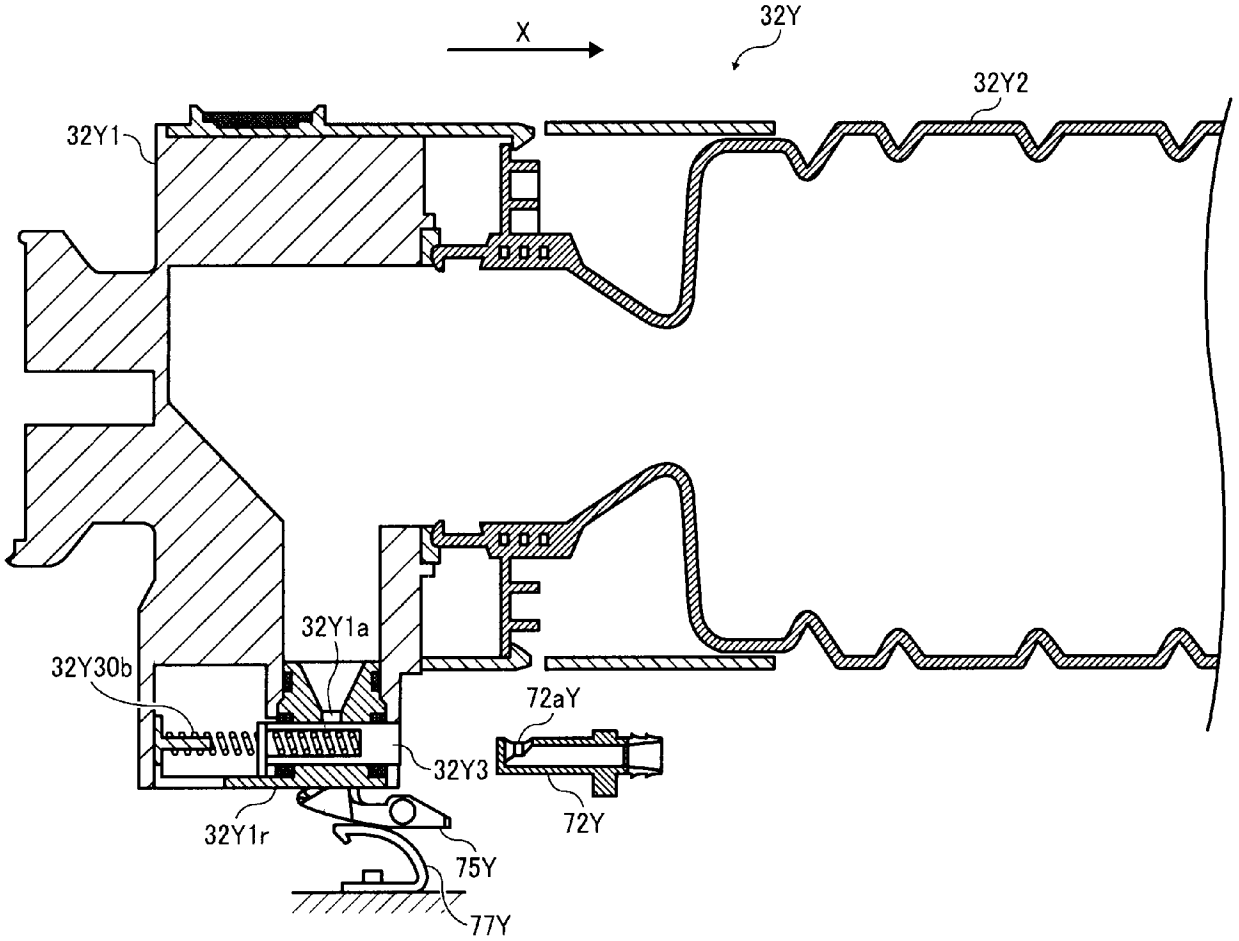
FIG. 36 is a schematic cross-sectional view that illustrates installation of the toner container into the toner container mount.
Figure 37:
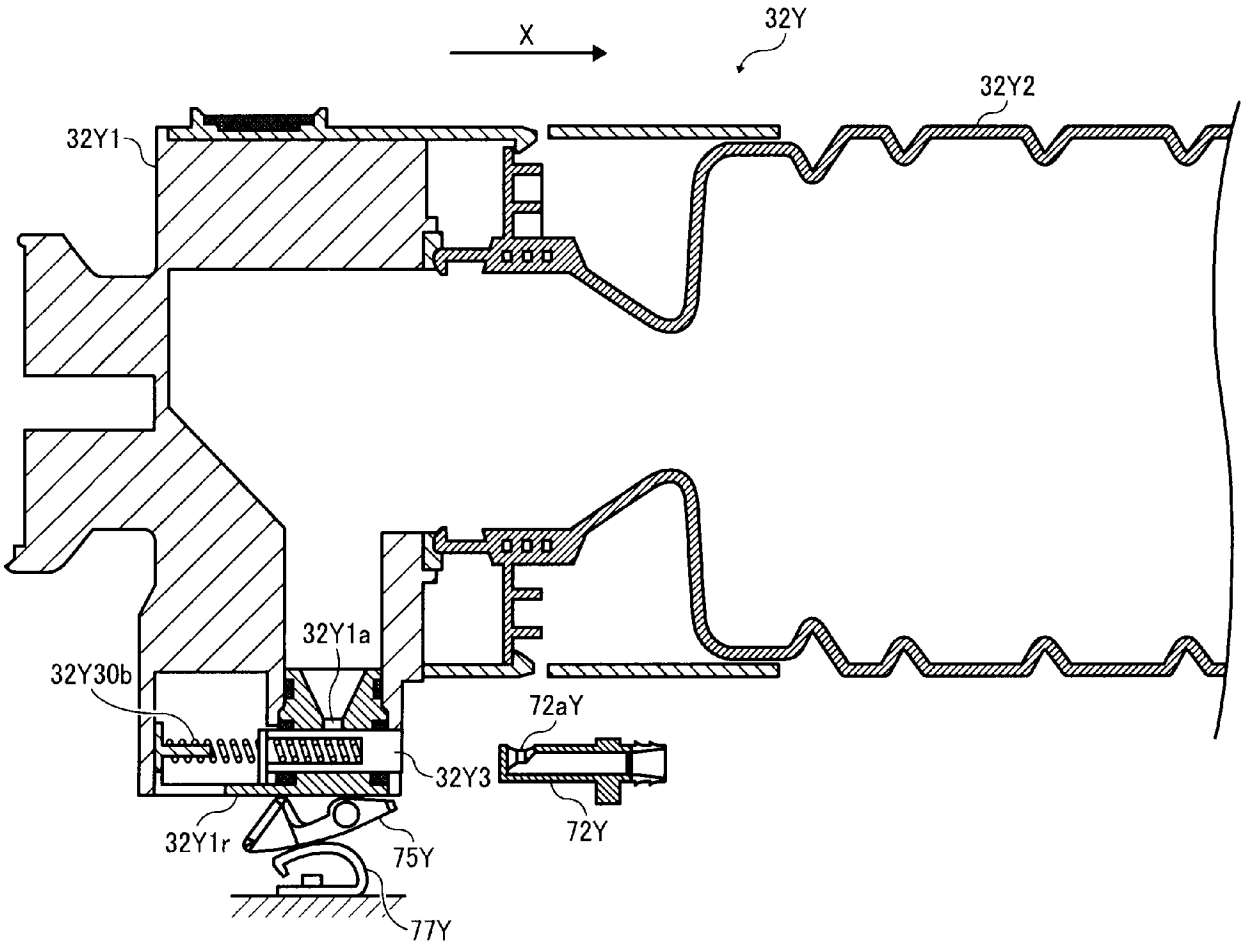
FIG. 37 is schematic cross-sectional view that illustrates a state subsequent to that shown in FIG. 36 in installation of the toner container.
Figure 38:
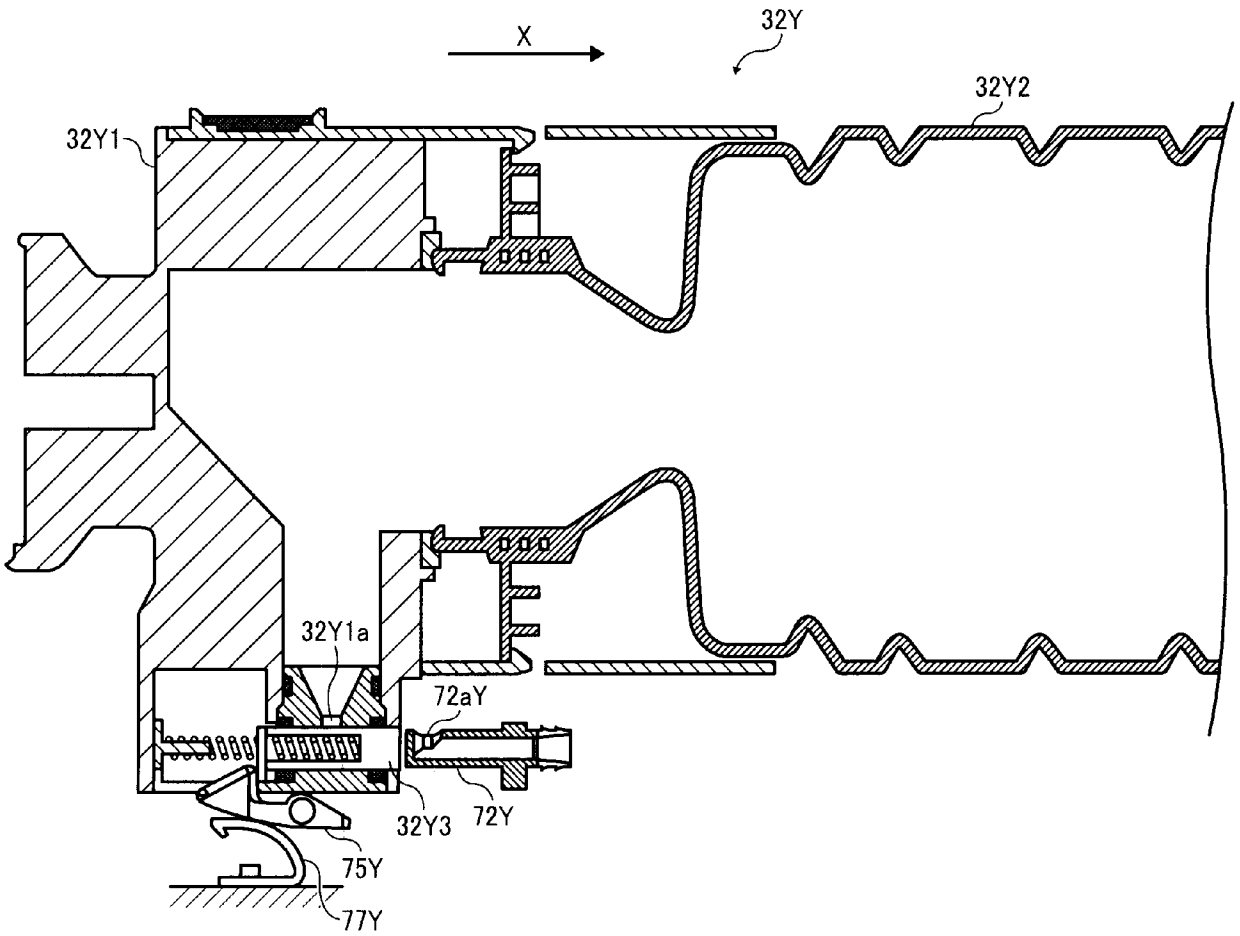
FIG. 38 is schematic cross-sectional view that illustrates a state subsequent to that shown in FIG. 33 in installation of the toner container.
Figure 39:
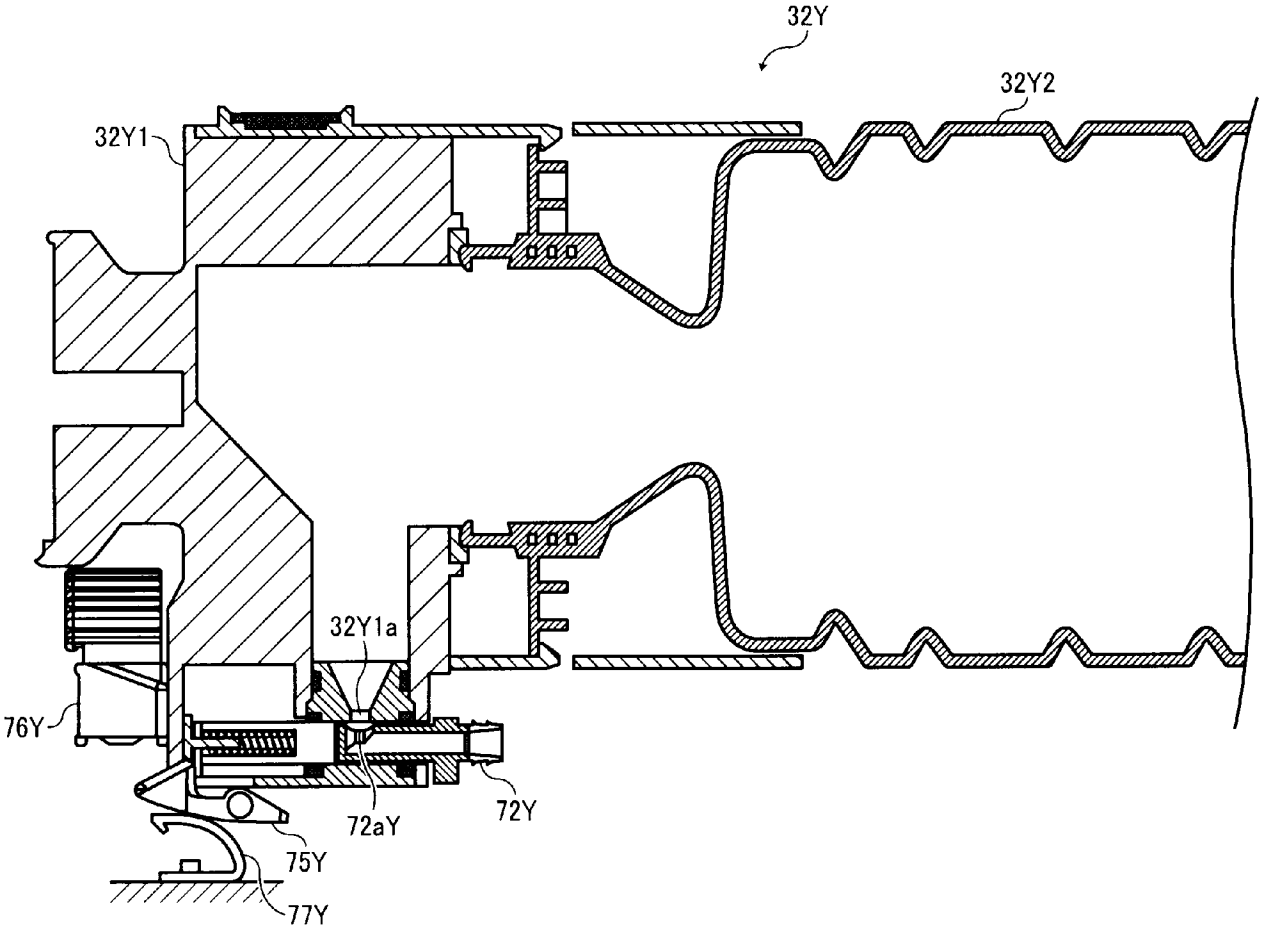
FIG. 39 is a cross-sectional view that illustrates the toner container set in the toner container mount.
Figure 40:
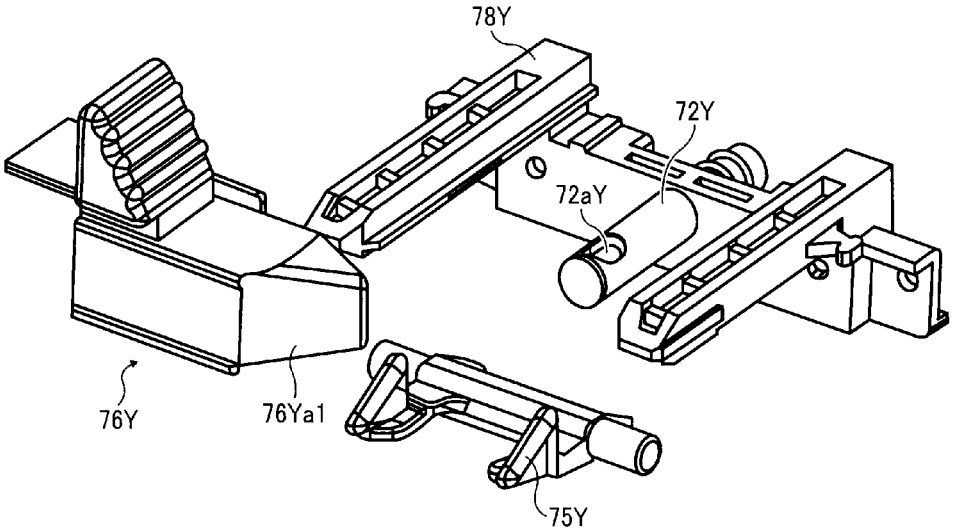
FIG. 40 is a perspective view that illustrates relative positions of a nozzle, a pawl, and the lever for fixing and releasing the toner container.
Figure 41:
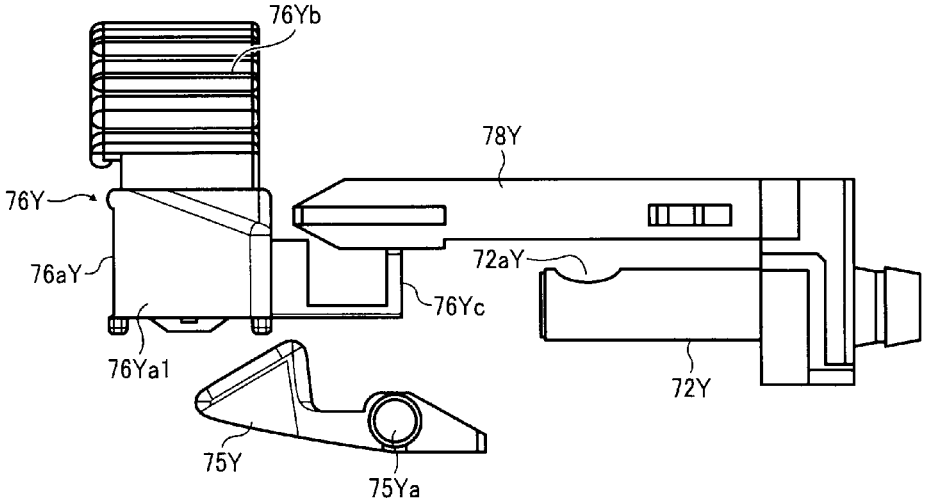
FIG. 41 is a side view that illustrates the relative positions of the nozzle, the pawl, and the lever for fixing and releasing the toner container.

FIGS. 36 through 38 are schematic cross-sectional views in parallel to the long axis of the toner container 32Y that illustrate progress of insertion of the toner container 32Y into the toner container mount 31 in the installation direction X. FIG. 39 is a schematic cross-sectional views in parallel to the long axis of the toner container 32Y that illustrate in the toner container 32Y fully inserted in the toner container mount 31 and the toner outlet 32Y1*a* is opened fully. FIG. 40 is a perspective view that illustrates relative positions of the nozzle 72, the pawl 75, and the lever 76 provided in the toner container mount 31. FIG. 41 is a side view in parallel to the long axis of the toner container 32Y that illustrates relative positions of the nozzle 72, the pawl 75, and the lever 76. In FIG. 41, the toner container 32Y to be inserted into the toner container mount 31 moves from the left to the right. Referring to FIG. 41, the lever 76, the pawl 75, and the nozzle 72 are arranged, in that order, in the installation direction of the toner container 32Y.

To mount the toner container 32Y in the toner container mount 31 of the main body 100, initially the cover provided on the front side of the main body 100 is opened, and thus the toner container mount 31 (insertion openings 71) is exposed on the front side.

Subsequently, the user grips the handle 32Y1*c* and pushes the toner container 32Y into the toner container mount 31. More specifically, the toner container 32Y is inserted into the toner container mount 31 along the longitudinal direction of the toner container 32Y with the cap 32Y1 positioned upstream from the bottle 32Y2 in the installation direction.

At that time, downstream end portions of the ribs 32Y1*m* (shown in FIG. 26) in the installation direction, serving as the sliding contact portion, contact the sloped surface 76*a*1 of the pawl 76*a* of the lever 76. The sloped surface 76*a*1 of the pawl 76*a* of the lever 76 is sloped so that the pawl 76*a* extends closer to the toner container 32Y downstream in the installation direction of the toner container 32Y as shown in FIGS. 14 through 17. Accordingly, as insertion of the toner container 32Y progresses, the lever 76 is pushed by the downstream end portions of the ribs 32Y1*m* to the release position not to hinder the insertion of the toner container 32Y. As the toner container 32Y is further inserted with an edge portion of the lever 76 at the release position in sliding contact with the ribs 32Y1*m*, the pawl 75 engages the pair of third grooves 32Y1*q* provided on the bottom face of the toner container 32Y as shown in FIG. 36. At that time, the first grooves 32Y1*g* of the cap 32Y1 engage the positioning protrusions 78 of the toner container mount 31, thus starting registration of the toner container 32Y.

When the pawl 75 of the toner container mount 31 comes in contact with the slidable surface 32Y1*r* of the cap 32Y1 as the toner container 32Y is inserted further, the pawl 75 is pushed down by a sloped face on the rim of the slidable surface 32Y1*r*. Thus, the pawl 75 is moved to the release position not to hinder insertion of the cap 32Y1. The toner container 32Y is further inserted as the pawl 75 pushed down slides on the slidable surface 32Y1*r* as shown in FIG. 37.

Subsequently, when the pawl 75 reaches the second groove 32Y1*i* as the toner container 32Y is inserted further, the pawl 75 moves from the release position shown in FIG. 37 and projects to the position engaging the plug 32Y3 so as to fit in the second groove 32Y1*i*. That is, the pawl 75 rotates about the shaft 75*a* (shown in FIG. 38). In other words, the slidable surface 32Y1*r* no longer pushes the pawl 75, and then the pawl 75 is pushed up by the leaf spring 77. At that time, a downstream end portion of the plug 32Y3 in the installation direction of the toner container 32Y reaches a position to contact the nozzle 72, and the position of the plug 32Y3, clamped by the nozzle 72 and the pawl 75, is determined relative to the toner container mount 31Y as shown in FIG. 38.

As the toner container 32Y is inserted further in the installation direction X, the nozzle 72 fits in the nozzle inlet 32Y1*j* with the positioning protrusions 78 fitted in the first grooves 32Y1*g*. Accordingly, the plug 32Y3 moves in the nozzle connection compartment 32Y1*b* relatively, thereby opening the toner outlet 32Y1*a*.

Then, referring to FIG. 39, the plug 32Y3 opens the toner outlet 32Y1*a* fully, and the nozzle 72 is inserted into the cap 32Y1 so that the toner inlet 72*a* of the nozzle 72 communicates with the toner outlet 32Y1*a*. Simultaneously, the lever 76 that has moved to the release position and slid on the ribs 32Y1*m* reaches upstream end portions of the ribs 32Y1*m* in the installation direction X and is no longer pushed by the ribs 32Y1*m*. Then, the lever 76 returns to the retention position, pushed by the spring 76*d* as shown in FIG. 12. Thus, installation of the toner container 32Y is completed.

To remove the toner container 32Y from the toner container mount 31, the above-described processes are executed in the reverse order to that in insertion of the toner container 32Y.

When the lever 76 is moved to the release position, the driving coupling 91 of the toner container mount 31 pushes the toner container 32Y in the removal direction (to the left in FIG. 39). Simultaneously, the spring 32Y30*b* and the pawl 75 in contact with the plug 32Y3 push the plug 32Y3 in the nozzle connection compartment 32Y1*b*, thereby closing the toner outlet 32Y1*a*. At that time, while keeping the release position, the lever 76 slides on the ribs 32Y1*m* on the cap 32Y1 and does not move to the retention position to hinder removal of the toner container 32Y. Subsequently, when the toner container 32Y is moved from the state shown in FIG. 38, further in the removal direction opposite the installation direction X, the pawl 75 is pushed down to the position not to hinder removal of the cap 32Y1 as shown in FIG. 37. As the toner container 32Y is moved further in the removal direction, the pawl 75 is no longer pushed by the slidable surface 32Y1*r* and then is pushed up by the leaf spring 77. Then, the pawl 75 fits in the third groove 32Y1*q* as shown in FIG. 36. When the cap 32Y1 is removed completely from the toner container mount 31, the lever 76 is not pushed by the rib 32Y1*m* but is moved by the spring 76*d* to the retention position.

Next, supply of toner from the toner containers 32 according to the present embodiments when one of them is removed (replaced) is described in detail below.

In the image forming apparatus 200 according to the present embodiments, when one of the yellow, cyan, magenta, and black toner containers 32 is removed, for example, for replacement, supply of the toner from other toner containers 32 is not stopped. In other words, the motors 92 for the respective toner containers 32 can be driven independently, and other toner containers 32 in the toner container mount 31 than the one removed therefrom receive driving forces from the respective motors 92. When the cover provided on the front side of the main body 100 is opened, although the toner containers 32 set in the toner container mount 31 are exposed, the bottle bodies (e.g., 32Y2) that rotate are positioned on the back of the respective caps (e.g., 32Y1). Because the bottle 32Y2 is not exposed through the insertion opening 71Y, the possibility that the user touches the rotating bottle 32Y2 and gets injured is eliminated even when the toner container 32Y is being driven by the bottle driving unit 90.

The user, however, might get injured in case the driving force is transmitted from the bottle driving unit 90 to the toner container 32 to be removed in removal of that toner container 32. Therefore, the present embodiments can make sure to stop driving of the toner container removed from the toner container mount 31 with driving of other toner containers 32 kept when one of the toner 32 containers is removed.

As described above, the bottle fixing portion 70 includes the position detectors 79 shown in FIGS. 18 through 21 for detecting the positions of the respective levers 76. In the present embodiments, start and stop rotating the toner containers 32, writing data in the electronic boards (ID chips) 32Y1*f*, and supplying toner from the toner containers 32 can be controlled with signals output from the respective position detectors 79. More specifically, the image forming apparatus 200 includes the controller 101 to control start and stop of the bottle driving units 90, data writing in the electronic boards (ID chips) 32Y1*f*, and the toner supply, and the controller 101 performs these control operations according to the signals output from the position detectors 79.

When the output from the lever position detector 79 is on, that is, in the state shown in FIGS. 18 and 19, the controller 101 drives the motor 92Y as required. The controller 101, however, stops the motor 92Y compulsively even if driving the motor 92Y is necessary, when the output from the lever position detector 79 is off, that is, in the state shown in FIGS. 20 and 21. More specifically, when the toner container 32Y is set in the toner container mount 31, the lever 76 is at the retention position, thus retaining the toner container 32Y. At that time, the lever position detector 79 detects the lever 76 and outputs the detection signal. Therefore, even when the lever 76 is moved to the retention position, the controller 101 does not drive the motor 92 unless a container detector detects that the toner container 32Y is set in the toner container mount 31. Thus, the controller 101 drives the motor 92 as required only when the lever position detector 79 detects that the lever 76 is at the retention position and the container detector detects that the toner container 32Y is set in the toner container mount 31. With this configuration, because the motor 92 to rotate the toner container 32Y is started only after the toner container 32Y is fully retained in the toner container mount 31 properly, that is, the motor 92 is started only after the user moves the toner container 32Y to the installation position, the lever 76 is moved from the release position to the retention position, and the lever position detector 79 detects that the lever 76 is at the retention position. Accordingly, the occurrence of the problem that the user touches the rotating bottle 32Y in installation of the toner container 32Y can be avoided.

By contrast, in removal of the toner container 32Y, the output from the lever position detector 79 is turned off when the lever 76 is slid to the release position. When the output from the lever position detector 79 is off, the controller 101 stops the motor 92Y compulsively even if the antenna board 74 detects the toner container 32Y, the motor 92 is started only after the user moves the toner container 32Y to the installation position, the lever 76 is moved from the release position to the retention position, and the lever position detector 79 detects that the lever 76 is at the retention position. Accordingly, because the lever 76Y is moved from retention position to the release position before the toner container 32Y is pulled out, the occurrence of the problem that the user touches the rotating bottle 32Y in removal of the toner container 32Y can be avoided.

Figure 42:
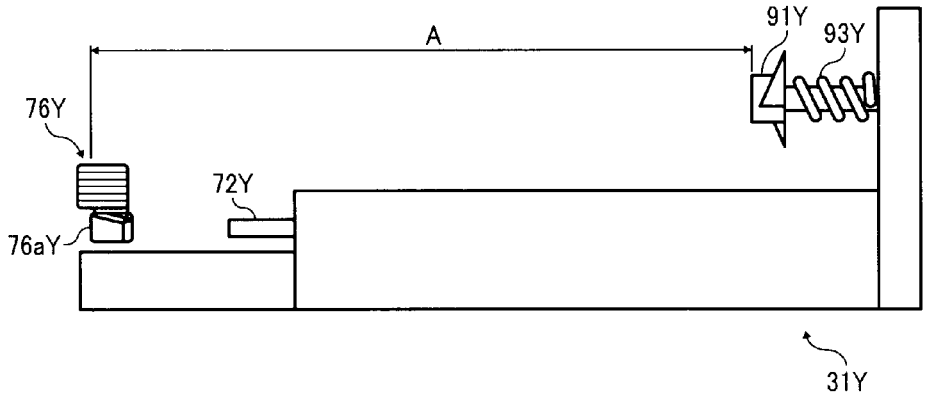
FIGS. 42 and 43 are schematic side views of the toner container and the toner container mount.
Figure 43:
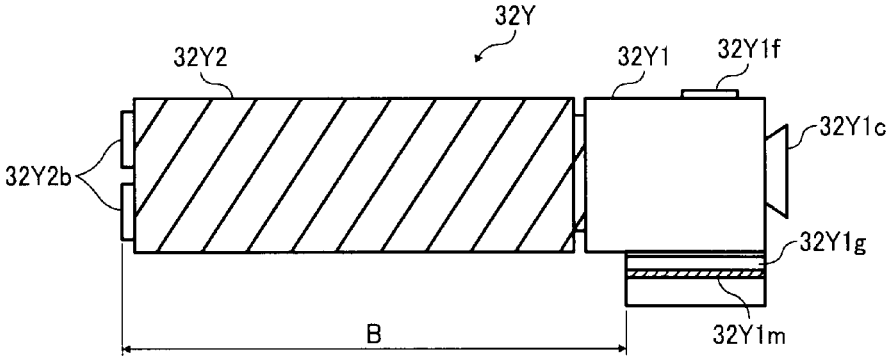

FIG. 42 is a schematic side view that illustrates relative positions of the lever 76 and the bottle driving unit 90 in the installation direction of the toner container 32Y, and FIG. 43 is a schematic side view of the toner container 32Y. For simplification and ease of understanding, the toner container mount 31 and the toner container 32Y shown in FIGS. 42 and 43 are those as viewed from the opposite sides. That is, the toner container 32Y is inserted into the toner container mount 31 from the left to the right in FIG. 42. By contrast, the toner container 32Y is inserted into the toner container mount 31 from the right to the left in FIG. 42.

In FIG. 42, a distance A is a horizontal length of the toner container mount 31 from an upstream end (proximal end) of the pawl 76*a* of the lever 76 to the driving coupling 91 in the installation direction. In FIG. 43, a distance B is a horizontal length from the downstream end portion of the sliding contact portion 32Y1*m* of the toner container 32Y to the driving input parts 32Y2*b* in the installation direction. In the present embodiments, the distance B is longer than the distance A.

With this configuration, in inserting the toner container 32Y into the toner container mount 31, the driving input parts 32Y2*b* do not come into contact with the driving coupling 91 when the toner container 32Y is inserted to a position where the downstream end portion of the sliding contact portion 32Y1*m* of the toner container 32Y starts to contact the pawl 76*a* (shown in FIG. 14). When the toner container 32Y is inserted further backward, the lever 76 slides to the release position, and thus the output from the lever position detector 79 is turned off. Accordingly, driving of the motor 92 of the bottle driving unit 90 is stopped. Therefore, even when the driving input parts 32Y2*b* contact the driving coupling 91, the bottle 32Y2 of the toner container 32Y does not rotate. As described above, when the distance A shown in FIG. 42 is greater than the distance B shown in FIG. 43 (A>B), unintentional rotation of the bottle 32Y2 can be prevented when the toner container 32Y is installed or removed from the toner container mount 31.

The controller 101 controls the data writing and stop of the data writing to IC chip 32Y1*f* based on the output of the laser position detector 79. In removal of the toner container 32Y, the output from the lever position detector 79 is turned off when the lever 76 is slid to the release position. When the output from the lever position detector 79 is off, the controller 101 stops data writing on the IC chip 32Y1*f* compulsively even if writing the data to the IC chip 32Y1*f* is required. This control can inhibits data writing on the IC chip (electronic board) 32Y1*f* when the toner container 32Y is removed from the toner container mount 31. That is, data writing is not attempted when it is inexecutable. Thus, write errors in IC chip caused by pulling out the toner container 32Y from the toner container mount 31 while the controller 101 writes the data to IC chip can be prevented or reduced.

In addition, the controller 101 drives and stops driving the toner supply process in the toner supply device 60 based on the output of the lever position detector 79. When the output of the lever position detector 79 is off, the controller 101 stops driving the screw pump 61 in the toner supply device 60 compulsively even when the driving the screw pump 61 is required. Thus, the occurrence of the problem that supplying the toner from the toner supply device 60 to the toner container 32 while installation and removal of the toner container 32 in and from the toner container mount 31 can be prevented.

Figure 44:
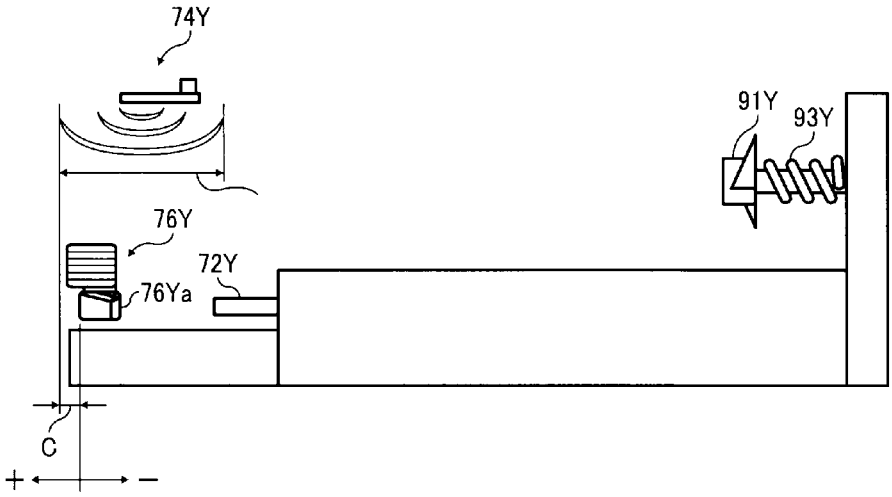
FIGS. 44 and 45 are schematic side views of the toner container and the toner container mount.
Figure 45:
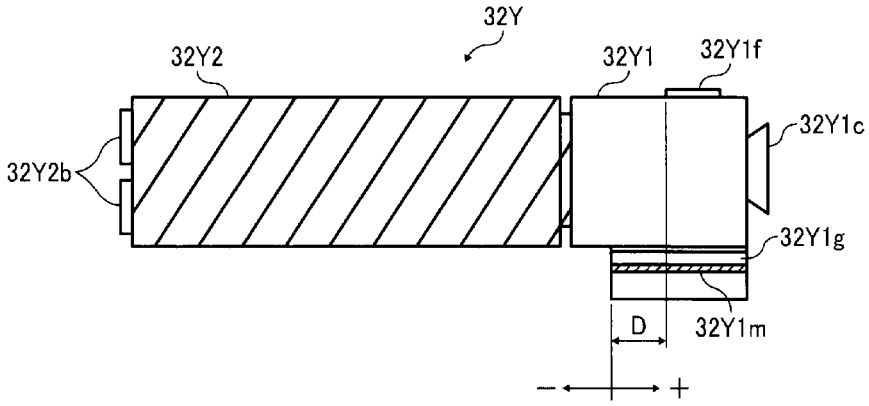

FIG. 44 is a schematic side view that illustrates relative positions of the lever 76 and the antenna board 74 in the installation direction of the toner container 32Y, and FIG. 45 is a schematic side view of the toner container 32Y. For simplification and ease of understanding, the toner container mount 31 and the toner container 32Y shown in FIGS. 44 and 45 are those as viewed from the opposite sides. That is, the toner container 32Y is inserted into the toner container mount 31 from the left to the right in FIG. 44. By contrast, the toner container 32Y is inserted into the toner container mount 31 from the right to the left in FIG. 45.

In FIG. 44, a distance C is a horizontal distance, in the installation direction of the toner container 32Y, from the upstream end of the pawl 76*a* of the lever 76 to an upstream end (proximal limit position) of the communicational area in which the antenna board 74 can communicate the electronic board 32Y1*f*. In FIG. 45, a distance D is a horizontal distance, in the installation direction of the toner container 32Y, from the downstream end portion of the sliding contact portion 32Y1*m* to a downstream end portion of the electronic board 32Y1*f*.

In the present embodiments, the distance D shown in FIG. 45 is greater than the distance C shown in FIG. 44 (D>C). The distance C is regarded as positive (+) when the proximal limit position of the communicational area is upstream from the proximal end portion the pawl 76*a* in the installation direction X and as negative (−) when the upstream side limit position of the communicational area is downstream from the upstream end portion (proximal end) of the pawl 76*a* in the installation direction X. The distance D is regarded as positive (+) when the downstream end of the electronic board 32Y1*f* is upstream from the downstream end portion of the sliding contact portion 32Y1*m* in the installation direction X and as negative (−) when the downstream end of the electronic board 32Y1*f* is downstream from the downstream end portion the sliding contact portion 32Y1*m* in the installation direction X.

When the distance D is thus greater than the distance C (D>C), in inserting the toner container 32Y into the toner container mount 31, the electronic board 32Y1*f* doest not yet enter the communicational area of the antenna board 74 when the downstream end portion of the sliding contact portion 32Y1*m* of the toner container 32Y starts to contact the pawl 76*a* (shown in FIG. 14). Therefore, before installation of the toner container 32Y in the toner container mount 31 is completed, driving of the motor 92 and data writing on the electronic board 32Y1*f* can be stopped because the output from the antenna board 74 is off outside the communicational area (shown in FIG. 44) even of the output of the lever position detector 79 is on.

In the state shown in FIG. 14, the toner container 32Y can move freely because the first grooves 32Y1*g* do not fit around the positioning protrusions 78. If data is written in or read out from the electronic board 32Y1*f* in this state, it is possible that the electronic board 32Y1*f* is moved outside the communicational area of the antenna board 74 during data writing or reading, resulting in a communication error. Thus, the electronic board 32Y1*f* or the antenna board 74, or both can be damaged seriously. Therefore, the relative positions of the toner container 32Y and the toner container mount 31 are set so that the distance D is greater than the distance C (D>C). With this arrangement, rotation of the toner container 32Y, and the data writing and reading from the electronic board 32Y1*f* can be executed only after the toner container 32Y is secured in the toner container mount 31.

Next, a feature of the toner container 32Y is described below in detail.

Figure 46:
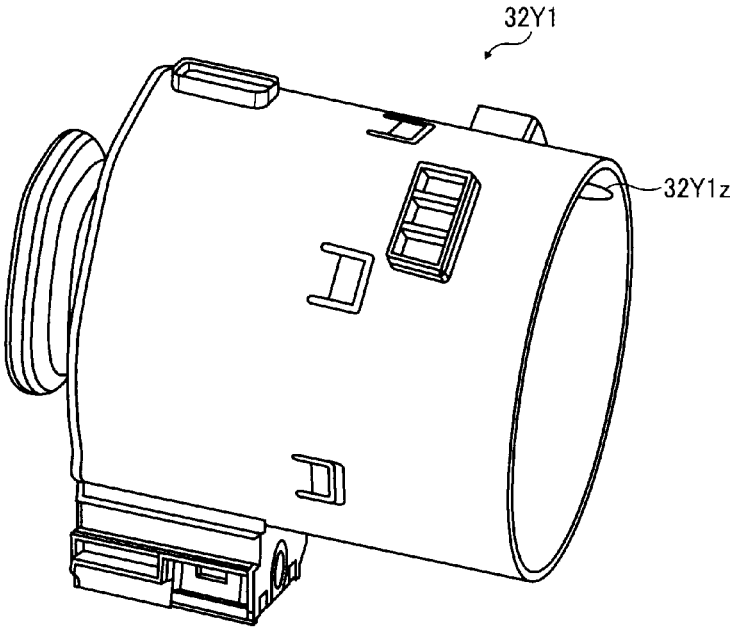
FIG. 46 is a schematic perspective view illustrating the cap of the toner container.
Figure 47:
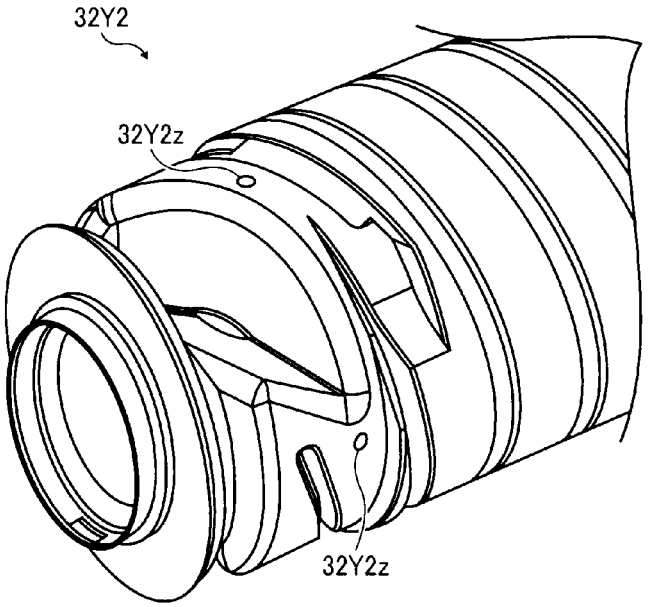
FIG. 47 is a schematic perspective view illustrating a front portion of the bottle in the toner container.

FIG. 46 is a perspective view illustrating the cap 32Y1 of the toner container 32Y for yellow. In FIG. 46, a cap projection 32Y1*z* that projects inward (toward a center axis of rotation of the bottle 32Y2) are provided in an inner circumferential face of the cap 32Y1. FIG. 47 is a perspective view illustrating the front portion of the bottle 32Y2 in the toner container 32. In FIG. 47, multiple bottle projections 32Y2*z* that project outward from an outer circumferential face of the bottle 32Y2 are arranged in a circumferential direction of the bottle 32Y2. The bottle projection 32Y2*z* serves as a container-body projection, the cap projections 32Y1*z* serves as a holder projection.

First Embodiment

Figure 48:
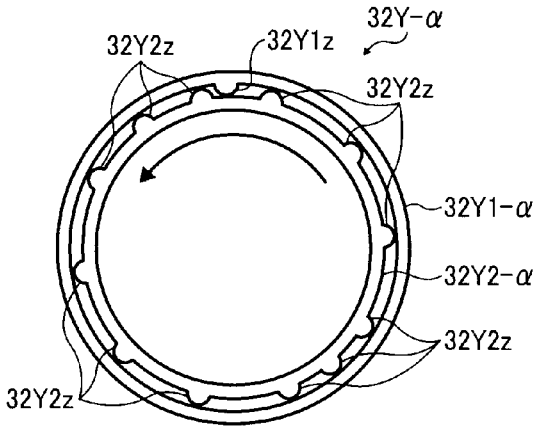
FIG. 48 is a cross-sectional view illustrating an engagement portion between the ca and the bottle in the toner container according to one illustrative embodiment of the present invention.

FIG. 48 is a cross-sectional view illustrating an engagement portion between a cap 32Y1-α and a bottle 32Y2-α of a first embodiment that is acceptable for the toner container 32Y according to aspect of this disclosure. As shown in FIG. 48, the cap 32Y1-α receives the front portion of the bottle 32Y2-α in a rotary axis direction and holds the bottle 32Y2-α rotatably. In this configuration shown in FIG. 48, single cap projection 32Y1*z* is provided on an inner circumferential face of the cap 32Y1-α that faces the front portion of the bottle 32Y2-α, and multiple bottle projection 32Y2*z* are arranged on an outer circumferential face of the bottle 32Y2-α in a circumferential direction thereof.

While the bottle 32Y2-α is rotated in 360 degrees, the respective twelve bottle projections 32Y2*z* provided on the front portion of the outer circumferential face of the bottle 32Y2-α contact and separate from the single cap projection 32Y1*z* provided on the inner circumferential face of the cap 32Y1-α once. Then, vibration is generated in the cap 32Y1-α and the bottle 32Y2-α while the bottle projections 32Y2*z* contact and separate from the cap projection 32Y1*z*. That is, the container-body projection repetitively contacts and separates from the holder projection with rotation of the container body to vibrate the container body and the holder. The agglomeration (coagulation) of the toner formed in the cap 32Y1-α and the bottle 32Y2-α is broken up by transmitting the vibration to the toner in the cap 32Y1-α and the bottle 32Y2-α. With this configuration, the agglomeration in the toner container 32Y-α can be broken up without providing a rotary conveyance member, and without stopping rotation the bottle 32Y2-α and conveyance the toner by reverse rotation of the bottle 32Y2-α.

A clearance, or gap, is provided between the bottle 32Y2-α and the cap 32Y1-α so that, the bottle 32Y2-α is jolted in the cap 32Y1-α while being rotated in the cap 32Y1-α. The bottle 32Y2-α moves freely in a vertical direction within a predetermined jolting range, and the bottle projection 32Y2*z* provided on the bottle 32Y2 can cross over the cap projection 32Y1*z* while contacting the cap projection 32Y1*z*.

More specifically, as shown in FIG. 48, in the configuration in which the cap projection 32Y1*z* is provided at a predetermined position, for example, at the 12-o'clock position of the inner circumferential face of the cap 32Y1-α, one of the twelve bottle projection 32Y2 that is moved to at the 12-o'clock position contacts the cap projection 32Y1*z*. Alternatively, when no bottle projection 32Y2*z* is positioned at the 12-o'clock position facing the cap projection 32Y1*z*, the outer circumferential face of the bottle 32Y2-α contacts the cap projections 32Y1*z*. This is because, the bottle 32Y2-α is pressed upward by a spring. When any one of the twelve bottle projections 32Y2*z* starts contacting the cap projection 32Y1*z*, a force in a direction pressing against the spring via the cap projection 32Y1*z* is exerted to the bottle projection 32Y2*z* (the downward force is exerted to the bottle projection 32Y2*z*). Then, the bottle 32Y2-α moves to the direction pressing against the spring (moves downward). Due to the movement of the bottle 32Y2-α, the bottle projection 32Y2*z* can cross over the cap projection 32Y1*z*.

Although the toner container 32Y for the yellow is described above, the toner containers 32C, 32M, 32K for corresponding cyan, magenta, black are similar configuration to the toner container 32Y, and the descriptions thereof is omitted.

Figure 49:
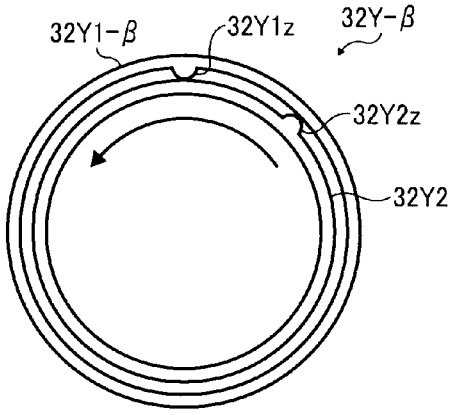
FIG. 49 is a cross-sectional view illustrating an engagement portion between a cap and a bottle in another embodiment of a toner container.
Figure 50:
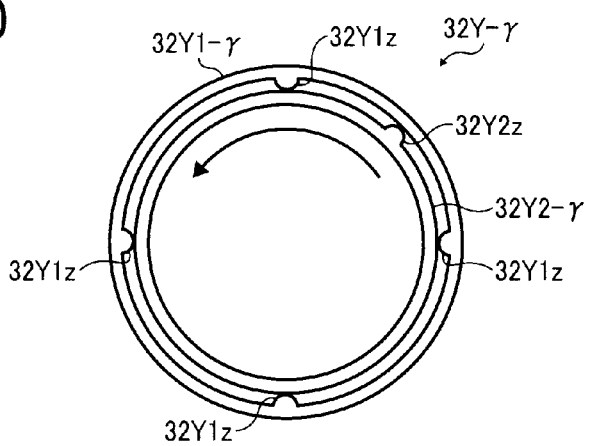
FIG. 50 is a cross-sectional view illustrating an engagement portion between a cap and a bottle in another embodiment of a toner container.
Figure 51:
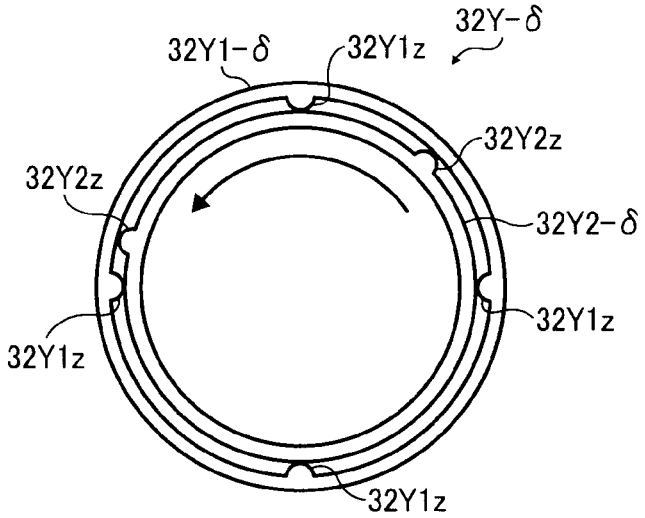
FIG. 51 is a cross-sectional view illustrating an engagement portion between a cap and a bottle in another embodiment of a toner container.
Figure 52:
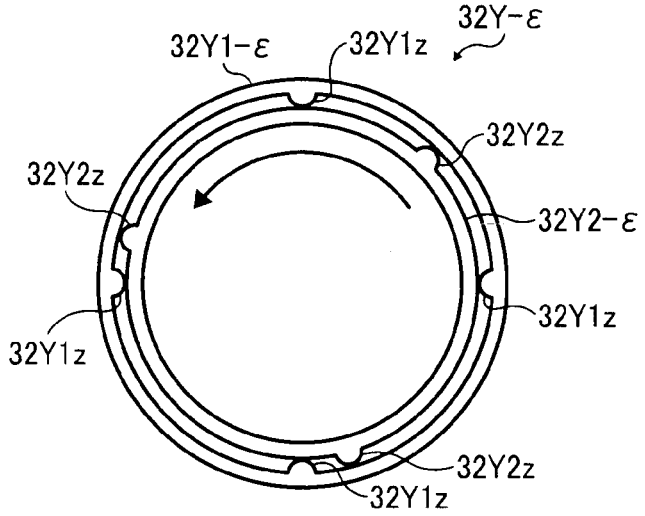
FIG. 52 a cross-sectional view illustrating an engagement portion between a cap and a bottle in another embodiment of a toner container.

Next, configurations of the toner container 32Y according to other embodiments thereof are described in detail. FIG. 49 shows a toner container 32Y-β according to a second embodiment. FIG. 50 shows a toner container 32Y-γ according to a third embodiment. FIG. 51 shows a toner container 32Y-δ according to a fourth embodiment. FIG. 52 shows a toner container 32Y-ϵ according to a fifth embodiment.

Second Embodiment

In the toner container 32Y-β according to the second embodiment shown in FIG. 49, single cap projection 32Y1*z* is provided on a cap 32Y1-β, and single bottle projection 32Y2*z* is provided on a bottle 32Y2-β. In this embodiment, when the bottle 32Y2-β rotates 360-degrees, the bottle projection 32Y2*z* contacts and separates from the cap projection 32Y1*z* once. In this configuration, when the bottle 32Y2-β rotates once per second, 1 Hz of vibration is applied to the bottle 32Y2-β and the cap 32Y1-β.

Third Embodiment

In the toner container 32Y-γ according to the third embodiment shown in FIG. 50, four cap projections 32Y1*z* are provided on a cap 32Y1-γ, and single bottle projection 32Y2*z* is provided on a bottle 32Y2-γ. The four cap projections 32Y1*z* provided on an outer circumferential face of the cap 32Y1-γ are arranged in a circumferential direction of the cap 32Y1-γ. The phase positions of respective four cap projections 32Y1*z* are shifted 90 degrees from each other. In this embodiment, when the bottle 32Y2-γ rotates in 360-roll, the single bottle projection 32Y2*z* contacts and separates from the four cap projections 32Y1*z* one time each, thus, vibration is generated four times per rotation. In this configuration, when the bottle 32Y2-γ rotates once per second, 4 Hz of vibration is applied to the bottle 32Y2-γ and the cap 32Y1-γ.

Fourth Embodiment

In the toner container 32Y-δ according to the fourth embodiment shown in FIG. 51, four cap projections 32Y1*z* are provided on a cap 32Y1-δ, and two bottle projections 32Y2*z* are provided on a bottle 32Y2-δ. The four cap projections 32Y1*z* provided on an outer circumferential face of the cap 32Y1-γ are arranged in a circumferential direction of the cap 32Y1-γ. The two bottle projections 32Y2*z* provided on an outer circumferential face of the bottle 32Y2-γ are arranged in a circumferential direction of the bottle 32Y2-γ. Similarly to the third embodiment, the phase positions of respective four cap projections 32Y1*z* are shifted 90 degrees from each other, and the phase positions of the two bottle projections 32Y2*z* are shifted 120 degrees or 240 degrees from each other.

In this embodiment, when the bottle 32Y2-δ rotates 360-degrees, the respective two bottle projections 32Y2*z* contact and separate from the four cap projections 32Y1*z* one time each, separately. While one of the two bottle projections 32Y2*z* contacts any one of the four cap projections 32Y1*z*, the other bottle projection 32Y2*z* is located in a position where the other bottle projection 32Y2*z* does not contact any other one of the cap projections 32Y1*z*. More specifically, in a rotary direction, a position at which the one of the two bottle projection 32Y2*z* contacts the any one of the four cap projection 32Y1*z* is defined as a "reference position", the other bottle projection 32Y2*z* is located at a phase position shifted 120 degrees or 240 degrees downstream from the reference position in the rotary direction. Conversely, three cap projections 32Y1*z* other than the one cap projection 32Y1*z* positioned at the reference position are located at phase positions shifted 90 degrees, 180 degrees, and 270 degrees downstream from the reference position in the rotary direction, respectively. Therefore, the other bottle projection 32Y2*z* does not contact any other cap projections 32Y1*z* positioned at respective 90 degrees, 180 degrees, and 270 degrees shifted from the reference position while the one of bottle projection 32Y2*z* positioned at the reference position contacts the one of cap projections 32Y1*z*.

Namely, in the fourth embodiment, the two bottle projections 32Y2*z* on the outer circumferential face of the bottle 32Y2-δ and the cap projections 32Y1*z* on the inner circumferential face of the cap 32Y1-δ is designed to be arranged at predetermined pitches (intervals) so as not to contact the two bottle projections 32Y2*z* with two of four cap projections 32Y1*z* at the same time. That is, the bottle projections 32Yz do not all contact the cap projection 32Y1*z* at the same time.

Thus, vibration is generated eight times per rotation. In this configuration, when the bottle 32Y2-δ rotates once per second, 8 Hz of vibration is applied to the bottle 32Y2-δ and the cap 32Y1-δ.

Fifth Embodiment

In the toner container 32Y-ϵ according to the fifth embodiment shown in FIG. 52, four cap projections 32Y1*z* are provided on a cap 32Y1-ϵ, and three bottle projections 32Y2*z* are provided on the bottle 32Y2-ϵ. The four cap projections 32Y1*z* provided on an outer circumferential face of the cap 32Y1-γ are arranged in a circumferential direction of the cap 32Y1-γ. The three bottle projections 32Y2*z* provided on an outer circumferential face of the bottle 32Y2-γ are arranged in a circumferential direction of the bottle 32Y2-γ. Similarly to the third and fourth embodiments, the phase positions of respective four cap projections 32Y1*z* are shifted 90 degrees from each other, and the phase positions of three bottle projections 32Y2*z* are shifted 120 degrees from each other.

In this embodiment, when the bottle 32Y2-ϵ rotates 360 degrees, the respective three bottle projections 32Y2*z* contact and separate from the respective four cap projections 32Y1*z* one time each, separately. While one of the three bottle projections 32Y2*z* contact any one of the four cap projections 32Y1*z*, the others of bottle projections 32Y2*z* do not contact any other cap projections 32Y1*z*. More specifically, in a rotary direction, a position at which the one of the three bottle projections 32Y2*z* contacts the any one of the four cap projections 32Y1*z* is defined as a "reference position", another the bottle projections 32Y2*z* is located at a phase position shifted 120 degrees, and the other bottle projections 32Y2*z* is located at a phrase position shifted 240 degrees downstream from the reference position in the rotary direction. Conversely, three cap projections 32Y1*z* other than the one cap projection 32Y1*z* positioned at the reference position are located at a phase position shifted 90 degrees, 180 degrees, 270 degrees downstream from the reference position in the rotary direction, respectively. Therefore, while the one of the three bottle projections 32Y2*z* contacts any one of the four cap projections 32Y1*z*, there is no chance to contact any other three cap projections 32Y1*z* located other than the reference position with the bottle projections 32Y2*z* located the phase position shifted 120 degrees downstream from the reference position or the bottle projections 32Y2*z* located the phase position shifted from 240 degrees downstream from the reference position.

Namely, in the fifth embodiment, the three bottle projections 32Y2*z* on the outer circumferential face of the bottle 32Y2-ϵ and the cap projections 32Y1*z* on the inner circumferential face of the cap 32Y1-ϵ are designed to be arranged at predetermined pitches (intervals) so as not to contact more than one of three bottle projections 32Y2*z* with more than one of the four cap projections 32Y1*z* at the same time. That is, the bottle projections 32Yz do not all contact the cap projection 32Y1*z* at the same time.

Thus, vibration is generated twelve times per rotation. In this configuration, when the bottle 32Y2-ϵ rotates once per second, 12 Hz of vibration is applied to the bottle 32Y2-ϵ and the cap 32Y1-ϵ.

(Experiment)

The inventors carried out a printing test as an experiment using the above-described embodiments of the toner containers 32Y-β, 32Y-γ, 32Y-δ, and 32Y-ϵ shown in FIGS. 49 through 52. In this printing test, a relation among numbers of vibration, mass of agglomeration per toner 1*g*, and numbers of white spots in output image that is image failures in which toner is partly absent (generation number per A3 sized paper) was examined.

In the process in the printing test, initially, the four embodiments of the toner container 32Y-β, 32Y-γ, 32Y-δ, and 32Y-ϵ were left under the same condition and same time period, and the Y toner was agglomerated in the respective toner containers 32Y-β, 32Y-γ, 32Y-δ, and 32Y-ϵ.

Subsequently, while the embodiments of the bottle bodies 32Y2-0, 32Y2-γ, 32Y2-6, and 32Y2-ϵ were rotated once per second, the test printing in which image area 5% of test image were continuously printed to multiple A3 sized paper were executed. Since the rotational velocity of the bottle bodies 32Y2-13, 32Y2-γ, 32Y2-6, and 32Y2-ϵ is one rotation per second, during the test printing, 1 Hz, 4 Hz, 8 Hz, and 12 Hz of vibrations were generated in the respective second embodiment shown in FIG. 49, third embodiment shown in FIG. 50, fourth embodiment shown in FIG. 51, and fifth embodiment shown in FIG. 52.

When the respective embodiments were used, the number of the white spots was measured. In addition, after the test printing, the Y toner contained in the bottle bodies 32Y2-13, 32Y2-γ, 32Y2-6, and 32Y2-ϵ and the caps 32Y1-0, 32Y1-γ, 32Y1-6, and 32Y1-ϵ were gently ejected therefrom. Then, 1 g of the toner thus ejected was passed through 500 μm mesh grid of a sieve. Subsequently, the agglomeration of the Y-toner remained on the mesh grid of the sieve was measured as a measure result, and "a mass of the agglomeration" contained in the Y (yellow) toner was defined as a value that multiplied the measure result by 0.5.

Herein, in all embodiments, the toner containers 32Y-β, 32Y-γ, 32Y-δ, and 32Y-ϵ contain a low-temperature fixed type toner for Y toner. Since the low-temperature fixed type toner can be softened and fixed on a paper at low thermal energy, in recent years with increased the demand for saving energy, many manufacturers adapt the low temperature fixed type toner.

However, the toner may be more likely to form agglomeration, instead of reducing thermal energy for fixing and saving energy.

Figure 53:
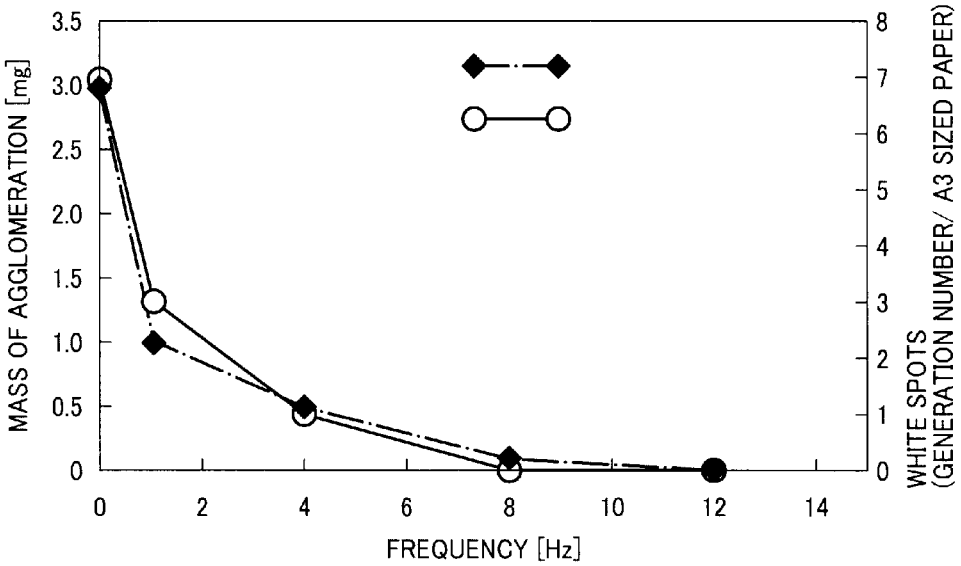
FIG. 53 shows relation among numbers of vibration, mass of agglomeration, and numbers of white spot in formed image.

FIG. 53 shows a relation among numbers of vibration, the mass of agglomeration, and the numbers of the white spots in the formed image (image failures in which toner is partly absent), which are measured by the experiment. With reference to FIG. 53, it can be seen that, as the frequency of vibration is increased, the agglomeration of the toner and the numbers of the white spots can be reduced. This is because, as the frequency of vibration is increased, greater impact is applied to the agglomeration of the toner, which promotes destruction of the agglomeration. In addition, since the agglomeration makes the white spots, it has been experimentally proven that the number of white spots is decreased as the agglomeration of the toner is decreased.

Herein, it is preferable the fifth embodiment of the toner container 32Y-ϵ shown in FIG. 52 be adapted as the toner container 32Y, 32M, 32C, and 32K in the aspect of this disclosure.

The toner container 32Y-ϵ according to fifth embodiment shown in FIG. 52 can generate the same frequency of vibration to the toner container 32Y-α according to the first embodiment shown in FIG. 48. For example, when the bottle 32Y2-α of the toner container 32Y-α shown in FIG. 48 is rotated once per second, 12 Hz of the vibration is generated. Similarly to the toner container 32Y-α, in the toner container 32Y-ϵ, when the bottle 32Y2-ϵ of the toner container 32Y-ϵ shown in FIG. 52 is rotated once per second, 12 Hz of the vibration is generated.

As described above, although the frequency of the vibration is identical between the toner container 32Y-α shown in FIG. 48 and the toner container 32Y-ϵ shown in FIG. 52, there are two different points therebetween.

The first different point therebetween is friction load to the cap projection 32Y1*z*. In the toner container 32Y-α shown in FIG. 48, the single cap projection 32Y1*z* is provided on the inner circumferential face of the cap 32Y1-α. With this configuration, in order to generate the vibration twelve times per second by using the single cap projection 32Y1*z*, the twelve bottle projections 32Y2*z* are provided on the bottle 32Y2-α. When the bottle 32Y2-ϵ rotates 360-degrees, the single cap projection 32Y1*z* contacts and separates the twelve bottle projections 32Y2*z* one time each, separately. That is, the single cap projection 32Y1*z* contacts and separates from the bottle projections 32Y2*z* twelve times per rotation.

By contrast, in the toner container 32Y-ϵ shown in FIG. 52, four cap projections 32Y1*z* are provided on the inner circumferential face of the cap 32Y1-ϵ. With this configuration, in order to generate the vibration twelve times per second by using the four cap projections 32Y1*z*, three bottle projections 32Y2*z* are provided on the bottle 32Y2-ϵ. When the bottle 32Y2-ϵ rotates 360-degrees, the respective four cap projections 32Y1*z* contact and separate from the respective three bottle projections 32Y1*z* one time each, separately. That is, each of the cap projections 32Y1*z* contacts and separates from the bottle projections 32Y2*z* three times per rotation.

Thus, although the cap projection 32Y1*z* in the toner container 32Y-α shown in FIG. 48 contacts and separates from the bottle projections 32Y2*z* twelve times per rotation, the each cap projection 32Y1*z* in the toner container 32Y-ϵ shown in FIG. 52 contacts and the separates from the bottle projections 32Y2*z* three times per rotation. Therefore, in the toner container 32Y-ϵ shown in FIG. 52, the friction load to the cap projections 32Y1*z* can be reduced to quarter of that in the toner container 32Y-α and the life of the toner container can be increased.

The second different point between the toner container 32Y-α shown in FIG. 48 and the toner container 32Y-ϵ shown in FIG. 52 is vibration generation position. More specifically, in the toner container 32Y-α shown in FIG. 48, the single cap projection 32Y1*z* is provided at only one position, for example, at the 12-o'clock position, on the inner circumferential face of the cap 32Y1-α. With this configuration, the vibration is generated only 12-o'clock position on the circumferential direction, fluctuation in crash ability of toner agglomeration may occur in the circumferential direction of the toner container 32Y-α shown in FIG. 48. The great vibration is less likely to transmit to the 6-o'clock position positioned opposite to the 12-o'clock position at which the cap projection 32Y1*z* is provided, it is difficult to break up (destroy) the agglomeration of the toner positioned in vicinity of the 6-o'clock position by the vibration.

By contrast, in the toner container 32Y-ϵ shown in FIG. 52, the phase positions of respective four cap projections 32Y1*z* are shifted 90 degrees from each other. Thus, the fluctuation in the crash ability of the toner agglomeration in the circumferential direction can be alleviated.

Sixth Embodiment

Figure 54:
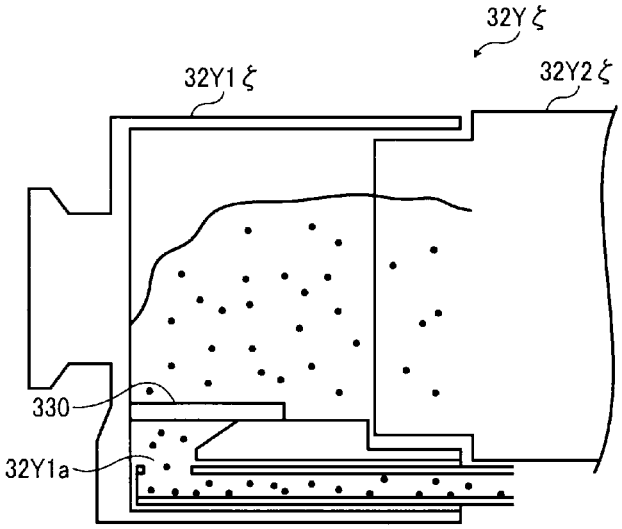
FIG. 54 is a partly vertical cross-sectional view illustrating a front edge of the cap of the toner container.
Figure 55:
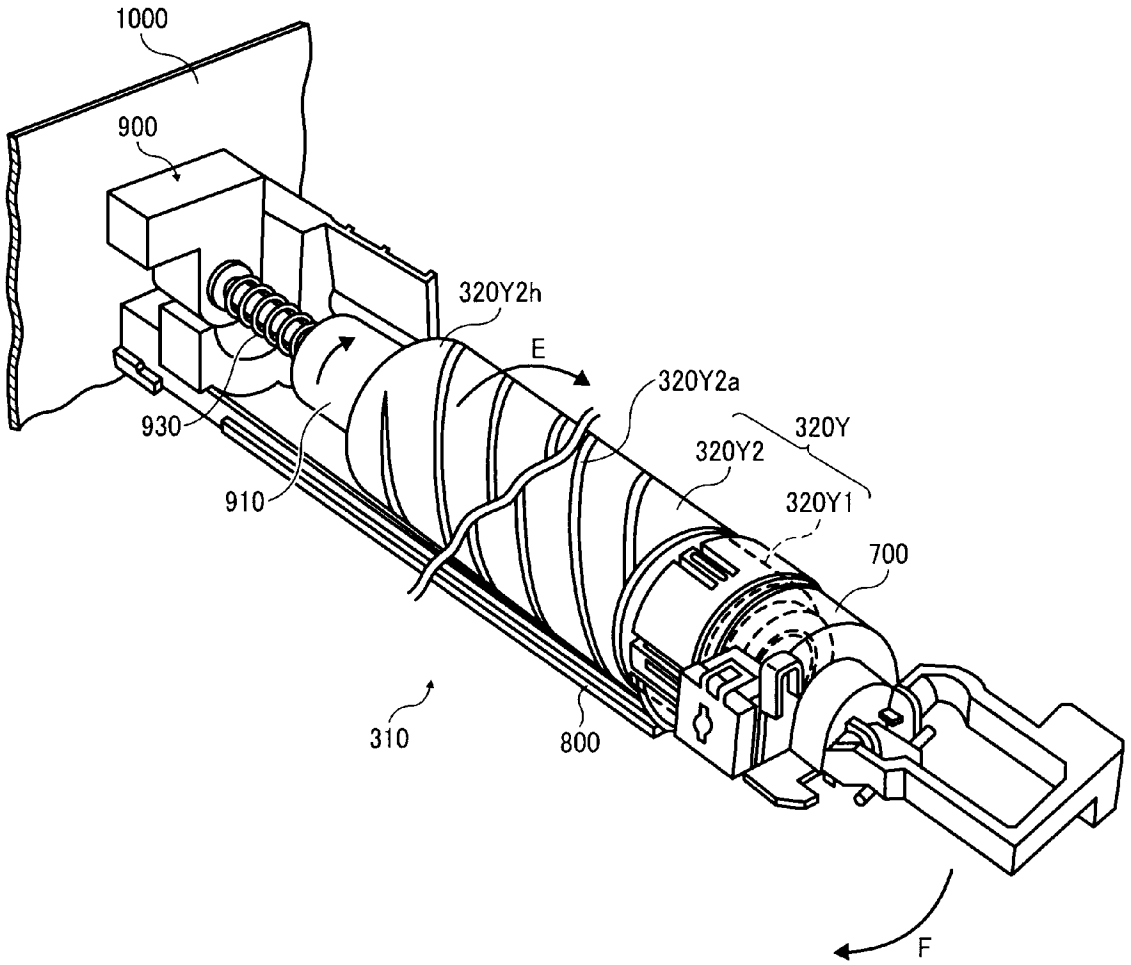
FIG. 55 RELATED ART
FIG. 55 is a schematic perspective diagram illustrating a related art toner container installed in a toner supply device.
Figure 56:
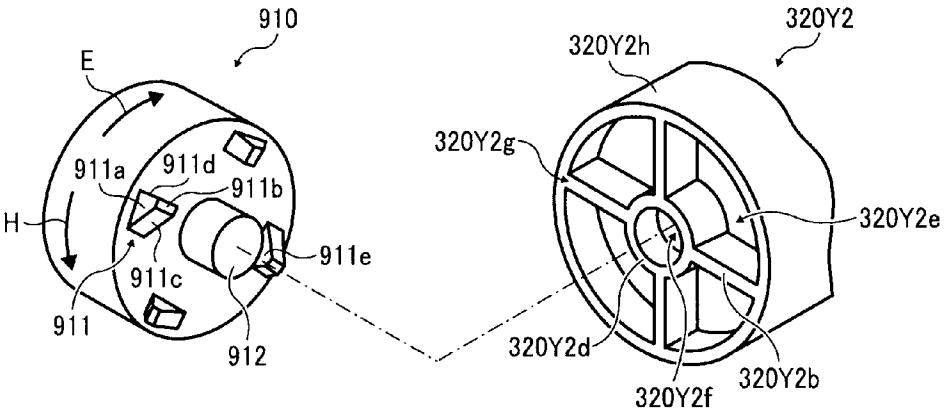
FIG. 56 RELATED ART
FIG. 56 is an enlarged perspective diagram illustrating a coupling engaged portion of a bottle in the toner container and the coupling member in the toner supply device shown in FIG. 55.
Figure 57:
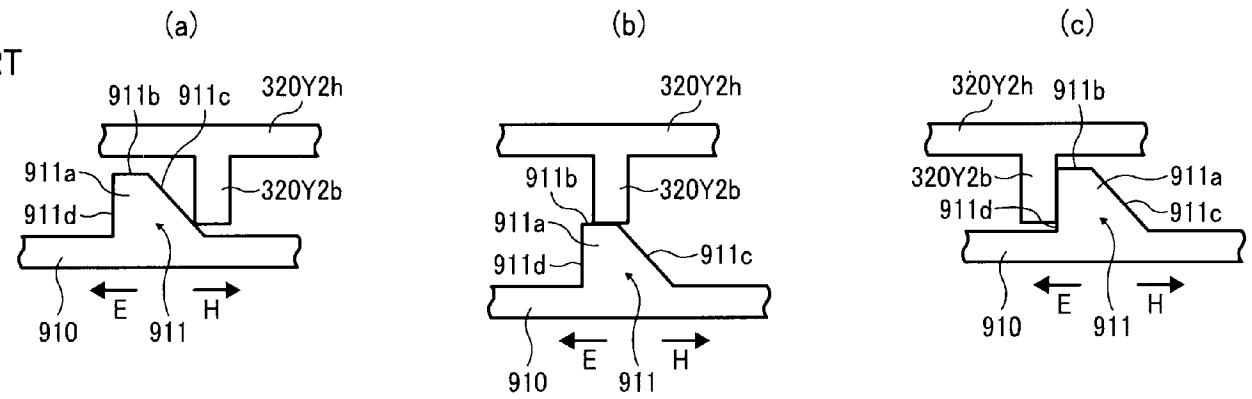
FIG. 57 RELATED ART
FIG. 57 is a schematic diagram illustrating a contact and separate process in the coupling engaged portion and the coupling member shown in FIG. 56.

FIG. 54 is a partly vertical cross-sectional view illustrating a front edge of a toner container 32Y-ζ of a sixth embodiment that is acceptable for the toner container 32Y according to aspect of this disclosure.

As shown in FIG. 54, a screen (mesh) 330 is hanged in a cap 32Y1-ζ. More specifically, the screen 330 is positioned across a path through which the Y toner in the cap 32Y1-ζ conveyed from the bottle 32Y1-ζ is moved (discharged) to the toner outlet 32Y1*a*. By thus providing the screen 330, only toner particles smaller than mesh size (mesh grid size) in the screen 330 can pass through the path and the toner thus passed is discharged to the toner outlet 32Y1*a*.

In a state in which the agglomeration is contained in the Y toner, the agglomerated toner cannot pass through the mesh size (mesh grid size) in the screen 330, the agglomerated toner clogs a toner entrance face (upper face shown in FIG. 54) of the screen 330. In this state, when the vibration generated by contacting and separating the cap projection 32Y1*z* with and from the bottle projection 32Y2*z* is applied to the cap 32Y1-ζ, the vibration is transmitted to the screen 330, and the screen 330 punches the agglomerated toner hanged in the toner entrance face of the screen 330. Thus, the agglomeration of the toner is effectively broken up. In addition, because the screen 330 catches the big agglomeration, the conveyance of the big agglomeration to the development device 5Y can be prevented, and the white spot caused by the agglomeration of the toner can be alleviated.

Herein, a comparison experiment was carried out with the toner container 32Y-ζ according to the present embodiment and a toner container according to a comparative example in which any cap projection and bottle projection is not provided therein. More specifically, the toner containers according to the comparative example are set in the printer, continuous printing test was executed. In the experiment using comparative example, the toner containers 32Y including various sizes of mesh sizes of screens, from big mesh size to small mesh size in order of precedence were tried. At time, when the mesh size in the screen 330 became set to 800 μm, the screen 330 caught a great amount of the agglomeration of the toner, then, it was difficult for the screen 330 to discharge the toner passing through the screen 330. By contrast, in the toner container 32Y-ζ according to the present embodiment included in the image forming apparatus 1, by contacting and separating the cap projection 32Y1*z* with and from the bottle projection 32Y2*z*, the screen 330 thus vibrated punches the agglomeration of the toner, and the agglomeration of the toner could be effectively broken up. Accordingly, even when the mesh size in the screen 330 was set diminished to 500 μm, the agglomeration of the toner did not clog the screen 330.

It is to be noted, in a case in which the toner container 32Y-ζ contains developer formed of toner and magnetic carrier instead of only toner, the mesh size of the screen 330 may be set larger than average particles of the magnet carrier.

Although the toner container of the embodiments of the present disclosure is used in so-called tandem-type multicolor printer including four image forming units corresponding to yellow, cyan, magenta, and black, the toner container 32Y in the above-described embodiments can adapted in a color image printer including single image forming unit. In order to or color image by the image forming unit, the Y, M, C, and K toner images are subsequently formed on a single photoreceptor, and theses images are superimposed onto an intermediate transfer member.

In the above-described toner container 32Y-α and 32Y-γ shown in FIGS. 48 and 50, the multiple projections (bottle projections 32Y2*z* in FIG. 48 and cap projections in FIG. 50), serving as the container-body projections or holder projections, that are arranged in a circumferential direction are provided on at least one of the bottle 32Y2-α and the cap 32Y1-γ, and a single projection (cap projection in FIG. 48 and bottle projection in FIG. 50) is provided on the other. With this configuration, while the bottle 32Y2 (container body) rotates 360-degrees, the cap projection 32Y1*z* and the bottle projection 32Y2*z* contacts and separates multiple times, and therefore, the vibration is generated multiple times in the toner container 32Y.

In the above-described toner containers 32Y-δ and 32Y-ϵ shown in FIGS. 51 and 52, the multiple projections are provided on both the bottle 32Y2-δ (32Y2-ϵ) and the cap 32Y1-δ (32Y1-ϵ). The multiple bottle projections 32Y2*z* are arranged in the circumferential direction of the bottle 32Y2, and multiple cap projection 32Y1*z* are arranged in the circumferential direction of the cap 32Y1. With this configuration shown in FIGS. 51 and 52, compared with the configuration in which one of the single the bottle projection 32Y2*z* and single cap projection 32Y1*z* is provided in the toner container shown in FIGS. 48 and 50, better result can be achieved. That is, the friction load to the projections 32Y2*z* and 32Y1*z* is reduced, and the life of the bottle 32Y2 (32Y2-δ, 32Y2-ϵ) and the cap 32Y1 (32Y1-δ, 32Y1-ϵ) can be increased. In addition, the fluctuation in crash ability of toner agglomeration in the circumferential direction is decreased, and the agglomeration can be broken up effectively.

In the above-described toner container 32Y shown in FIGS. 51 and 52, the arrangement pitch among the multiple cap projections 32Y1*z* and arrangement pitch among the multiple bottle projections 32Y2*z* are set so that the bottle projections 32Y2*z* do not all contact the holder projections 32Y1*z* at the same time. With this configuration, the occurrence of the rotation failure of the bottle 32Y2 caused by contacting the two respective bottle projections 32Y2*z* with the two or more the cap projections 32Y1*z* at the same times can be avoid.

In the above-described toner container 32Y-ζ as shown in FIG. 54, the screen 330 whose mesh size is rougher (greater) than toner particles is provided in the toner pass in the cap 32Y1-ζ, and the toner is discharged to the toner outlet 32Y1*a* via the screen 330. As described above, the screen 330 punches the agglomerated toner caught in the screen 330, the agglomeration of the toner can be broken up effectively. In addition, the screen 330 catches the big agglomeration, thus avoiding the big agglomeration from being supplied to the development device, which can prevent the occurrence of the white spot of the output image caused by the agglomeration of the toner.

The number, position, and shape of the components of the image forming apparatus described herein are not limited to those described above. Numerous additional modifications and variations are possible in light of the above teachings. It is therefore to be understood that, within the scope of the appended claims, the disclosure of this patent specification may be practiced otherwise than as specifically described herein.

What is claimed is:

1. A powder container comprising:

a cylindrical container body to contain a powder, having an opening in one end thereof, to convey the powder contained in the container body to the opening with rotation of the container body, having a conveyor to convey the powder toward the opening, and having a container-body projection provided on an outer circumferential surface thereof at a position upstream from the opening in a powder conveying direction of the conveyor; and a cylindrical holder, into which the one end of the container body having the opening is inserted, to hold the container body rotatably, having a powder outlet through which the powder is discharged from the holder, a holder projection provided on an inner circumferential surface thereof at a position facing the container-body projection of the container body, and a toner reservoir to which the powder is discharged from the opening, wherein the container-body projection repetitively contacts and separates from the holder projection with said rotation of the container body to vibrate the container body and the holder.

2. The powder container according to claim 1, wherein the container body comprises at least one additional container-body projection to form multiple container-body projections, and the multiple container-body projections are arranged in a circumferential direction of the container body.

3. The powder container according to claim 1, wherein the holder comprises at least one additional holder projection to form multiple holder projections, and the multiple holder projections are arranged in a circumferential direction of the holder.

4. The powder container according to claim 1, wherein the container body comprises at least one additional container-body projection, the holder comprises at least one additional holder projection, and the respective multiple container-body projections and the respective multiple holder projections are arranged in circumferential directions thereof at predetermined arrangement pitches.

5. The powder container according to claim 4, wherein the arrangement pitch among the respective container-body projections and the arrangement pitch among the respective holder projections are set so that the container-body projections do not all contact the holder projection at the same time.

6. The powder container according to claim 1, wherein the holder comprises a screen having a mesh size larger than a particle size of the powder and through which the powder located in the holder is discharged to the powder outlet formed in the holder.

7. The powder container according to claim 1, wherein a spiral protrusion is formed in an inner circumferential face of the container body and the spiral protrusion conveys the powder contained in the container body to the opening with rotation of the container body.

8. The powder container according to claim 1, wherein the powder comprises toner.

9. The powder container according to claim 1, wherein the powder comprises developer.

10. The powder container according to claim 1, wherein the holder is a cap.

11. An image forming apparatus comprising:

an image forming unit to form a toner image;

a toner supply device to supply toner to the image forming unit; and a toner container to supply the toner to the toner supply device, the toner container comprising:

a cylindrical container body to contain a powder, having an opening in one end thereof, to convey the powder contained in the container body to the opening with rotation of the container body, having a conveyor to convey the powder toward the opening, and having a container-body projection provided on an outer circumferential surface of the container body at a position upstream from the opening in a powder conveying direction of the conveyor; and a cylindrical holder, into which the one end of the container body having the opening is inserted, to hold the container body rotatably, having a powder outlet through which the powder is discharged from the holder, a holder projection provided on an inner circumferential surface thereof at a position facing the container-body projection of the container body, and a toner reservoir to which the powder is discharged from the opening, wherein the container-body projection repetitively contacts and separates from the holder projection with said rotation of the container body to vibrate the container body and the holder.

12. The image forming apparatus according to claim 11, wherein the container body of the toner container comprises at least one additional container-body projection to form multiple container-body projections; and the multiple container-body projections are arranged in a circumferential direction of the container body.

13. The image forming apparatus according to claim 11, wherein the holder of the toner container comprises at least one additional holder projection to form multiple holder projections, and the multiple holder projections are arranged in a circumferential direction of the holder.

14. The image forming apparatus according to claim 11, wherein the container body of the toner container comprises at least one additional container-body projection, the holder comprises at least one additional holder projection, and the respective multiple container-body projections and the respective multiple holder projections are arranged in circumferential directions thereof at predetermined arrangement pitches.

15. The image forming apparatus according to claim 14, wherein the arrangement pitch among the respective container-body projections and the arrangement pitch among the respective holder projections are set so that the container-body projections do not all contact the holder projection at the same time.

16. The image forming apparatus according to claim 11, wherein the holder of the toner container comprises a screen having a mesh size larger than a particle size of the powder and through which the powder located in the holder is discharged to the powder outlet formed in the holder.

17. The image forming apparatus according to claim 11, wherein a spiral protrusion is formed in an inner circumferential face of the container body of the toner container and the spiral protrusion conveys the toner contained in the container body to the opening with rotation of the container body.

18. The image forming apparatus according to claim 11, wherein the holder is a cap.

19. The image forming apparatus according to claim 11, further comprising additional multiple containers to store mutually different colors of toners.

* * * * *